US011713061B2

(12) United States Patent
Jones et al.

(10) Patent No.: US 11,713,061 B2
(45) Date of Patent: Aug. 1, 2023

(54) HOPPER RAILROAD CAR HAVING TOP HATCH COVER ASSEMBLY

(71) Applicant: Gunderson LLC, Portland, OR (US)

(72) Inventors: Peter L. Jones, Southlake, TX (US); Victor Mankarious, Euless, TX (US); James A. Warwick, North Richland Hills, TX (US); Steven James Knight, Mission Hill, SD (US); Jordan Paul Liske, Yankton, SD (US)

(73) Assignee: Gunderson LLC, Portland, OR (US)

( * ) Notice: Subject to any disclaimer, the term of this patent is extended or adjusted under 35 U.S.C. 154(b) by 375 days.

(21) Appl. No.: 17/001,949

(22) Filed: Aug. 25, 2020

(65) Prior Publication Data

US 2022/0063682 A1 Mar. 3, 2022

(51) Int. Cl.
*B61D 7/02* (2006.01)

(52) U.S. Cl.
CPC ..... *B61D 7/02* (2013.01)

(58) Field of Classification Search
CPC ..... B61D 7/02; B61D 17/04; B61D 17/12; B61D 17/16
See application file for complete search history.

(56) References Cited

U.S. PATENT DOCUMENTS

| | | | | |
|---|---|---|---|---|
| 1,776,168 | A | 9/1930 | Sweeley et al. | |
| 2,239,033 | A | 4/1941 | Cartmill | |
| 3,190,238 | A | 6/1965 | Carney et al. | |
| 3,224,491 | A | 12/1965 | Wallace | |
| 3,348,602 | A | 10/1967 | Bertil | |
| 3,707,919 | A | 1/1973 | Adler | |
| 3,796,168 | A | 3/1974 | Zeller | |
| 4,040,363 | A | 8/1977 | Walk et al. | |
| 4,239,008 | A | 12/1980 | Conlon | |
| 4,245,565 | A | 1/1981 | Stark et al. | |
| 4,248,160 | A | 2/1981 | Carney et al. | |
| 4,376,542 | A | 3/1983 | Hennessy | |
| 4,452,150 | A * | 6/1984 | Dominguez | B61D 7/00 114/201 R |
| 4,638,743 | A | 1/1987 | Loomis | |
| 4,840,126 | A | 6/1989 | Kleykamp | |
| 5,311,824 | A | 5/1994 | Sauer et al. | |
| 5,785,362 | A | 7/1998 | Nadherny | |
| 6,827,025 | B2 | 12/2004 | Gaydos et al. | |

(Continued)

FOREIGN PATENT DOCUMENTS

| | | | |
|---|---|---|---|
| BR | 102014028426 | A2 | 9/2016 |
| DE | 3721146 | A1 | 1/1989 |

OTHER PUBLICATIONS

"Extended European Search Report", from corresponding European Patent Application No. 21192838.7, dated Jan. 28, 2022.

*Primary Examiner* — Robert J McGarry, Jr.
(74) *Attorney, Agent, or Firm* — Neal, Gerber & Eisenberg LLP

(57) ABSTRACT

Various embodiments provide a hopper railroad car top hatch cover assembly including a hatch cover and a hatch cover securer configured to secure the hatch cover in a closed position engaging a coaming of the hopper railroad car. Various embodiments provide a hopper railroad car having a top hatch cover assembly including a hatch cover and a hatch cover securer configured to secure the hatch cover in a closed position engaging a coaming of the hopper railroad car.

24 Claims, 38 Drawing Sheets

(56) References Cited

U.S. PATENT DOCUMENTS

| | | | |
|---|---|---|---|
| 7,823,515 | B2 | 11/2010 | Schaefer et al. |
| 8,056,486 | B2 | 11/2011 | Haymond et al. |
| 8,631,746 | B2 | 1/2014 | Knight et al. |
| 8,701,565 | B2 | 4/2014 | Creighton et al. |
| 8,826,827 | B1 | 9/2014 | Dimmer et al. |
| 9,783,212 | B2 | 10/2017 | Gibney et al. |
| 10,035,521 | B2 | 7/2018 | Williams |
| 2008/0029011 | A1 | 2/2008 | Czarnowski et al. |
| 2010/0258032 | A1 | 10/2010 | Haymond et al. |
| 2010/0307374 | A1 | 12/2010 | Kalal |
| 2012/0048140 | A1 | 3/2012 | Dial et al. |
| 2012/0152146 | A1 | 6/2012 | Blankenship |
| 2013/0020829 | A1 | 1/2013 | Smith et al. |
| 2017/0225694 | A1 | 8/2017 | Sandheinrich et al. |
| 2019/0112867 | A1 | 4/2019 | Warren |
| 2019/0161096 | A1 | 5/2019 | Warren |
| 2021/0046955 | A1 | 2/2021 | Jones et al. |
| 2021/0213981 | A1 | 7/2021 | Jones et al. |

* cited by examiner

HOPPER RAILROAD CAR HAVING TOP HATCH COVER ASSEMBLY

BACKGROUND

The railroad industry employs a variety of different railroad cars for transporting different materials. For example, various known railroad cars often carry bulk materials such as grain, and are sometimes call "hopper railroad cars." Known hopper railroad cars often include one or more openable top hatches that seal the top opening(s) of the hopper railroad car (when the hopper railroad car is not being loaded) to protect the materials in the hopper railroad car from the elements and other external sources. Various known hopper railroad cars also include one or more discharge chutes at the bottom of the hopper railroad car for unloading the materials from the hopper railroad car. Various known hopper railroad cars include one or more internal walls that provide structure to the hopper railroad car and that direct the materials in the hopper railroad car toward the discharge chute(s). To load various known hopper railroad cars, the hopper railroad car is positioned underneath a material loading assembly, and the top hatch(es) are opened. Opening the top hatch(es) often require(s) specialized machinery and/or a worker to be physically present on the top of the hopper railroad car to open the top hatch(es).

There is a continuing need to provide improved hopper railroad cars, such as hopper railroad cars that have one or more improved top hatch assemblies that improve the material loading process.

SUMMARY

Various embodiments of the present disclosure provide an improved top hatch cover assembly for a hopper railroad car. Various embodiments of the present disclosure provide a hopper railroad car having an improved top hatch cover assembly. In various example embodiments of the present disclosure, the top hatch cover assembly generally includes a hatch cover and a hatch cover securer configured to co-act with and to secure the hatch cover in a closed position.

In various example embodiments of the present disclosure, the hatch cover includes a partially flexible elongated hatch, a plurality of spaced apart central hinges connected to the hatch, a first end hinge connected to a first end of the hatch, a second end hinge connected to an opposite second end of the hatch, a first actuator connected to the first end hinge, and a second actuator connected to the second end hinge. The elongated flexible hatch includes an elongated flexible panel. The elongated movable flexible panel is larger than an upwardly extending coaming of the roof of the hopper railroad car, and larger than an opening in the roof of the hopper railroad car partially defined by the coaming. The flexible hatch includes a coaming sealer configured to engage and create a seal with the coaming when the elongated movable hatch of the hatch cover is in the closed position engaging the coaming.

In various example embodiments, the hatch cover securer includes a hatch cover engager pivotally or rotatably movable from: (a) a hatch cover engagement position in which the hatch cover engager secures the hatch of the hatch cover in the closed position engaging the coaming to (b) a hatch cover non-engagement position in which the hatch cover engager allows the hatch of the hatch cover to move to a fully open position.

In various example embodiments, the hatch cover securer includes a hatch cover engager linearly movable from: (a) a hatch cover engagement position in which the hatch cover engager secures the hatch of the hatch cover in the closed position engaging the coaming to (b) a hatch cover non-engagement position in which the hatch cover engager allows the hatch of the hatch cover to move to a fully open position.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
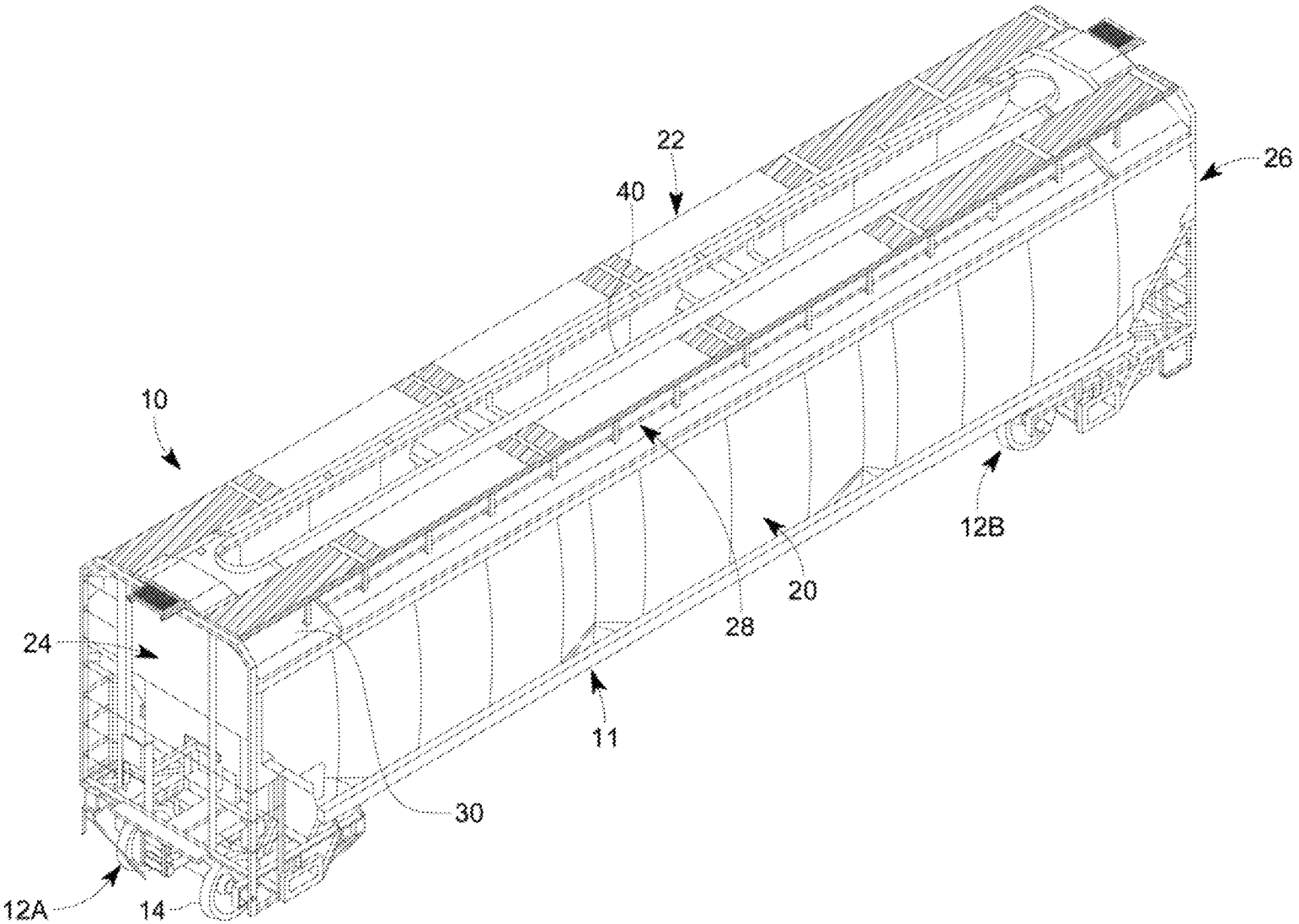
FIG. 1 is a top perspective view of a hopper railroad car of the present disclosure that is configured to transport a variety of bulk materials, shown without the top hatch cover assembly of the present disclosure and shown with running boards connected to the roof.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Various embodiments of the present disclosure provide a top hatch cover assembly for a railroad hopper railroad car that is partially flexible and that automatically opens and closes. The top hatch cover assembly facilitates automatic opening and closing without requiring additional or external specialized machinery or equipment. The top hatch cover assembly of the present disclosure also eliminates the need for a person to be physically present on roof of the hopper railroad car to open and close the top hatch cover assembly for the loading materials into the hopper railroad car.

Referring now to the drawings, FIG. 1 partially illustrates an example hopper railroad car 10 having a roof 28 to which the top hatch cover assembly of the present disclosure can be connected. The illustrated example hopper railroad car 10 generally includes: (1) a frame 11; (2) spaced apart trucks 12A and 12B configured to support the frame 11; (3) a plurality of wheels (such as wheel 14) that support the trucks 12A and 12B; (4) a first side wall 20 connected to and supported by the frame 11; (5) a second side wall 22 connected to and supported by the frame 11; (6) a first end wall 24 connected to and supported by the frame 11; (7) a second end wall 26 connected to and supported by the frame 11; and (8) a roof 28 connected to and supported by the side walls 20 and 22, the end walls 24 and 26, and the frame 11. The first and second side walls 20 and 22 are spaced apart. The first and second end walls 24 and 26 are also spaced apart. The hopper railroad car 10 generally includes a first end and a second end. The frame 11, the side walls 20 and 22, the end walls 24 and 26, and the roof 28 define one or more interior compartments (not shown). It should be appreciated that the configuration and size of the hopper railroad car may vary in accordance with the present disclosure. The configuration of the roof 28 of the hopper railroad car can vary, for instance, in the degree of curvature. For example, FIGS. 1 to 15 show one example curved roof. FIG. 1 additionally shows running boards positioned above the curved roof. It should be appreciated that the top hatch cover assembly of the present disclosure can be employed with different hopper railroad cars having differently configured roofs. For brevity, the present disclosure employs only one set of numerals (e.g., 28, 30, 40, and 50) referencing various parts of the example hopper railroad cars shown herein for the different example embodiments of the present disclosure described herein.

As seen in FIGS. 1 to 15, in this illustrated example embodiment, the roof 28 generally includes: (1) a curved panel 30; and (2) a coaming 40 integrally connected to, supported by and upwardly extending from the curved panel 30.

The curved panel 30 is elevated in the middle (from side to side), such that the panel 30 is higher in the middle and is lower at the respective connection points or edges at the respective side walls. This enables the curved panel 30 to deflect rain, snow, and other objects off the roof 28 of the hopper railroad car 10. The curved panel 30 may be made from steel, or any other suitable material. The curved panel 30 is illustrated as having a symmetrical curvature. However, it should be appreciated that the curvature may be asymmetrical in accordance with the present disclosure. It should also be appreciated that the roof 28 may alternatively include a flat (i.e., not curved) panel, a panel including one or more sharp bends rather than a gradual curve, or a panel having a curvature different from that shown in the Figures in accordance with the present disclosure. In addition, the roof 28 may include a single panel or multiple panels connected together in accordance with the present disclosure.

The coaming 40 generally includes an oval upright portion (not labeled) having a top surface (not labeled), an inner surface (not labeled), and an outer surface (not labeled). The coaming 40 extends along a substantial length of the roof 28 and defines an oval or obround opening 50 through which materials can be loaded into the hopper railroad car. In other words, the coaming 40 extends around the opening 50, defining an outer perimeter of the opening 50. The coaming 40 extends above the curved panel 30, and in particular extends from and above the upper surface of the curved panel 30. In the illustrated example, the upright portion of the coaming 40 includes two semicircular end walls (not separately labeled) connected by two parallel spaced apart side walls (not separately labeled). The inner surface of the coaming 40 is adjacent to the opening 50, thereby forming an oblong ring around the opening 50. The outer surface of the coaming 40 is opposite the inner surface of the coaming 40. The top surface of the coaming 40 is opposite the top surface of the curved panel 30 and extends from the inner surface to the outer surface. The top surface is curved from the inner surface to the outer surface. In other embodiments, the coaming includes an upper curved flange that defines the top surface of the coaming. It should be appreciated that the present disclosure may be employed with other suitably shaped coamings, or with other alternative roof structures.

First Example Embodiment

Referring now more specifically to FIGS. 2 to 19, one example top hatch cover assembly 100 of the present disclosure is generally shown. This example illustrated top hatch cover assembly 100 generally includes: (1) a hatch cover 150 suitably connected on one side of the coaming 40 to the cover panel 30 of the roof 28 and including an elongated movable hatch 200 pivotally movable from a closed position engaging the coaming 40 to a fully open position away from the coaming 40; and (2) a hatch cover securer 1000 suitably connected on the other side of the coaming 40 to the cover panel 30 of the roof 28 and including a hatch cover engager 1400 pivotally or rotatably movable from a hatch cover engagement position in which the hatch cover engager 1400 secures the hatch cover 150 in the closed position engaging the coaming 40 to a hatch cover non-engagement position in which the hatch cover engager 1400 allows the hatch 200 of the hatch cover 150 to move to the fully open position, as further explained herein.

More specifically, the hatch cover 150 includes: (1) a flexible elongated movable hatch 200; (2) a plurality of spaced apart central hinges 300*a*, 300*b*, 300*c*, 300*d*, 300*e*, and 300*f* suitably connected to the hatch 200 and the curved panel 30 of the roof 28; (3) a first end hinge 400 suitably connected to a first end 202 of the hatch 200 and the curved panel 30 of the roof 28; (4) a second end hinge 500 suitably connected to an opposite second end 252 of the hatch 200 and the curved panel 30 of the roof 28; (5) a first actuator 600 suitably connected to the first end hinge 400 and the curved panel 30 of the roof 28; and (6) a second actuator 700 suitably connected to the second end hinge 500 and the curved panel 30 of the roof 28.

The hatch cover 150 is suitably connected to the roof 28, and more particularly to the curved panel 30 by the hinges 300*a*, 300*b*, 300*c*, 300*d*, 300*e*, 300*f*, 400, and 500. The hatch 200 of the hatch cover 150 is configured to securely engage and provide a seal with the coaming 40 when in a closed position (such as shown in FIGS. 2, 3, 6, 9, 10, 11, and 12). The hatch 200 of the hatch cover 150 is configured to disengage from the coaming 40 and move to various open positions (such as shown in FIGS. 4, 5, 7, 8, 13, 14, and 15). The hatch 200 of the hatch cover 150 is configured to move and particularly rotate between the fully open position (shown in FIGS. 4, 5, 7, 8, and 15) and the closed position. Thus, the hatch 200 of the hatch cover 150 is configured to unseal and seal the hopper railroad car 10 by moving from the fully open position to the closed position, and vice versa. The hatch 200 and certain other parts of the hatch cover 150 are configured to be secured in the fully closed position by the hatch cover securer 1000, as further described herein.

The elongated movable hatch 200 of the hatch cover 150 generally includes a first end 202 and an opposite second end 252. The elongated movable hatch 200 includes: (1) a flexible elongated panel 210; and (2) an elongated oblong coaming sealer 250 suitably connected to the bottom of the flexible elongated panel 210.

The flexible elongated panel 210 is generally rectangular, is larger than the coaming 40, and is larger than the opening 50. The panel 210 has a top surface (not labeled), a bottom surface (not labeled), a first side edge (not labeled), a second side edge (not labeled), a first end edge (not labeled), and a second end edge (not labeled). It should also be appreciated that the panel 210 is large enough relative to the coaming 40 such that when the elongated movable hatch 200 of the hatch cover 150 is in the closed position engaging the coaming 40, that the first side edge, the second side edge, the first end edge, and the second end edge each extend outwardly of the coaming 40. The panel 210 is made from a relatively light weight flexible material that is also semi-rigid in certain embodiments. In this example, the material of the panel 210 is made from a conveyor belt type material such as reinforced tarpaulin, reinforced plastic, reinforced rubber, or a suitable lamination using one or more of such materials and/or other suitable materials. However, it should be appreciated that the material can be any other suitable material in accordance with the present disclosure. It should also be appreciated that the elongated panel can include one or more internal and/or external supporting members that provide a desired amount of support and rigidity to the material of the elongated panel in accordance with the present disclosure. It should also be appreciated that while this example panel 210 is made from one continuous section of material, the present disclosure contemplates that the panel 210 can be made from two or more sections that are suitably connected, and in certain such embodiments overlapping. It should also be appreciated that while this example panel 210 is made from one continuous layer of material, the present disclosure contemplates that the panel 210 can be made from two or more layers of material. It should also be appreciated that while this example panel 210 is rectangular, the present disclosure contemplates that the panel 210 can be made in other suitable shapes and sizes. It should be appreciated that the structure of the panel 210 is such that the panel 210 can be lifted from either end and that the flexible material will enable part of the elongated panel to be lifted without lifting the entire panel 210, and such that adjacent sections of the panel 210 can be sequentially lifted as further described below.

The elongated coaming sealer 250 that functions in part as a gasket includes a generally oval ring that is slightly wider than the top surface of the coaming 40, and is larger than the opening 50. The coaming sealer 250 has a top surface (not labeled), a bottom surface (not labeled), an outer surface (not labeled), and an inner surface (not labeled). The coaming sealer 250 is suitably connected to the bottom of the elongated panel 210. In this example embodiment, the top surface of the sealer 250 is suitably connected to the bottom surface of the panel 210 (such as by using a suitable adhesive). The coaming sealer 250 includes two spaced apart-straight sections, and two spaced apart curved sections that respectively correspond to the two straight sections and two curved walls of the coaming 40. It should also be appreciated that the coaming sealer 250 is large enough relative to the coaming 40 such that when the elongated movable hatch 200 of the hatch cover 150 is in the closed position engaging the coaming 40, the bottom surface of the elongated coaming sealer 250 engages and seals the entire top surface of the coaming 40. The coaming sealer 250 is made from a relatively light weight flexible rubber material; however, it should be appreciated that the material of the coaming sealer 250 can be any other suitable material in accordance with the present disclosure. It should also be appreciated that while this example coaming sealer 250 is made from one continuous section of material, the present disclosure contemplates that the coaming sealer 250 can be made from two or more sections that are suitably connected, and in certain such embodiments overlapping. It should also be appreciated that while this example coaming sealer 250 is made from one continuous layer of material, the present disclosure contemplates that the coaming sealer can be made from two or more layers of material. It should be appreciated that the coaming sealer 250 is compressible such that when it engages the top surface 44 of the coaming 40, it compresses to form a seal with the coaming 40. It should also be appreciated that while this example sealer 250 is oval (to align with, correspond to, and seal the oval coaming), the present disclosure contemplates that the sealer 250 can be made in other suitable shapes and sizes. It should be appreciated that the structure of the sealer 250 is such that the coaming sealer 250 can be lifted with the lifting of the panel 210 from either end and that the sealer 250 will enable part of the panel 210 to be lifted without lifting the entire panel 210 and such that adjacent sections of the panel 210 can be sequentially lifted. It should also be appreciated that the sealer 250 could alternatively or additionally include one or more sections that are configured to engage: (a) the inner and/or outer surfaces of the coaming 40, or (b) only the inner and/or outer surfaces of the coaming 40, in accordance with the present disclosure. In other words, the sealer 250 can be suitably configured to create a seal on one or more selected surfaces of the coaming. Additionally, it should be appreciated as further explained herein that the hatch cover 150 and the hatch cover securer 1000 are configured to co-act to create an even or substantially even seal along the entire lengths and along the curvatures of the seal 250, and are further configured to provide more than 5 pounds of pressure along every three inches of the sealer 250.

As mentioned above, the hatch cover 150 includes spaced apart central hinges 300*a*, 300*b*, 300*c*, 300*d*, 300*e*, and 300*f* suitably connected to the hatch 200. More specially, each of these central hinges 300*a*, 300*b*, 300*c*, 300*d*, 300*e*, and 300*f* is suitably connected to the elongated panel 210 by a plurality of fasteners (not shown or labeled). It should also be appreciated that the elongated panel 210 may otherwise suitably attached to the central hinges such as using an adhesive or other suitable attachment mechanism. In this illustrated example embodiment, each of the central hinges 300*a*, 300*b*, 300*c*, 300*d*, 300*e*, and 300*f* is identical, and thus only central hinge 300*b* (best shown in FIGS. 16, 17, 18, and 19) is discussed in detail for brevity. It should be appreciated that the central hinges 300*a*, 300*b*, 300*c*, 300*d*, 300*e*, and 300*f* do not need be identical in accordance with the present disclosure. It should also be appreciated that the quantity and spacing of the central hinges may vary in accordance with the present disclosure.

More specifically, as shown in FIGS. 7, 16, 17, 18, and 19, the central hinge 300*b* generally includes: (1) a mounting bracket 310*b* suitably connected to the curved panel 30 of the roof 28; (2) a pivot pin bracket 320*b* suitably connected to the mounting bracket 310*b*; (3) a pivot pin assembly 330*b* suitably connected to the pivot pin bracket 320*b*; and (4) a pivot arm 340*b* suitably pivotally connected to the pivot pin bracket 320*b* by the pivot pin assembly 330*b* and suitably connected to the elongated panel 210.

Figure 16:
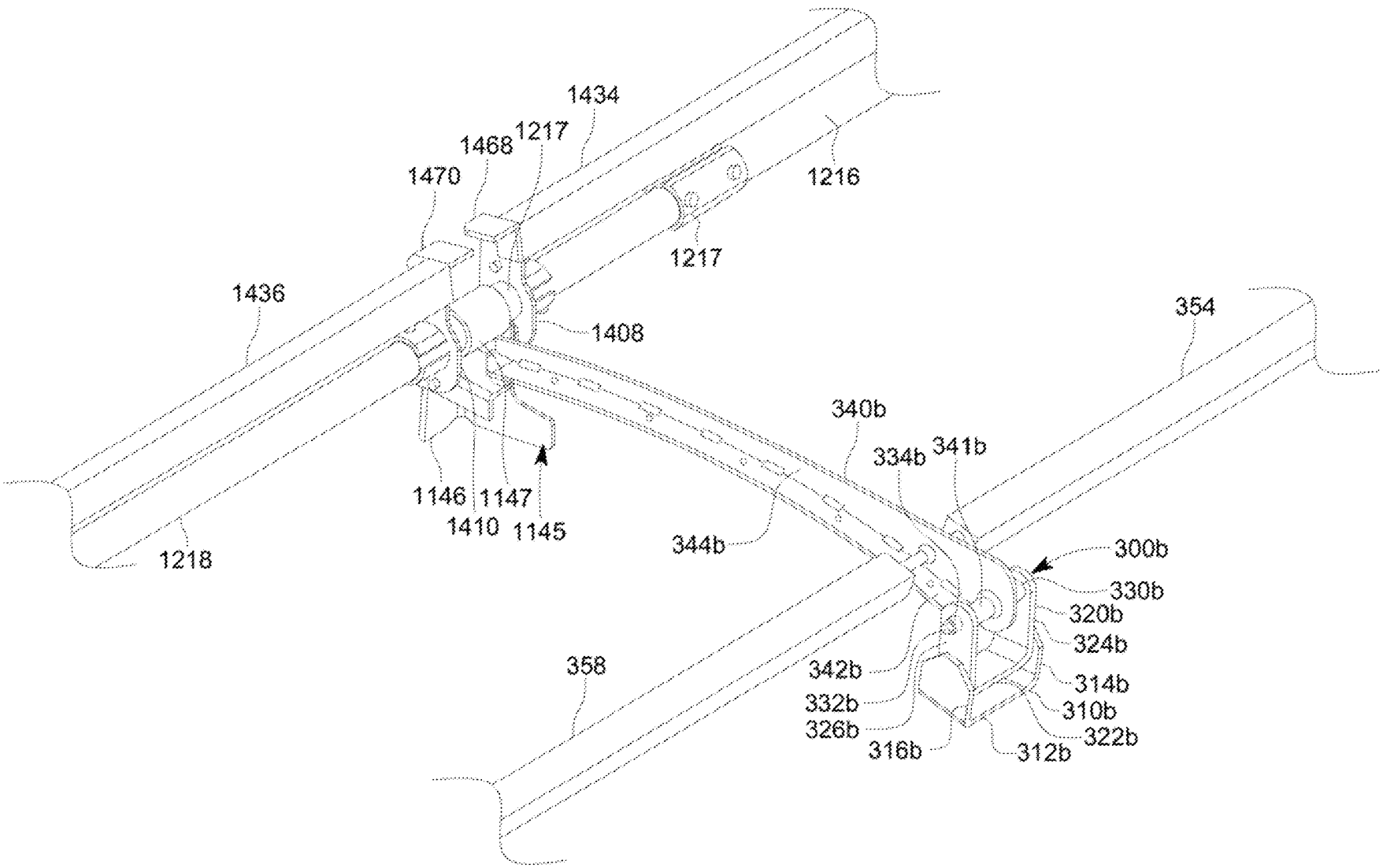
FIG. 16 is an enlarged fragmentary top perspective view of certain parts (including one of the central hinges) of the hatch cover and of certain parts (including one of the hatch cover engagers) of the hatch cover securer of the hatch cover assembly of FIG. 2.
Figure 17:
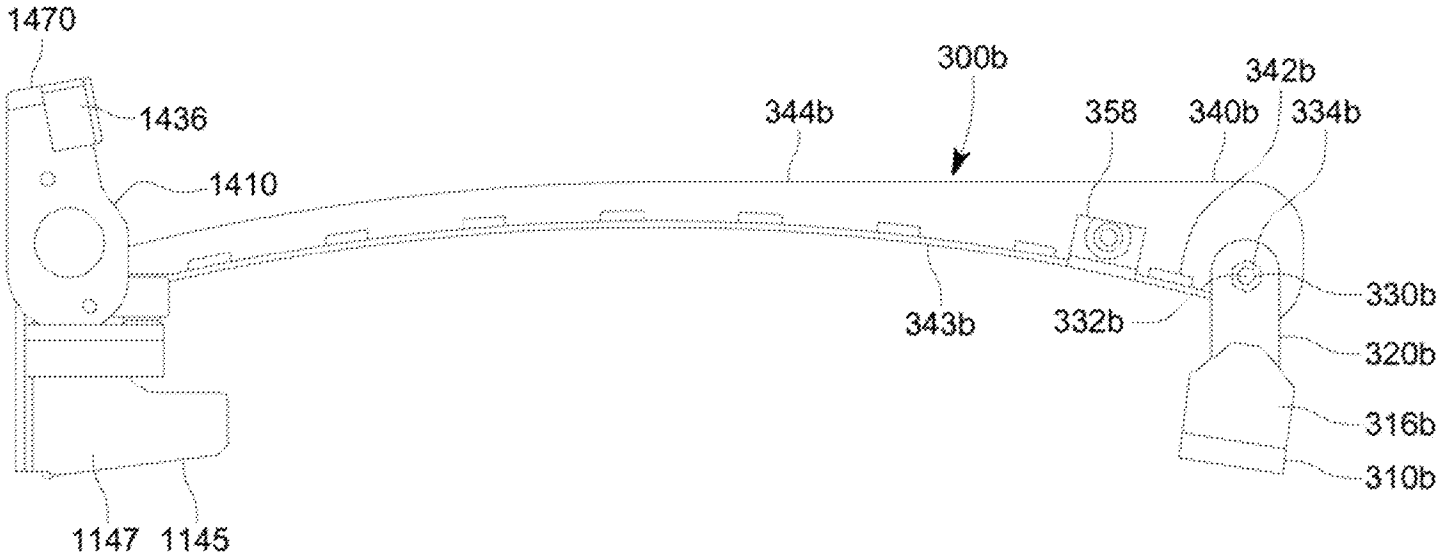
FIG. 17 is an enlarged end view of certain parts (including one of the central hinges) of the hatch cover and of certain parts (including one of the hatch cover engagers) of the hatch cover securer of the hatch cover assembly of FIG. 2.

The mounting bracket 310*b* includes: (1) a mounting base 312*b*; (2) a first mounting leg 314*b* integrally connected to and extending upwardly from the mounting base 312*b*; and (3) a second mounting leg 316*b* integrally connected to and extending upwardly from the mounting base 312*b*. The second mounting leg 316*b* is aligned with and spaced apart from the first mounting leg 314*b*. The mounting base 312*b* is suitably connected to the roof 28 and specifically to curved panel 30 of the roof 28 adjacent to the coaming 40, as best shown in FIG. 16. The mounting bracket 310*b* is made of steel in this example embodiment. It should be appreciated that the mounting bracket 310*b* may be alternatively sized, configured, and made of different materials in accordance with the present disclosure.

The pivot pin bracket 320*b* includes: (1) a base 322*b*; (2) a first mounting arm 324*b* integrally connected to and extending upwardly from the base 322*b*; and (3) a second mounting arm 326*b* integrally connected to and extending upwardly from the base 322*b*. The second mounting arm 326*b* is aligned with and spaced apart from the first mounting arm 324*b*. The first mounting arm 324*b* is integrally connected to the first mounting arm 314*b* of the mounting bracket 310*b*. The second mounting arm 326*b* is integrally connected to the second mounting arm 316*b* of the mounting bracket 310*b*. The first mounting arm 324*b* defines an opening (not shown or labeled) for receiving part of the pivot pin assembly 330*b*. The second mounting arm 324*b* also defines an opening (not shown or labeled) for receiving part of the pivot pin assembly 330*b*. The openings of the first mounting arm 324*b* and the second mounting arm 324*b* are aligned. The pivot pin bracket 320*b* is mounted relative to the mounting bracket 310*b* to facilitate a suitable amount of clearance for pivoting and rotation of the pivot arm 340*b* relative to the roof 28 and specifically to the curved panel 30 of the roof 28 as well as the coaming 40 of the roof 28. The pivot pin bracket 320*b* is made of steel in this example embodiment. It should be appreciated that the pivot pin bracket 320*b* may be alternatively sized, configured, and made of different materials in accordance with the present disclosure.

The pivot pin assembly 330*b* includes: (1) a bolt 332*b* that extends through the openings in first mounting arm 324*b* and the second mounting arm 326*b*; (2) a nut 334*b* suitably connected to the bolt 332*b*; and (3) a collar 341*b* freely rotatably journaled about the bolt 332*b* between the first mounting arm 324*b* and the second mounting arm 326*b*. Although not shown, the pivot pin assembly 330*b* may include one or more suitable washers. The pivot pin assembly 330*b* is made of steel in this example embodiment. It should be appreciated that the pivot pin assembly 330*b* may be alternatively sized, configured, and made of different materials in accordance with the present disclosure.

The pivot arm 340*b* includes: (1) an elongated hatch connector base 342*b*; and (2) an elongated support wall 344*b* integrally centrally connected to and upwardly extending from the elongated hatch connector base 342*b*. The hatch connector base 342*b* includes a bottom surface 343*b* that is positioned on the top surface of the elongated panel 210 of the hatch 200. The hatch connector base 342*b* includes a plurality of openings (not labeled) for suitable fasteners (not labeled) that connect the hatch connector base 342*b* (and thus the pivot arm 340*b*) to the panel 210. The support wall 344*b* adds structural support to the hatch connector base 342*b* and facilitates the rotation of the hatch 200. The elongated support wall 344*b* is integrally connected to the collar 341*b* of the pivot pin assembly 330*b*. This configuration enables the pivot arm 340*b* and the section of the panel 210 of the hatch 200 to pivot about the pivot pin assembly 330*b* and relative to the pivot pin bracket 320*b*, the coaming 40, and the roof 28. The pivot arm 340*b* is made of steel in this example embodiment. It should be appreciated that the pivot arm 340*b* may be alternatively sized, configured, and made of different materials in accordance with the present disclosure.

In this illustrated example embodiment, the hatch cover 150 additionally includes a plurality of additional hatch engagement members 350, 354, 358, 362, 366, 370, and 374 extending between and suitably rotatably and pivotally connected to and between pairs of respective pivot arms of the hinges including spaced apart hinges 400, 300*a*, 300*b*, 300*c*, 300*d*, 300*e*, 300*f*, and 500. It should be appreciated that for the pivot arms to lift sequentially, the connections between the engagement members and the pivot arms allow for more motion than just rotation. The engagement member must is free to pivot vertically relative to each respective pivot arm, such that one end of the engagement member can be lifted before the other. More specifically, (1) additional hatch engagement member 350 extends between and is suitably connected to and between the pivot arm 460 (described below) of hinge 400 and the pivot arm of 300*a* by respective bosses (not labeled) that are each rotatably and pivotally connected to the respective pivot arms; (2) additional hatch engagement member 354 extends between and is suitably connected to and between the pivot arm of hinge 300*a* and the pivot arm of 300*b* by respective bosses (not labeled) that are each rotatably and pivotally connected to the respective pivot arms; (3) additional hatch engagement member 358 extends between and is suitably connected to and between the pivot arm of hinge 300*b* and the pivot arm of 300*c* by respective bosses (not labeled) that are each rotatably and pivotally connected to the respective pivot arms; (4) additional hatch engagement member 362 extends between and is suitably connected to and between the pivot arm of hinge 300*c* and the pivot arm of 300*d* by respective bosses (not labeled) that are each rotatably and pivotally connected to the respective pivot arms; (5) additional hatch engagement member 366 extends between and is suitably connected to and between the pivot arm of hinge 300*d* and the pivot arm of 300*e* by respective bosses (not labeled) that are each rotatably and pivotally connected to the respective pivot arms; (6) additional hatch engagement member 370 extends between and is suitably connected to and between the pivot arm of hinge 300*e* and the pivot arm of 300*f* by respective bosses (not labeled) that are each rotatably and pivotally connected to the respective pivot arms; and (7) additional hatch engagement member 374 extends between and is suitably connected to and between the pivot arm of hinge 300*f* and the pivot arm (not labeled) of hinge 500 by respective bosses (not labeled) that are each rotatably and pivotally connected to the respective pivot arms. Each of the additional hatch engagement members 350, 354, 358, 362, 366, 370, and 374 has a square cross-section and four flat surfaces. Each of the additional hatch engagement members 350, 354, 358, 362, 366, 370, and 374 is configured to freely rotate and pivot relative to the spaced apart pivot arms to which it is attached. This free rotation and pivotal movement enables the opening of the hatch cover 150 and particularly the hatch 200 from either or both ends. For instance, as the hatch 200 is opened from the first end 202, the first additional hatch engagement member 350 can rotate and pivot as the flexible hatch 200 moves upwardly. This allowed rotation and pivotal movement prevents the bending of the additional hatch engagement member 350. This free rotation also enables the closing of the hatch cover 150 and particularly the hatch 200 from either or both ends in the same manner. It should also be appreciated that these rotational and pivotal connections enable each pivot arm to move independently and each section of the panel 210 to be lifted (or lowered) sequentially. Each additional hatch engagement member is configured to engage a portion of the top surface of the hatch 200 over a section of the hatch 200 that includes the seal 250 to thus apply an even amount of pressure to that portion of the hatch 200 and that portion of the seal 250. Each additional hatch engagement member is made of steel in this example embodiment. It should be appreciated that the additional hatch engagement members may be alternatively sized, configured, and made of different materials in accordance with the present disclosure.

As mentioned above, the hatch cover 150 includes the first end hinge 400 suitably connected to a first end 202 of the hatch 200 and the second end hinge 500 suitably connected to a second end 252 of the hatch 200. More specially, each of these hinges 400 and 500 is suitably connected to opposite ends of the elongated panel 210. In this illustrated example embodiment, each of the hinges 400 and 500 are mirror images of each other, and thus end hinge 400 is primarily discussed in detail for brevity. It should be appreciated that the first and second end hinges 400 and 500 do not need be exact mirror images in accordance with the present disclosure.

Figure 8:
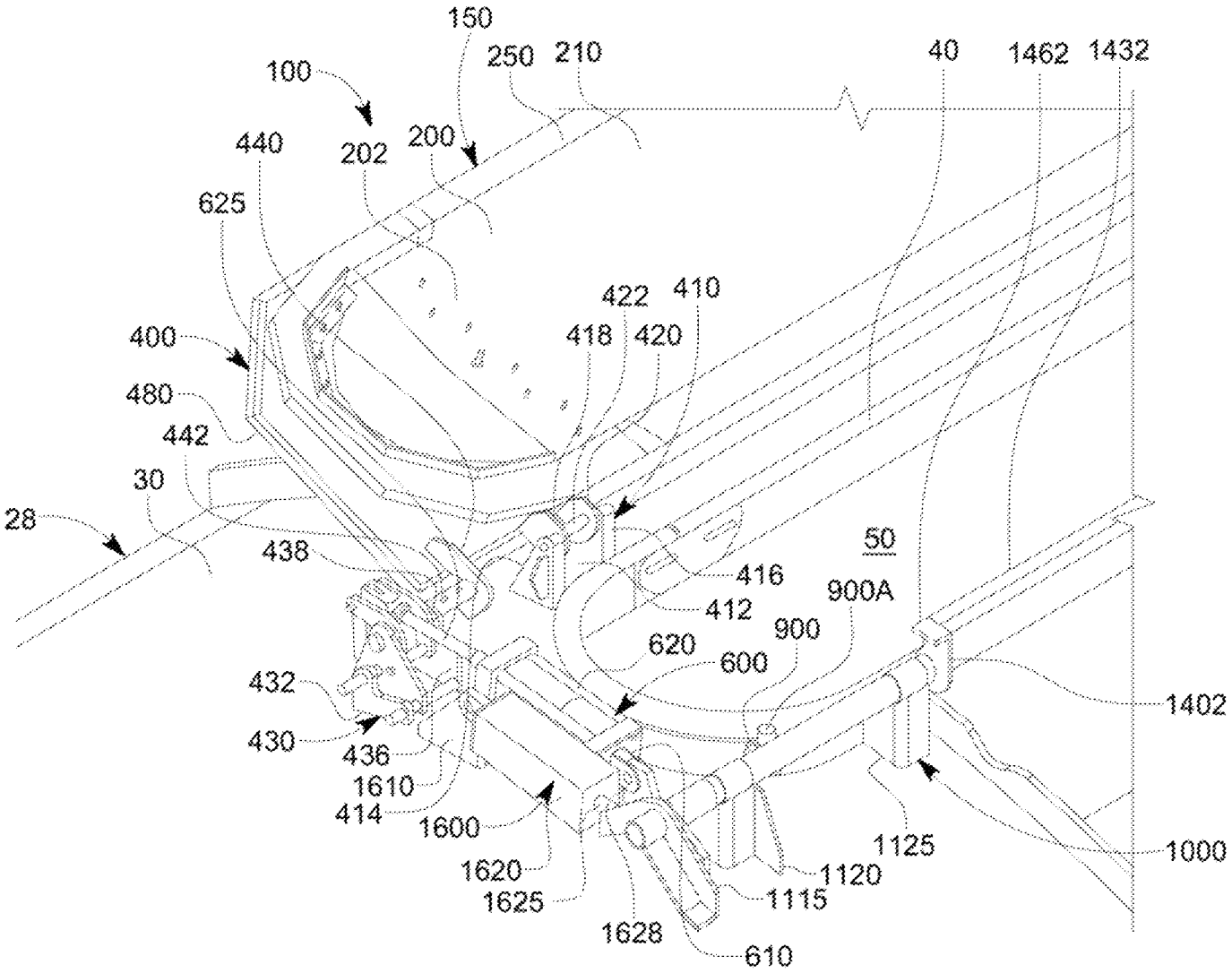
FIG. 8 is an even further enlarged fragmentary top perspective view of the first end of the roof of the example hopper railroad car of FIG. 1, and the first end of the top hatch cover assembly of FIG. 2 shown connected to the first end of the roof of the hopper railroad car of FIG. 1 and shown in the fully open position.
Figure 9:
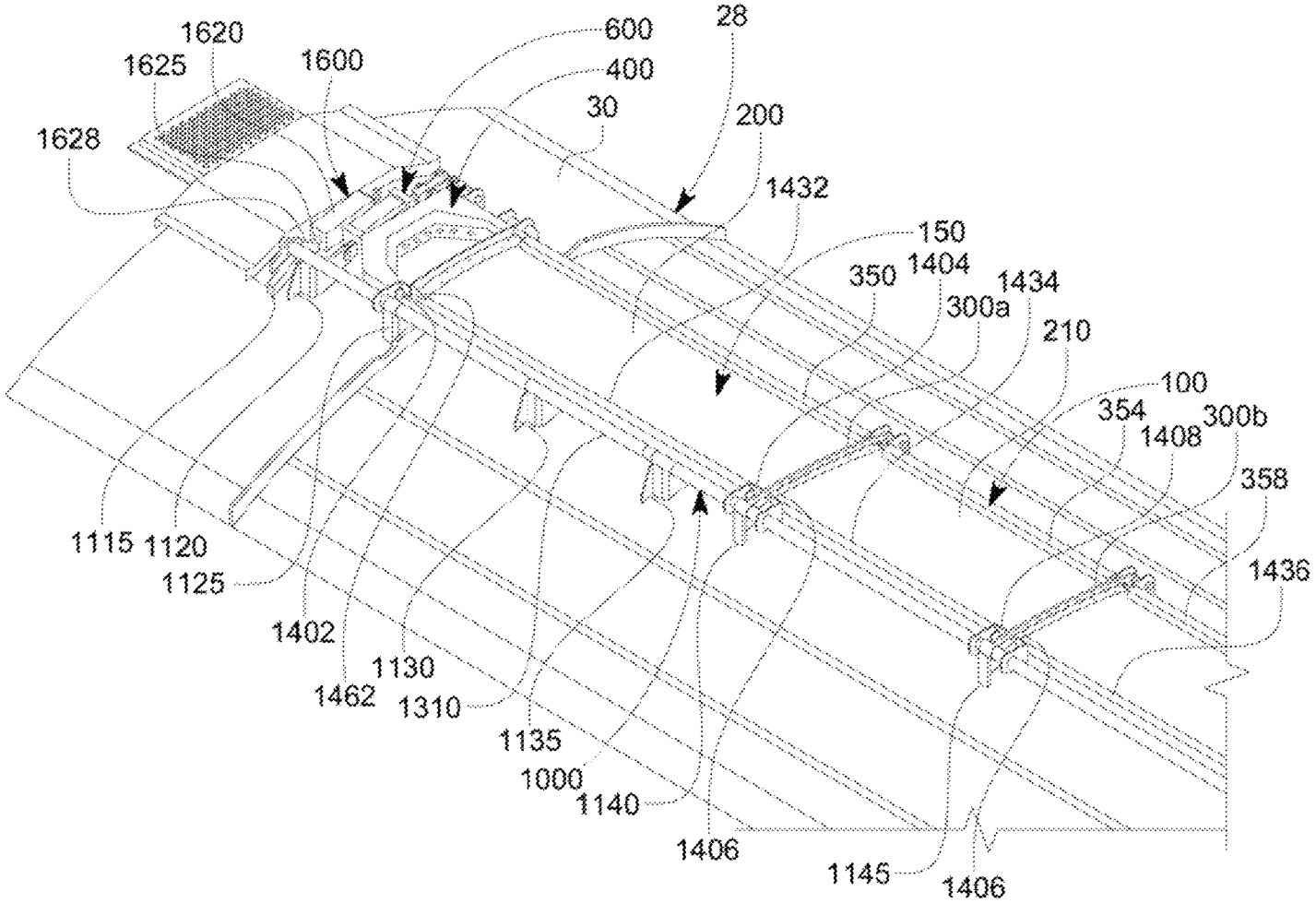
FIG. 9 is a further enlarged fragmentary top perspective view of the first end of the roof of the example hopper railroad car of FIG. 1, and the first end of the top hatch cover assembly of FIG. 2 shown connected to the first end of the roof of the hopper railroad car of FIG. 1 and shown in the closed position.
Figure 10:
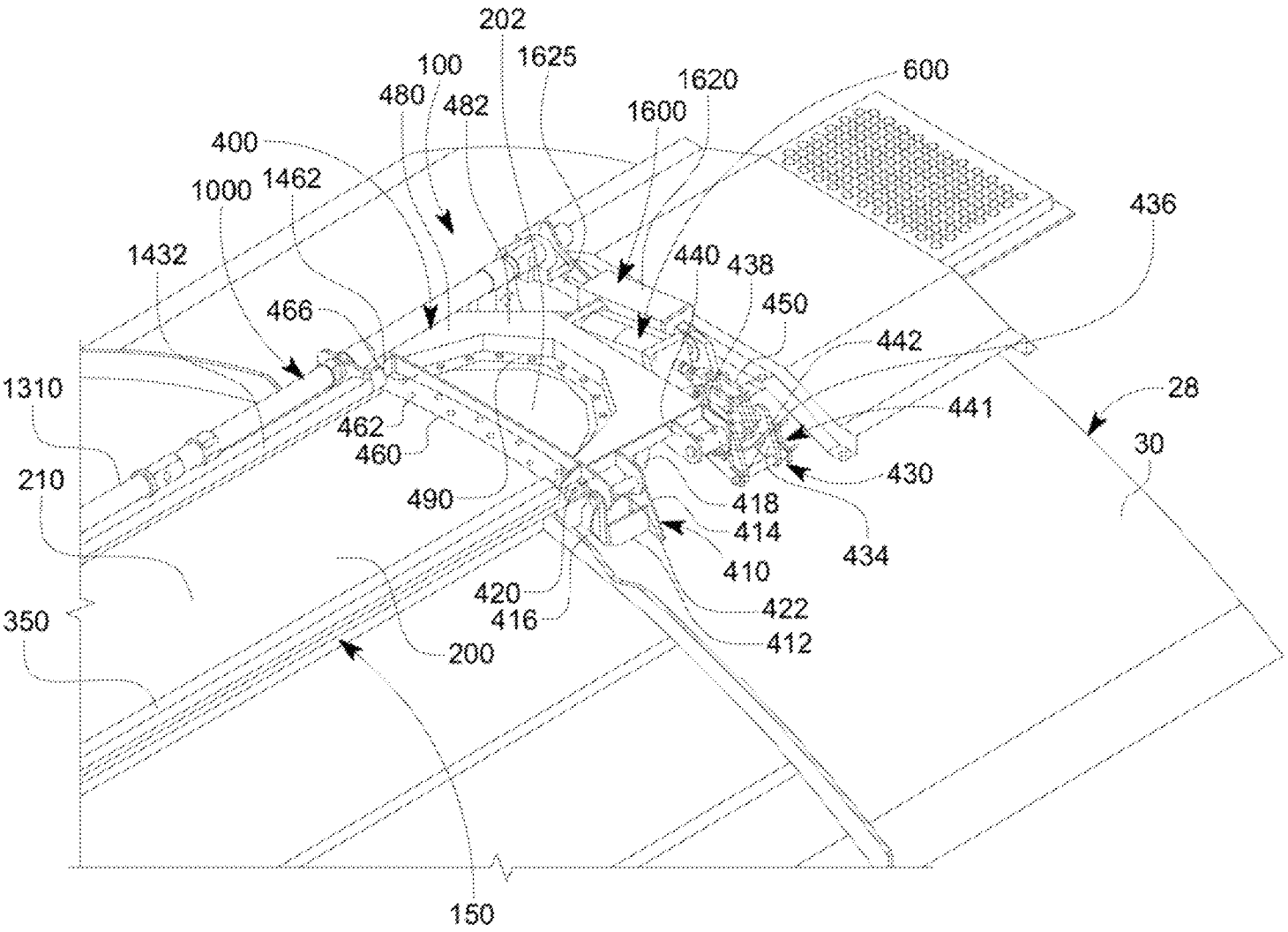
FIG. 10 is a further enlarged fragmentary top perspective view of the first end of the roof of the example hopper railroad car of FIG. 1, and the first end of the top hatch cover assembly of FIG. 2 shown connected to the first end of the roof of the hopper railroad car of FIG. 1 and shown in the closed position.
Figure 11:
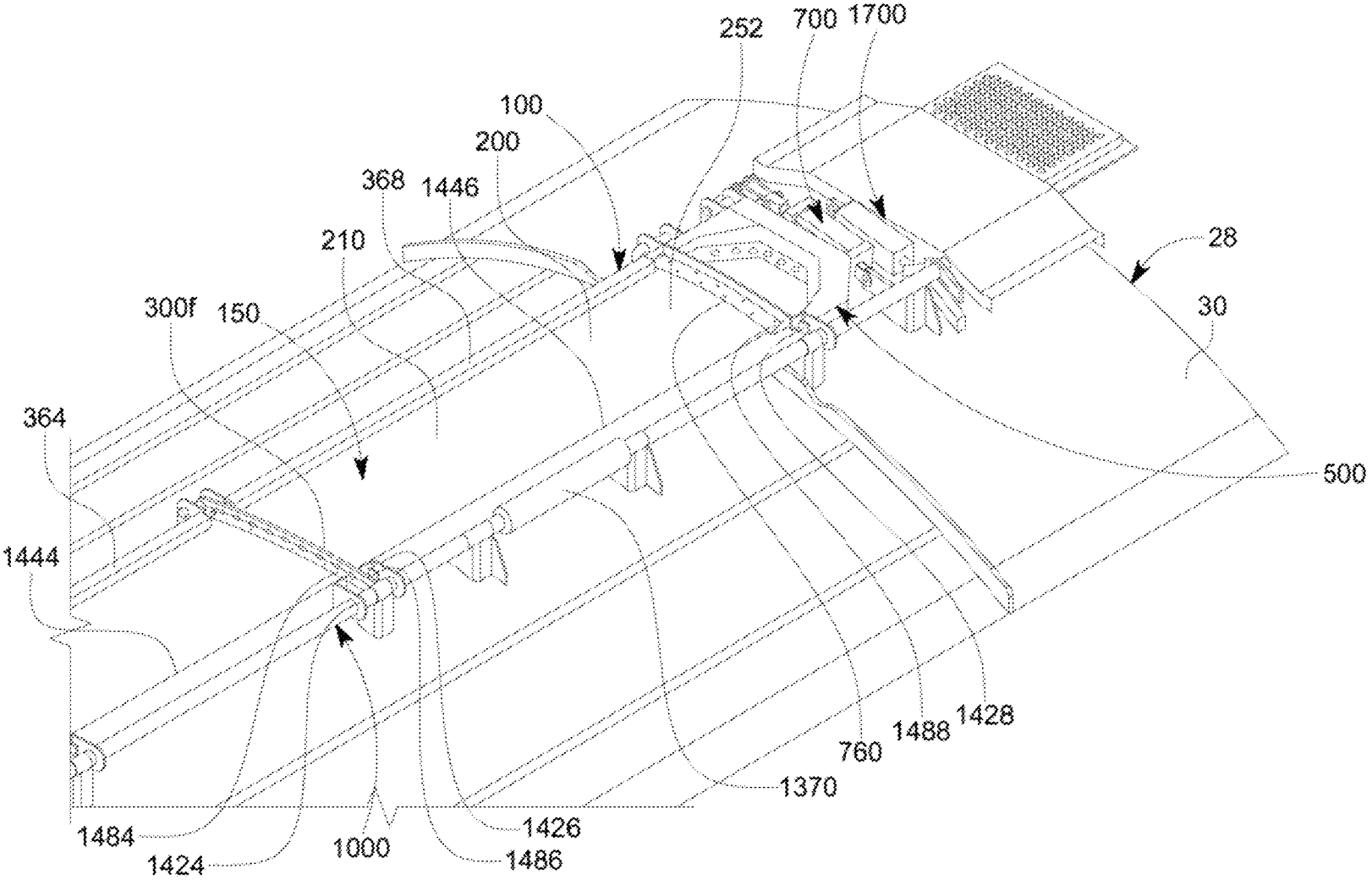
FIG. 11 is a further enlarged fragmentary top perspective view of the second end of the roof of the example hopper railroad car of FIG. 1, and the second end of the top hatch cover assembly of FIG. 2 shown connected to the second end of the roof of the hopper railroad car of FIG. 1 and shown in the closed position.
Figure 12:
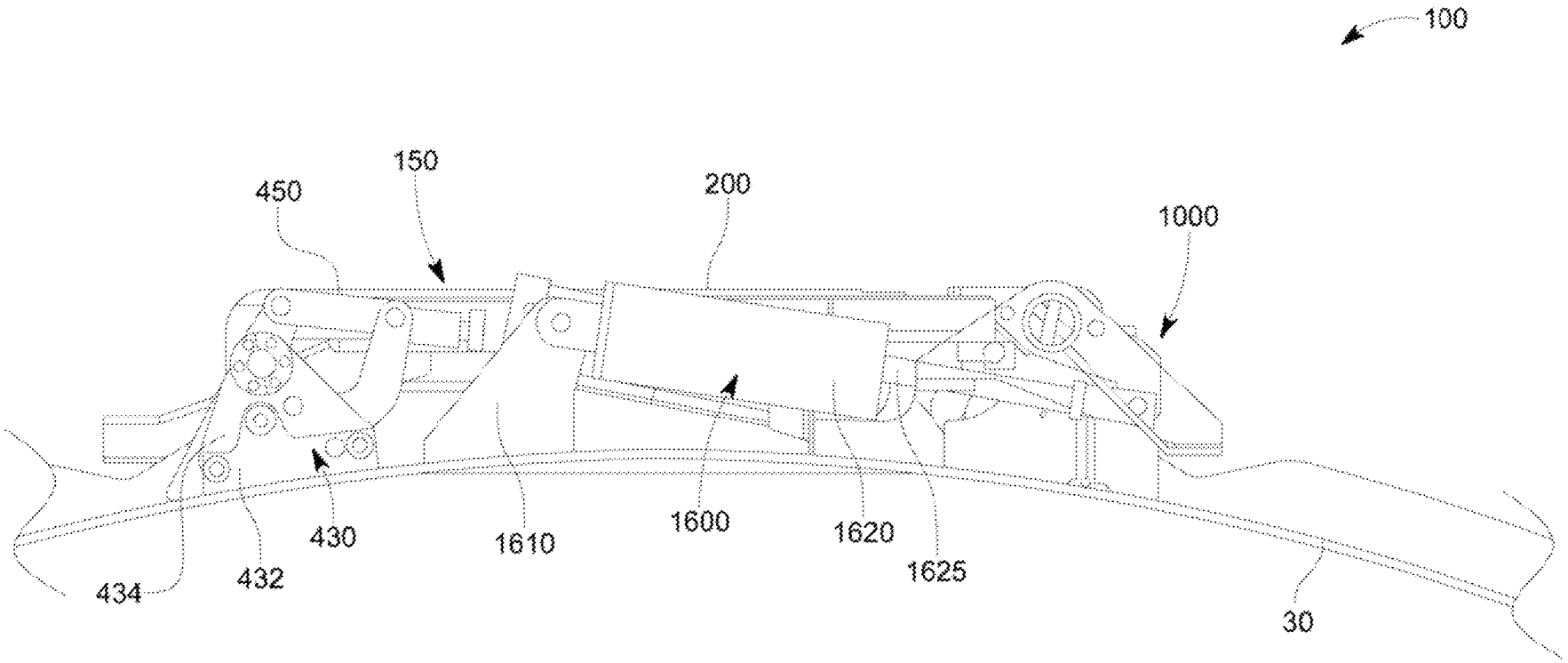
FIG. 12 is an enlarged fragmentary end view of the first end of the roof of the example hopper railroad car of FIG. 1, and the first end of the top hatch cover assembly of FIG. 2 shown connected to the first end of the roof of the hopper railroad car of FIG. 1 and shown in the closed position.

As best shown in FIGS. 8, 10, and 12, the hinge 400 generally includes: (1) a first mounting bracket assembly 410; (2) a second mounting bracket assembly 430; (3) an actuator linkage assembly 450 suitably connected to the pivot pin assembly 440; (4) a pivot arm 460 suitably pivotally connected to the first mounting bracket assembly 410; and (5) a hinge plate 480 suitably pivotally connected to the first and second mounting bracket assemblies 410 and 430.

More specifically, the first mounting bracket assembly 410 includes: (1) a mounting base 412; (2) a first mounting leg 414 integrally connected to the mounting base 412; and (3) a second mounting leg 416 integrally connected to the mounting base 412. The second mounting leg 416 is aligned with and spaced apart from the first mounting leg 414. The mounting base 412, the first mounting leg 414, and the second mounting leg 416 are suitably connected to the roof 28 and specifically to the curved panel 30 of the roof 28 adjacent to the coaming 40 as best shown in FIGS. 8 and 10. The first mounting bracket assembly 410 further includes: (4) a first mounting arm 418 integrally connected to and extending from the hinge plate 480; and (5) a second mounting arm 420 integrally connected to and extending from the hinge plate 480. The second mounting arm 420 is aligned with and spaced apart from the first mounting arm 418. The first mounting arm 418 defines an opening (not shown or labeled) for receiving part of a pivot pin assembly 422. The second mounting arm 420 also defines an opening (not shown or labeled) for receiving part of the pivot pin assembly 422. The openings of the first mounting arm 418 and the second mounting arm 420 are aligned. The first mounting arm 418 and the second mounting arm 420 are pivotally mounted to the first mounting leg 414 and the second mounting leg 416 by the pivot pin assembly to facilitate a suitable amount of clearance for pivoting and rotation of the first mounting arm 418 and the second mounting arm 420 relative to the roof 28 and specifically the curved panel 30 of the roof 28 and the coaming 40 of the roof 28. The pivot pin assembly 422 includes: (1) a bolt (not labeled) that extends through the openings in first mounting arm 418 and the second mounting arm 420; (2) a nut (not labeled) connected to the bolt; and (3) a collar (not labeled) freely rotatably journaled about the bolt between the first mounting arm 418 and the second mounting arm 420. Although not shown, the pivot pin assembly 422 may include one or more suitable washers. The first mounting bracket assembly 410 is made of steel in this example embodiment. It should be appreciated that the first mounting bracket assembly 410 may be alternatively sized, configured, and made of different materials in accordance with the present disclosure.

The second mounting bracket assembly 430 includes: (1) a mounting base 432; (2) a first mounting leg 434; and (3) a second mounting leg 436. The second mounting leg 436 is aligned with and spaced apart from the first mounting leg 434. The mounting base 432, the first mounting leg 434, and the second mounting leg 436 are suitably connected to the roof 28 and specifically to the curved panel 30 of the roof 28 adjacent to the coaming 40 as best shown in FIGS. 8 and 10. The second mounting bracket assembly 430 further includes: (4) a first mounting arm 438 integrally connected to and extending from the hinge plate 480; and (5) a second mounting arm 440 integrally connected to and extending from the hinge plate 480. The second mounting arm 440 is aligned with and spaced apart from the first mounting arm 438. The first mounting leg 434, the second mounting leg 436, the first mounting arm 438, and the second mounting arm 440 define aligned openings (not shown or labeled) for receiving part of a pivot pin assembly 441. The second mounting bracket assembly 430 is made of steel in this example embodiment. It should be appreciated that the second mounting bracket assembly 430 may be alternatively sized, configured, and made of different materials in accordance with the present disclosure.

The first mounting arm 438 and the second mounting arm 440 are pivotally mounted to the first mounting leg 434 and the second mounting leg 436 by the pivot pin assembly 441 to facilitate a suitable amount of clearance for pivoting and rotation of the first mounting arm 438 and the second mounting arm 440 relative to the roof 28 and specifically the curved panel 30 of the roof 28 as well as the coaming 40 of the roof 28. A solid shaft (not labeled) extends through first mounting leg 434, the four bar linkage (not labeled), the second mounting leg 436, the first mounting arm 438, the hollow tube 442, and the second mounting arm 440. The hollow tube 442 is fixedly attached to arms 438 and 440. The solid shaft is fixedly attached to the hollow tube 442 and arms 438 and 440 using bolts that pass through the holes in the hollow tube 442 and holes in the solid shaft. When the four bar linkage is actuated, it rotates the solid shaft, which rotates the hollow tube 442 and arms 438 and 440, causing hinge plate 480 to rotate.

It should be appreciated that the actuator linkage assembly 450 is suitably fixedly connected to the pivot pin assembly 441 such that actuation of the rod 625 of the actuator 600 (as described below) causes the actuator linkage assembly 450 to rotate parts of the actuator linkage assembly 450, which rotate the first mounting arm 438 and the second mounting arm 440, which rotate the pivot arm 460 and the hinge plate 480, which causes the hatch 200 to move from the closed position to the fully open position.

It should be appreciated that the actuator linkage assembly 450 may include any suitable linkages and connectors that are arranged such that extension of the extendable rod 625 of the actuator 600 causes pivot pin assembly 441 to rotate relative to the first mounting leg 434 and the second mounting leg 436. The actuator linkage assembly 450 is made of steel in this example embodiment. It should be appreciated that the actuator linkage assembly 450 may be alternatively sized, configured, and made of different materials in accordance with the present disclosure.

The pivot arm 460 includes: (1) an elongated hatch connector base 462; and (2) an elongated support wall 464 integrally centrally connected to and upwardly extending from the elongated hatch connector base 462. The hatch connector base 462 includes a bottom surface (not labeled) that is positioned on the top surface of the elongated panel 210 of the hatch 200. The hatch connector base 462 includes a plurality of openings (not labeled) for suitable fasteners (not labeled) that connect the hatch connector base 462 (and thus the pivot arm 460) to the panel 210. The support wall 464 adds structural support to the hatch connector base 462 and facilitates the rotation of the hatch 200. The elongated hatch connector base 462 and the elongated support wall 464 are integrally connected to the arm 420, the collar of the pivot pin assembly 422, and the hinge plate 480. This configuration enables the pivot arm 460 and the section of the panel 210 of the hatch 200 to pivot relative to the first mounting bracket assembly 410, the coaming 40, and the roof 28. The pivot arm 460 is made of steel in this example embodiment. It should be appreciated that the pivot arm 460 may be alternatively sized, configured, and made of different materials in accordance with the present disclosure.

The hinge plate 480 includes a top portion 482 and a bottom portion 490 suitably connected by a plurality of fasteners (not labeled) to the hatch as best shown in FIG. 10. The hinge plate 480 is made of steel in this example embodiment. It should be appreciated that the hinge plate 480 may be alternatively sized, configured, and made of different materials in accordance with the present disclosure.

This configuration enables the hinge plate 480 and the first end of the hatch 200 of the hatch cover 150 to pivot via the first mounting bracket assembly 410 and the second mounting bracket assembly 430 and relative to the coaming 40, the cover panel 30, and the roof 28.

As mentioned above, and as best shown in FIGS. 6, 7, 8, 9, and 10, the hatch cover 150 includes: (1) the first actuator 600 suitably connected at one end to actuator linkage assembly 450 of the first end hinge 400 and at the other end to the curved panel 30 of the roof 28, and (2) the second actuator 700 suitably connected at one end to the actuator linkage assembly of the second end hinge 500 and at the other end to the curved panel 30 of the roof 28. More specially, in this illustrated example embodiment, each of the actuators 600 and 700 are identical, and thus actuator 600 is primarily discussed in detail for brevity. It should be appreciated that the actuator 600 and 700 do not need be identical in accordance with the present disclosure.

The actuator 600 generally includes: (1) a mounting bracket 610; and (2) a powered cylinder assembly 620. The mounting bracket 610 is suitably connected to the curved panel 30 of the roof 28 adjacent the coaming 40. Thus, the actuator 600 is connected to the curved panel 30 of the roof 28 via the mounting bracket 610, and one or more fasteners, welds, or other connection mechanisms (not shown or labeled) in accordance with the present disclosure. The powered cylinder assembly 620 is pivotally connected to the mounting bracket 610. The powered cylinder assembly 620 includes an extendable movable rod 625 suitably connected to the actuator linkage assembly 450 of the first end hinge 400. The powered cylinder assembly 620 is configured to receive suitable control signals or instructions from a suitable controller (not shown) in a suitable manner. It should be appreciated that this signals or instructions can be sent and received via any suitable manner. The actuator 600 can be pneumatically powered, hydraulically powered, or electrically powered in various different embodiments. It should be appreciated that the powered cylinder assembly 620 can be any suitable such assembly. It should also be appreciated that the actuator 600 (as well as actuator 700) may be alternatively configured or be alternative actuators in accordance with the present disclosure.

As mentioned above, the actuators 600 and 700 co-act to provide forces to move and particularly to rotate the hatch 200 from the closed position to the fully open position, and vice versa. In the illustrated embodiment, the actuators 600 and 700 are respectively positioned adjacent to the first and second ends of the hatch 200. The actuators 600 and 700 are configured to open the hatch 200 from either or both ends. Each actuator can lift the respective end of the elongated movable flexible hatch 200 to cause a sequential lifting of the hatch 200 from the coaming 40 in sequential sections from that end. This process in effect causes an unpeeling of the hatch 200 from the coaming 40. Both actuators 600 and 700 can cause this to occur simultaneously from both ends of the hatch 200 such that the unpeeling effect meets in the middle of the hatch 200 and such that the central section of the hatch 200 is the last section to be lifted (or unpeeled) from the coaming 40.

Turning now to the illustrated example hatch cover securer 1000, the hatch cover securer 1000 generally includes: (1) a mounting assembly 1110; (2) a hatch cover engager rotator 1200 supported by the mounting assembly 1110; (3) a biasing assembly 1300 suitably connected to the hatch cover engager rotator 1200; (4) a hatch cover engager 1400 suitably connected to the hatch cover engager rotator 1200; (5) a first actuator 1600 suitably connected to the hatch cover engager rotator 1200; and (6) a second actuator 1700 suitably connected to the hatch cover engager rotator 1200.

Figure 2:
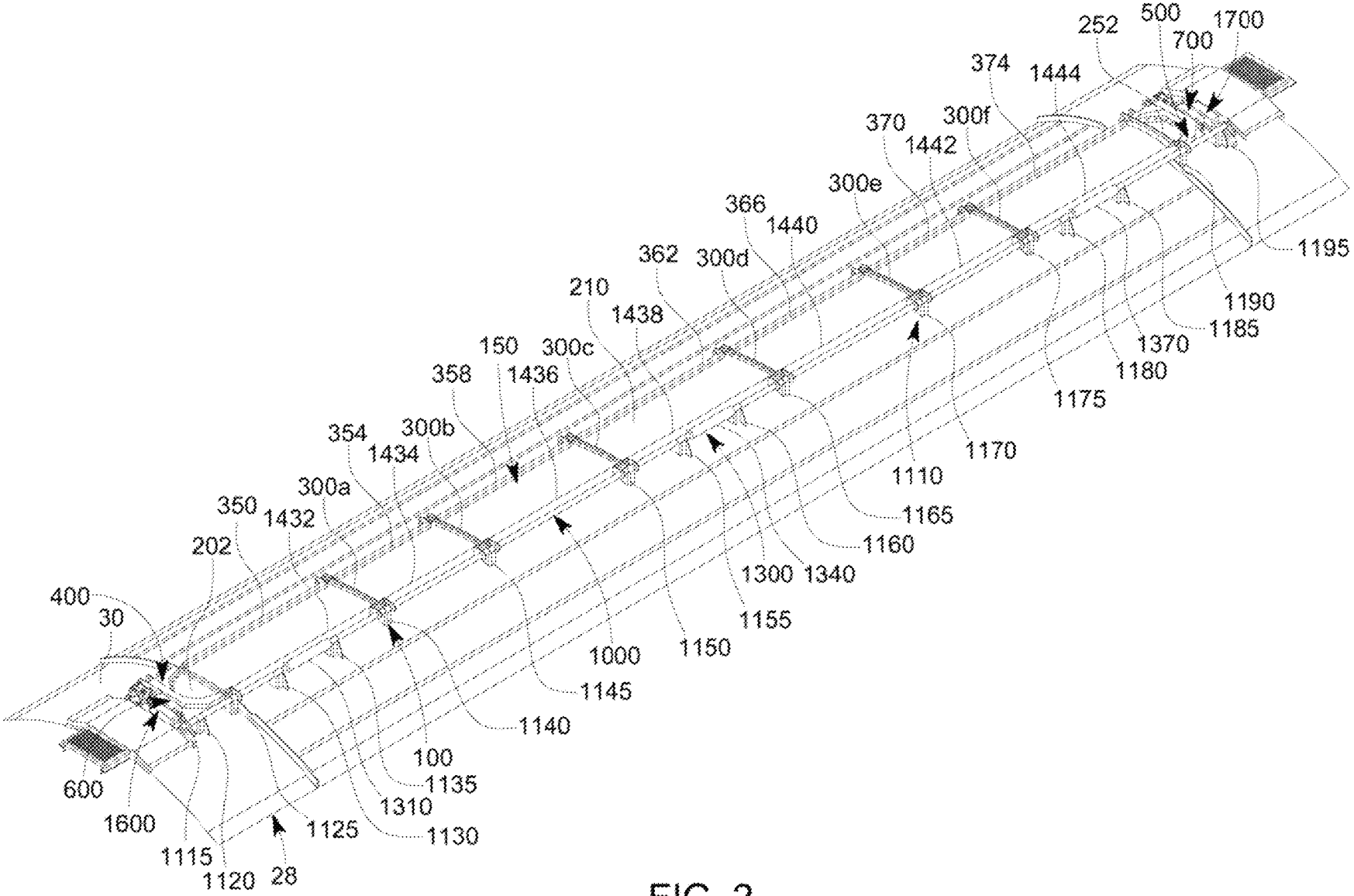
FIG. 2 is an enlarged top perspective view of the roof of an example hopper railroad car, showing a top hatch cover assembly of one example embodiment of the present disclosure connected to the roof of the hopper railroad car of FIG. 1 and shown in the closed position.
Figure 3:
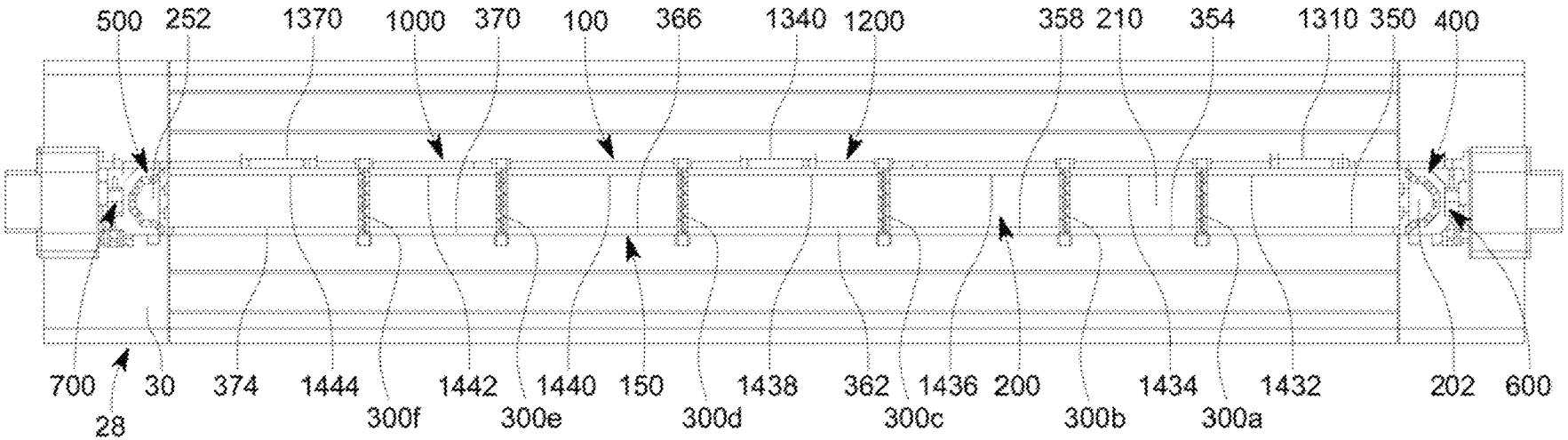
FIG. 3 is an enlarged top view of the roof of the hopper railroad car of FIG. 2, and the top hatch cover assembly of FIG. 2 shown connected to the roof of the hopper railroad car of FIG. 1 and shown in the closed position.
Figure 4:
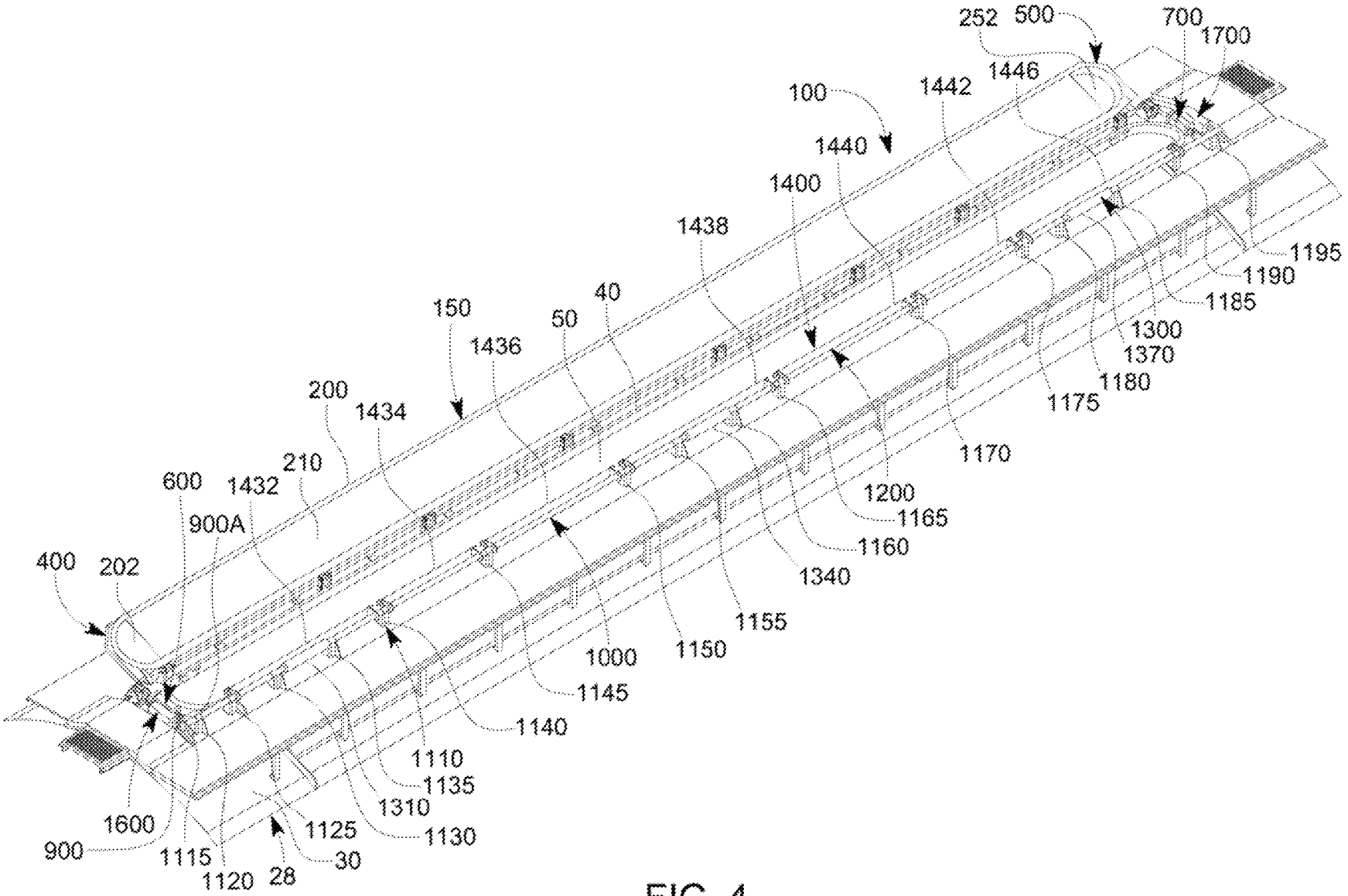
FIG. 4 is a top perspective view of the roof of the hopper railroad car of FIG. 2, and the top hatch cover assembly of FIG. 2 shown connected to the roof of the hopper railroad car of FIG. 1 and shown in an open position.
Figure 5:
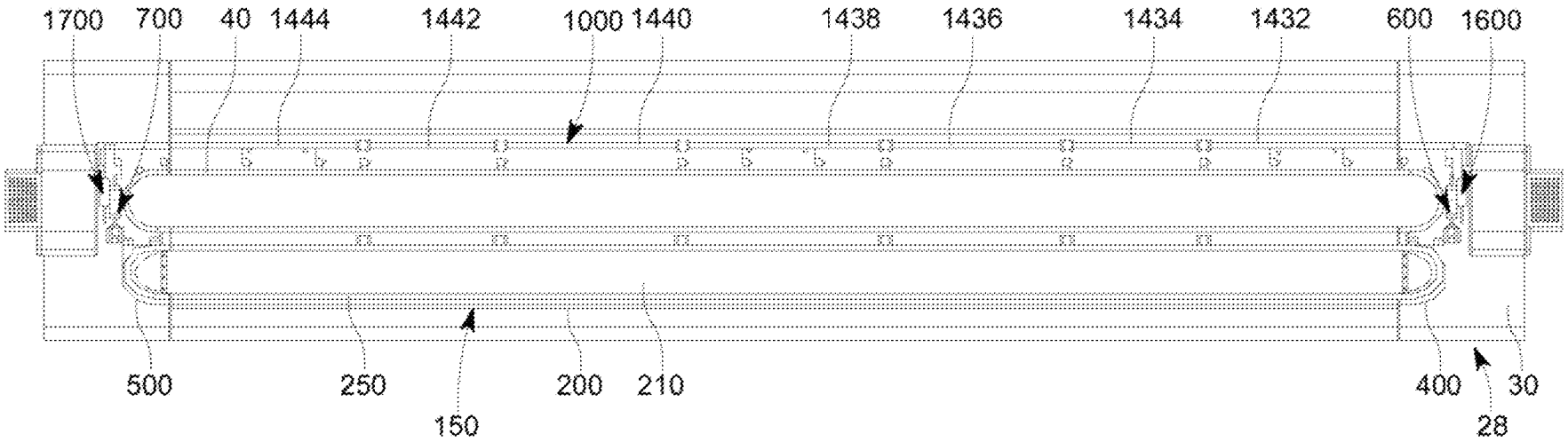
FIG. 5 is a top view of the roof of the example hopper railroad car of FIG. 2, and the top hatch cover assembly of FIG. 2 shown connected to the roof of the hopper railroad car of FIG. 1 and shown in an open position.
Figure 6:
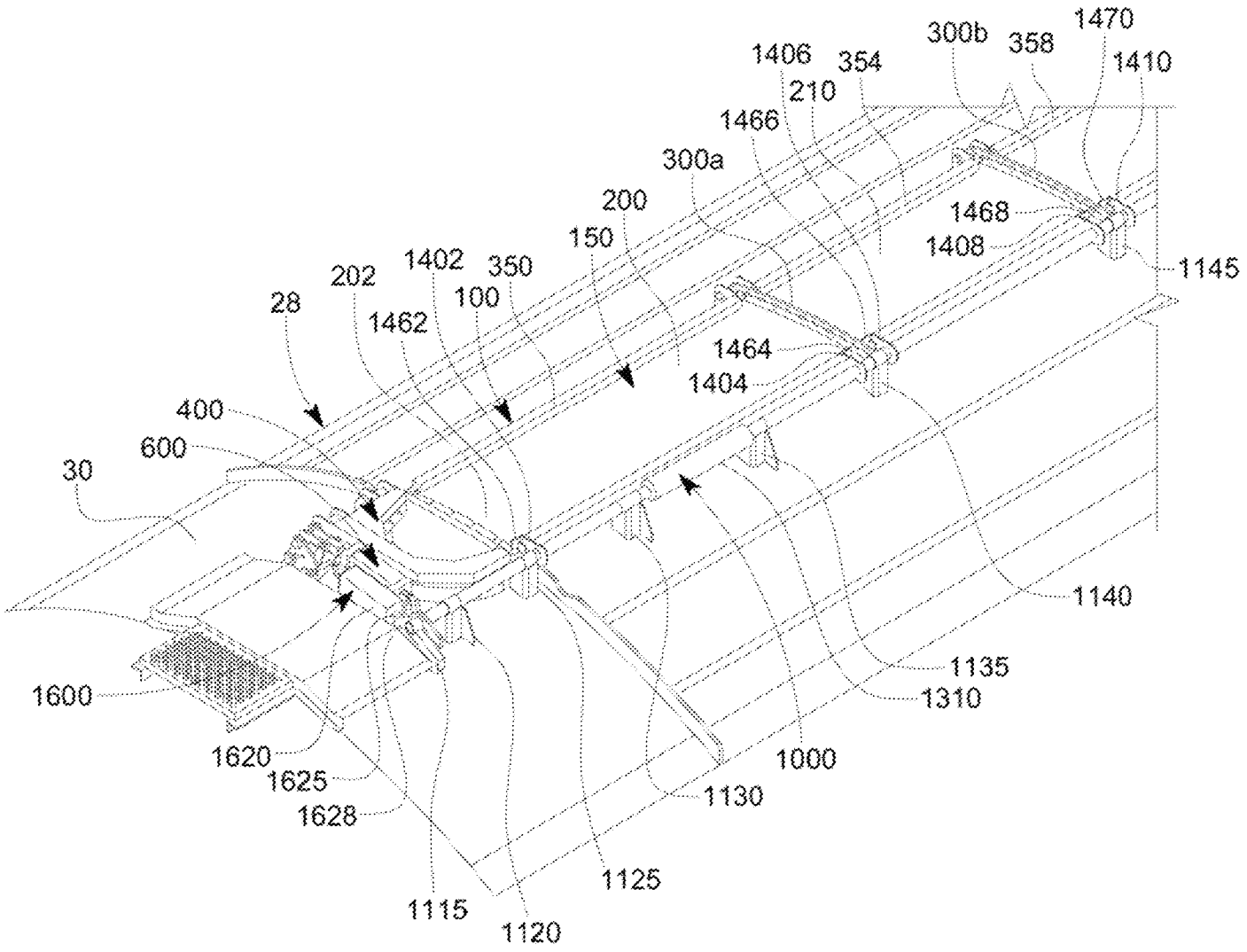
FIG. 6 is a further enlarged fragmentary top perspective view of a first end of the roof of the example hopper railroad car of FIG. 1, and a first end of the top hatch cover assembly of FIG. 2 shown connected to the first end of the roof of the hopper railroad car of FIG. 1 and shown in the closed position.

The mounting assembly 1110 includes a plurality of spaced apart mounting brackets such as mounting brackets 1115, 1120, 1125, 1130, 1135, 1140, 1145, 1150, 1155, 1160, 1165, 1170, 1175, 1180, 1185, 1190, and 1195, as generally shown in FIGS. 2 and 4. These mounting brackets 1115, 1120, 1125, 1130, 1135, 1140, 1145, 1150, 1155, 1160, 1165, 1170, 1175, 1180, 1185, 1190, and 1195 are configured to support the hatch cover engager rotator 1300 such that the hatch cover engager rotator 1300 can rotate: (1) from a first position shown in FIGS. 2, 3, 6, 9, 10, and 12; (2) to a second position shown in FIGS. 4, 5, 7, 8, 15, 16, 17, 18, and 19; and (3) back to the first position. These mounting brackets 1115, 1120, 1125, 1130, 1135, 1140, 1145, 1150, 1155, 1160, 1165, 1170, 1175, 1180, 1185, 1190, and 1195 are also configured to support the biasing assembly 1300, as also shown in FIGS. 2 and 4.

Each of these mounting brackets includes a base portion (not labeled) and a receiver portion (not labeled) integrally connected to the respective base portion. For example, as shown in FIGS. 16, 17, 18, and 19, mounting bracket 1145 includes a base portion 1146 and a receiver portion 1147 integrally connected to the base portion 1146. Each base portion is fixedly connected to the curved panel 30 of the roof 28. Each receiver portion is configured to receive and be journaled about a portion of the hatch cover engager rotator 1200. In this illustrated example embodiment, each receiver portion includes a hollow cylindrical member through which part of the hatch cover engager rotator 1200 extends and which supports that part of the hatch cover engager rotator 1200. Each of the mounting brackets pivot arm is made of steel in this example embodiment. It should be appreciated that any of the mounting brackets may be alternatively sized, configured, and made of different materials in accordance with the present disclosure.

Figure 19:
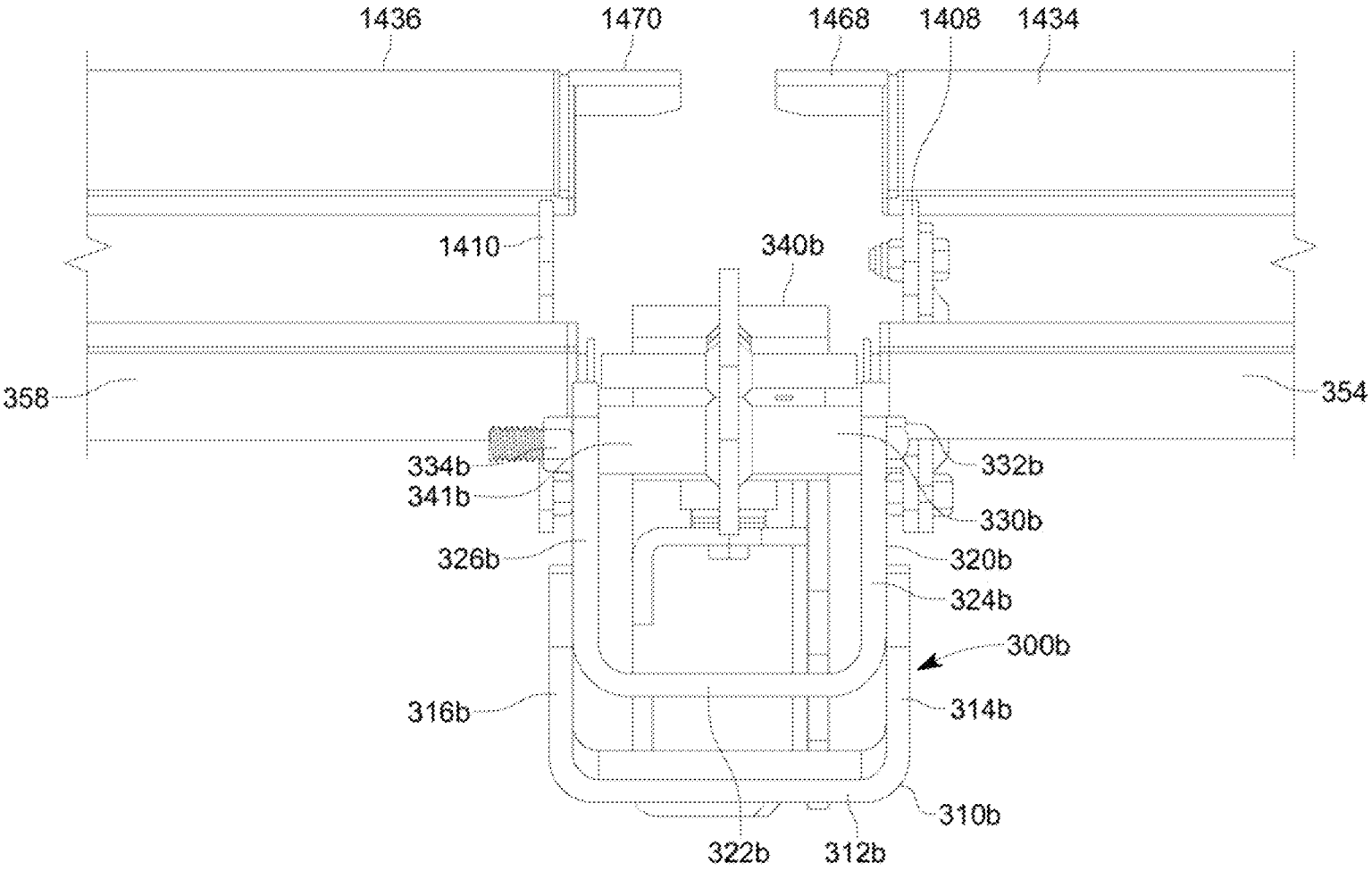
FIG. 19 is an enlarged fragmentary side view of certain parts (including one of the central hinges) of the hatch cover and of certain parts (including one of the hatch cover engagers) of the hatch cover securer of the hatch cover assembly of FIG. 2.

The hatch cover engager rotator 1200 includes a plurality of elongated cylindrical rods that are not individually labeled and a plurality of rod connectors that are not individually labeled. For example, as shown in FIGS. 16 and 19, the rods 1216 and 1218 are suitably connected by rod connecter 1217. The rod connectors suitably connect the rods to form the hatch cover engager rotator 1200. It should be appreciated that any suitable quantity of rods and rod connectors may be employed in accordance with the present disclosure. The hatch cover engager rotator is made of steel in this example embodiment. It should be appreciated that the hatch cover engager rotator may be alternatively sized, configured, and made of different materials in accordance with the present disclosure.

Generally, in the first position, the hatch cover engager rotator 1200 causes the hatch cover engager 1400 to engage the hatch 200, the hinges 300*a*, 300*b*, 300*c*, 300*d*, 300*e*, and 300*f*, and the hinges 400 and 500 at various spaced apart positions along the hatch cover 150 to secure the hatch cover 150 in the closed position and to secure the hatch cover 150 and specifically the hatch 200 to the coaming 40 (as shown in FIGS. 2, 3, 6, 9, 10, 11, and 12). The hatch cover engager rotator 1200 is biased toward the first position by the biasing assembly 1300. Generally, in the second position, the hatch cover engager rotator 1200 causes the hatch cover engager 1400 to be dis-engaged from the hatch cover 150 and out of the way of the hatch cover 150 to allow parts of the hatch cover 150 (and specifically the hatch 200 and the arms of the hinges 300*a*, 300*b*, 330*c*, 300*d*, 300*e*, and 300*f* of the hatch cover 150) to move from the closed position to a fully opened position (shown in FIGS. 4, 5, 7, 8, 13, 14, and 15).

The biasing assembly 1300 includes one or more biasing members such as biasing members 1310, 1340, and 1370 suitably connected to the hatch cover engager rotator 1200 and particularly to one or more of the rods of the hatch cover engager rotator 1200. The biasing members 1310, 1340, and 1370 in this example embodiment each include a torsion spring. The biasing members 1310, 1340, and 1370 are configured to bias the hatch cover engager rotator 1200 and the hatch cover engager 1400 toward the first position. If the hopper railroad car or the top hatch cover assembly 100 loses power, the biasing members 1310, 1340, and 1370 are configured to cause the hatch cover engager rotator 1200 to rotate toward the first position such that the hatch cover engager 1400 can secure the hatch cover 150 to the coaming 40 even if the hopper railroad car or the hatch cover assembly 100 loses power. The biasing assembly is made of steel in this example embodiment. It should be appreciated that the biasing assembly may be alternatively sized, configured, and made of different materials in accordance with the present disclosure.

The hatch cover engager 1400 includes: (1) a plurality of engager supporting arms 1402, 1404, 1406, 1408, 1410, 1412 (not labeled), 1414 (not labeled), 1416 (not labeled), 1418 (not labeled), 1420 (not labeled), 1422 (not labeled), 1424, 1426, and 1428; (2) a plurality of elongated first hatch engagers 1432, 1434, 1436, 1438, 1440, 1442, and 1444; and (3) a plurality of second hatch engagers 1462, 1464, 1466, 1468, 1470, 1472 (not labeled), 1474 (not labeled), 1476 (not labeled), 1478 (not labeled), 1480 (not labeled), 1482 (not labeled), 1484, 1486, and 1488.

The plurality of engager supporting arms 1402, 1404, 1406, 1408, 1410, 1412, 1414, 1416, 1418, 1420, 1422, 1426, and 1428 are respectively fixedly connected to the rods of the hatch cover engager rotator 1200 and extend from such rods. The supporting arms are made of steel in this example embodiment. It should be appreciated that the supporting arms may be alternatively sized, configured, and made of different materials in accordance with the present disclosure.

Figure 18:
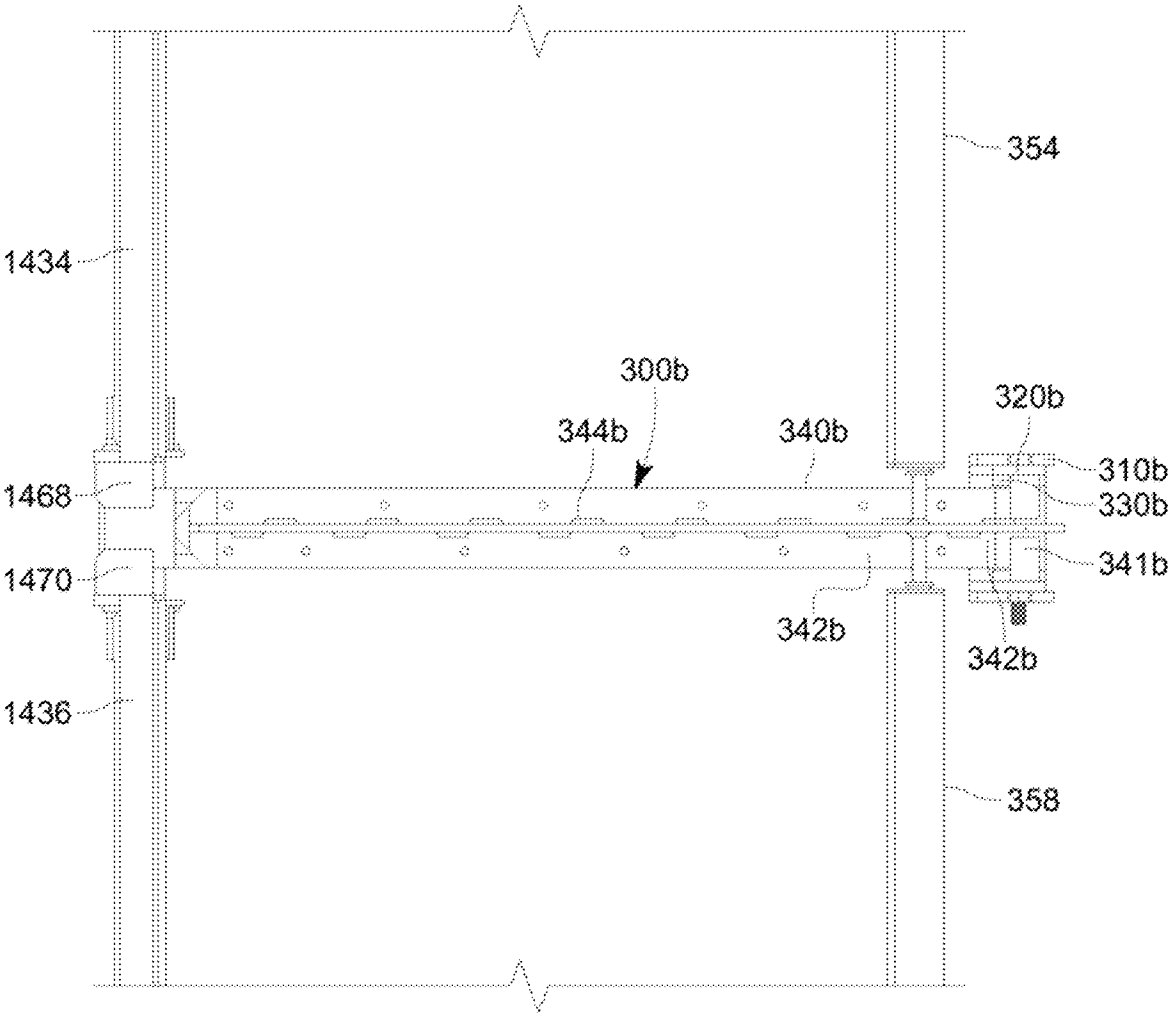
FIG. 18 is an enlarged fragmentary top view of certain parts (including one of the central hinges) of the hatch cover and of certain parts (including one of the hatch cover engagers) of the hatch cover securer of the hatch cover assembly of FIG. 2.

The plurality of first elongated hatch engagers 1432, 1434, 1436, 1438, 1440, 1442, and 1444, are respectively suitably connected to the plurality of engager supporting arms 1402, 1404, 1406, 1408, 1410, 1412, 1414, 1416, 1418, 1420. Each first hatch cover engager is an elongated member suitably connected to and between two of the respective supporting arms. Specifically, (1) hatch engager 1432 extends between and is suitably connected to engager supporting arms 1402 and 1404; (2) hatch engager 1434 extends between and is suitably connected to engager supporting arms 1406 and 1408; (3) hatch engager 1436 extends between and is connected to engager supporting arms 1410 and 1412; (4) hatch engager 1438 extends between and is suitably connected to engager supporting arms 1414 and 1416; (5) hatch engager 1440 extends between and is suitably connected to engager supporting arms 1418 and 1420; (6) hatch engager 1442 extends between and is suitably connected to engager supporting arms 1422 and 1424; and (7) hatch engager 1444 extends between and is suitably connected to engager supporting arms 1426 and 1428. As best shown in FIGS. 16, 18, and 19, for example, the hatch cover engager 1434 is suitably connected at one end to supporting arm 1408 and the hatch cover engager 1434 is suitably connected at one end to supporting arm 1410. Each first hatch cover engager is configured to engage a portion of the top surface of the hatch 200 over a section of the hatch 200 that includes the seal 250 to thus apply pressure to that portion of the hatch 200 and that portion of the seal 250. The first hatch cover engagers are made of steel in this example embodiment. It should be appreciated that the first hatch cover engagers may be alternatively sized, configured, and made of different materials in accordance with the present disclosure.

The plurality of second hatch cover engagers 1462, 1464, 1466, 1468, 1470, 1472, 1474, 1476, 1478, 1480, 1482, 1484, 1486, and 1488, are respectively suitably connected to the plurality of engager supporting arms 1402, 1404, 1406, 1408, 1410, 1412, 1414, 1416, 1418, 1420, 1422, 1424, 1426, and 1428. Each second hatch cover engager is an L-Shaped member connected to one of the supporting arms. Specifically, (1) hatch cover engager 1462 is suitably connected to and extends from engager supporting arm 1402; (2) hatch cover engager 1464 is suitably connected to and extends from engager supporting arm 1404; (3) hatch cover engager 1466 is suitably connected to and extends from engager supporting arm 1406; (4) hatch cover engager 1468 is suitably connected to and extends from engager supporting arm 1408; (5) hatch cover engager 1470 is suitably connected to and extends from engager supporting arm 1410; (6) hatch cover engager 1472 is suitably connected to and extends from engager supporting arm 1412; and (7) hatch cover engager 1474 is suitably connected to and extends from engager supporting arm 1414; (8) hatch cover engager 1476 is suitably connected to and extends from engager supporting arm 1416; (9) hatch cover engager 1478 is suitably connected to and extends from engager supporting arm 1418; (10) hatch cover engager 1480 is suitably connected to and extends from engager supporting arm 1420; (11) hatch cover engager 1482 is suitably connected to and extends from engager supporting arm 1422; (12) hatch cover engager 1484 is suitably connected to and extends from engager supporting arm 1424; (13) hatch cover engager 1486 is suitably connected to and extends from engager supporting arm 1426; and (15) hatch cover engager 1488 is suitably connected to and extends from engager supporting arm 1428. As best shown in FIGS. 16, 18, and 19, for example, the hatch cover engager 1468 is suitably connected to supporting arm 1408, and the hatch cover engager 1470 is suitably connected to supporting arm 1410. Each second hatch cover engager is configured to engage the top surface of the one of the pivot arms of a respective one of the hinges 300*a*, 300*b*, 300*c*, 300*d*, 300*e*, 300*f*, 400, or 500. For example, as indicted by FIGS. 16, 18, and 19, the hatch cover engager 1468 is configured to engage the top surface of the elongated hatch connector base 342*b* of pivot arm 340*b* on one side of the elongated support wall 344*b*, and the hatch cover engager 1470 is configured to engage the top surface of the elongated hatch connector base 342*b* of pivot arm 340*b* on the opposite side of the elongated support wall 344*b*. Each second hatch cover engager is configured to engage the hinges and to apply pressure to that portion of the hatch 200. The first hatch cover engagers respectively engage the hatch between respective sets of spaced apart second hatch engagers, and thus the first hatch cover engagers and the second hatch cover engagers co-act to secure the hatch 200 in the closed position. The second hatch cover engagers are made of steel in this example embodiment. It should be appreciated that the second hatch cover engagers may be alternatively sized, configured, and made of different materials in accordance with the present disclosure.

Collectively, these multiple spaced apart engagements, enable the hatch cover securer 1000 to selectively secure the hatch 200 of the hatch cover 150 in place engaging the coaming.

It should be appreciated that while this illustrated example embodiment includes two different types of hatch cover engagers, in other embodiments, only either one of such different hatch cover engagers are employed or only certain of these hatch cover engagers are employed.

The hatch cover securer 1000 includes: (1) the first actuator 1600 suitably connected at one end to the hatch cover engager rotator 1200 and at the other end to the curved panel 30 of the roof 28; and (2) the second actuator 1700 suitably connected at one end to the hatch cover engager rotator 1200 and at the other end to the curved panel 30 of the roof 28. More specially, in this illustrated example embodiment, each of the actuators 1600 and 1700 are identical, and thus actuator 1600 is primarily discussed in detail for brevity. It should be appreciated that the actuator 1600 and 1700 do not need be identical in accordance with the present disclosure.

The actuator 1600 generally includes: (1) a mounting bracket 1610; and (2) a powered cylinder assembly 1620. The mounting bracket 1610 is suitably connected to the curved panel 30 of the roof 28 adjacent the coaming 40. The powered cylinder assembly 1620 is pivotally connected to the mounting bracket 1610. The powered cylinder assembly 1620 includes an extendable movable rod 1625 suitably connected by a linkage assembly 1628 to the hatch cover engager rotator 1200. The extension of the movable rod 1625 causes the hatch cover engager rotator 1200 to rotate from the first position (described above) to the second position (described above). The powered cylinder assembly 1620 is configured to receive suitable control signals or instructions from a suitable controller (not shown) via any suitable manner. It should be appreciated that these signals or instructions can be sent and received via any suitable manner. The actuator 1600 can be pneumatically powered, hydraulically powered, or electrically powered in various different embodiments. It should be appreciated that the powered cylinder assembly can be any suitable such assembly. It should also be appreciated that the actuators 1600 and 1700 may be alternatively configured or be alternative actuators in accordance with the present disclosure.

As mentioned above, the actuators 1600 and 1700 provide forces to rotate the hatch cover engager rotator 1200 and the hatch cover engager 1400 suitably connected to the hatch cover engager rotator 1200 to move the hatch cover engager 1400 from the hatch cover engagement position to the hatch cover non-engagement position, and vice versa. In the illustrated embodiment, two actuators 1600 and 1700 are positioned adjacent to the first and second ends of the hatch cover engager rotator 1200.

Each actuator 1600 and 1700 is suitably connected to the curved panel 30 of the roof 28 via an actuator bracket, and one or more fasteners, welds, or other connection mechanisms (not labeled) in accordance with the present disclosure.

FIGS. 12, 13, 14, 15, and 16 further illustrate part of the operation of the top hatch cover assembly 100 including the hatch cover 150 and the hatch cover securer 1000.

FIG. 12 illustrates the hatch cover 150 in a closed position. In FIG. 12, the hatch cover 150 is positioned engaging the coaming 40 such that oval coaming sealer 250 engages (such as being positioned on the top of) and forms a seal with a suitable surface (such as the oval top surface) of the coaming 40. The coaming sealer 250 remains suitably connected to the steel coaming 40 by the force applied by the hatch cover securer 1000. It should be appreciated that the combination of: (1) the hinge 400; (2) the hinge 500; (3) the pivot arms of hinges 300*a* to 300*f*; (4) the additional hatch engagement members 350, 354, 358, 362, 366, 370, and 374; (5) the first elongated hatch engagers 1432, 1434, 1436, 1438, 1440, 1442, and 1444; and (6) the plurality of second hatch cover engagers 1462, 1464, 1466, 1468, 1470, 1472, 1474, 1476, 1478, 1480, 1482, 1484, 1486, and 1488, are individually and collectively configured to engage respective portions of the top surface of the hatch 200 over a section of the hatch 200 that includes the seal 250 to apply even amounts of pressure to those portions of the hatch 200 and those portions of the seal 250. In various embodiments, these components co-act to compress the seal under a desired amount of pressure at least point or section of the seal 250. In various such embodiments, the amounts of pressure is even or substantially even over the entire lengths of both sides of the coaming and both ends of the coaming. In various such embodiments, the amounts of pressure are greater than 5 pounds per every 3 inches. In various embodiments, the biasing assembly maintains this pressure even if power is lost.

Figure 13:
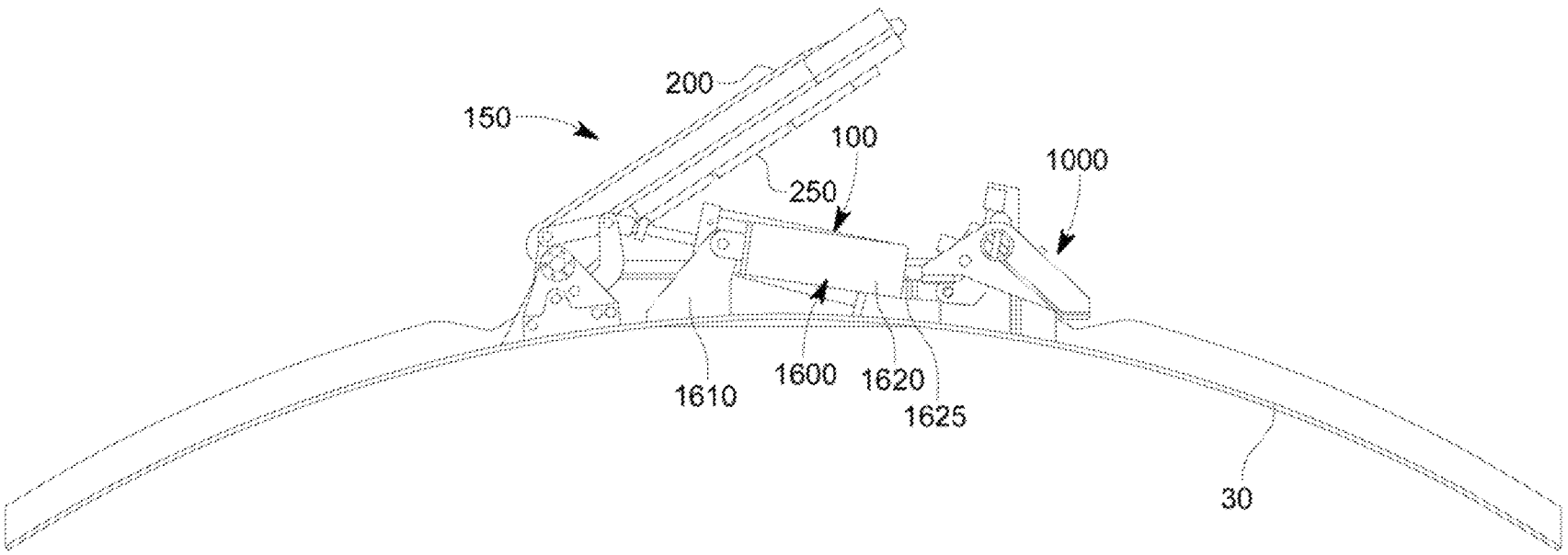
FIG. 13 is an enlarged fragmentary end view of the first end of the roof of the example hopper railroad car of FIG. 1, and the first end of the top hatch cover assembly of FIG. 2 shown connected to the first end of the roof of the hopper railroad car of FIG. 1 and shown in a partially open position.
Figure 14:
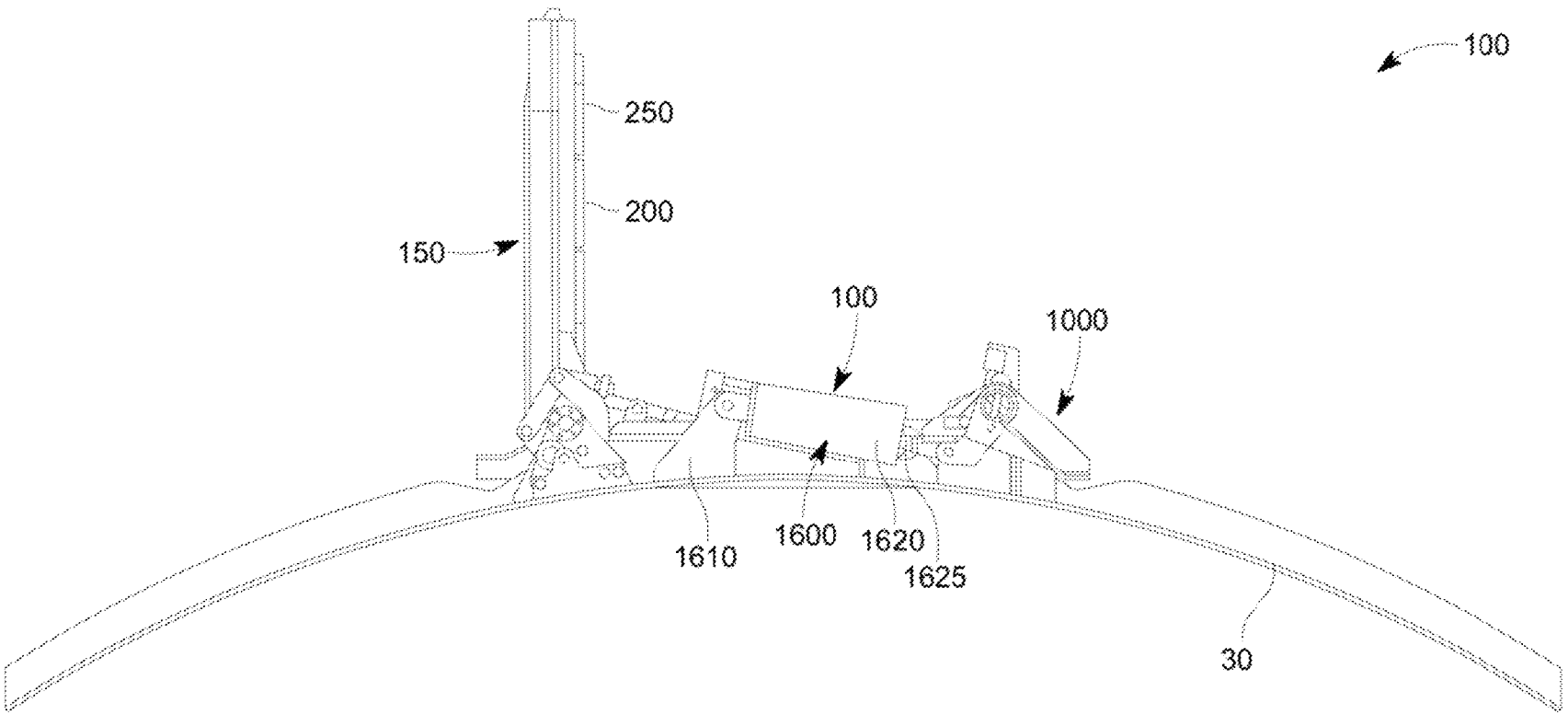
FIG. 14 is an enlarged fragmentary end view of the first end of the roof of the example hopper railroad car of FIG. 1, and the first end of the top hatch cover assembly of FIG. 2 shown connected to the first end of the roof of the hopper railroad car of FIG. 1 and shown in a further partially open position.

FIGS. 13 and 14 illustrate the hatch cover 150 in partially open positions. To open the hatch 200, the actuator 1600 and 1700 rotate the hatch cover engager rotator 1200 and the hatch cover engager 1400 suitably connected to the hatch cover engager rotator 1200 to move the hatch cover engager 1400 from the hatch cover engagement position to the hatch cover non-engagement position, the actuators 600 and 700 then rotate the hatch 200 causing it to move upwardly and away from the coaming 40 at that end. FIG. 13 shows the rotated hatch cover engager rotator 1200 and the hatch cover engager 1400 out of the way of the hatch 200, and the hatch cover 150 with the hatch 200 partially opened. FIG. 14 shows the hatch 100 further partially opened.

Figure 15:
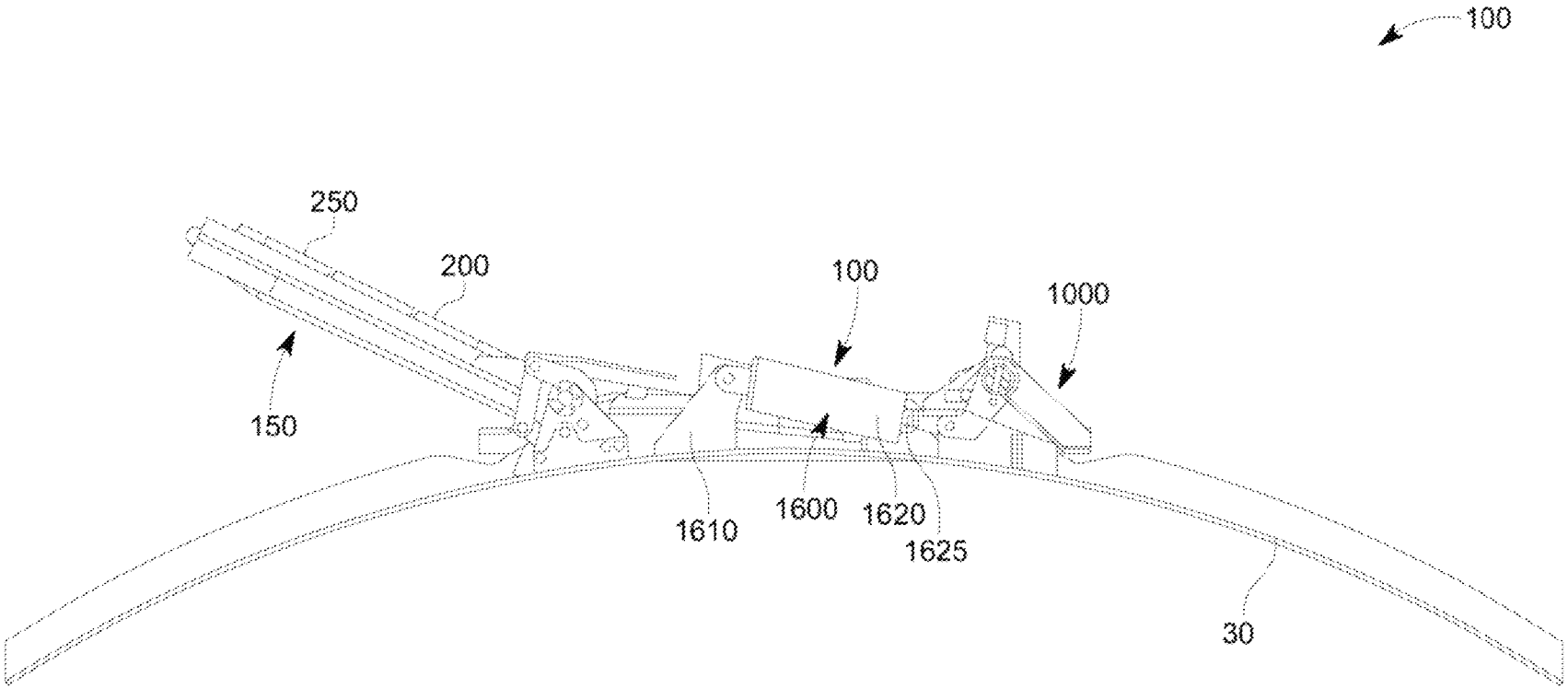
FIG. 15 is an enlarged fragmentary end view of the first end of the roof of the example hopper railroad car of FIG. 1, and the first end of the top hatch cover assembly of FIG. 2 shown connected to the first end of the roof of the hopper railroad car of FIG. 1 and shown in the fully open position.

FIG. 15 illustrates the hatch 200 of the hatch cover 150 in a fully open position. To move to the hatch 200 of the hatch cover 150 closed position, the process is reversed.

Figure 7:
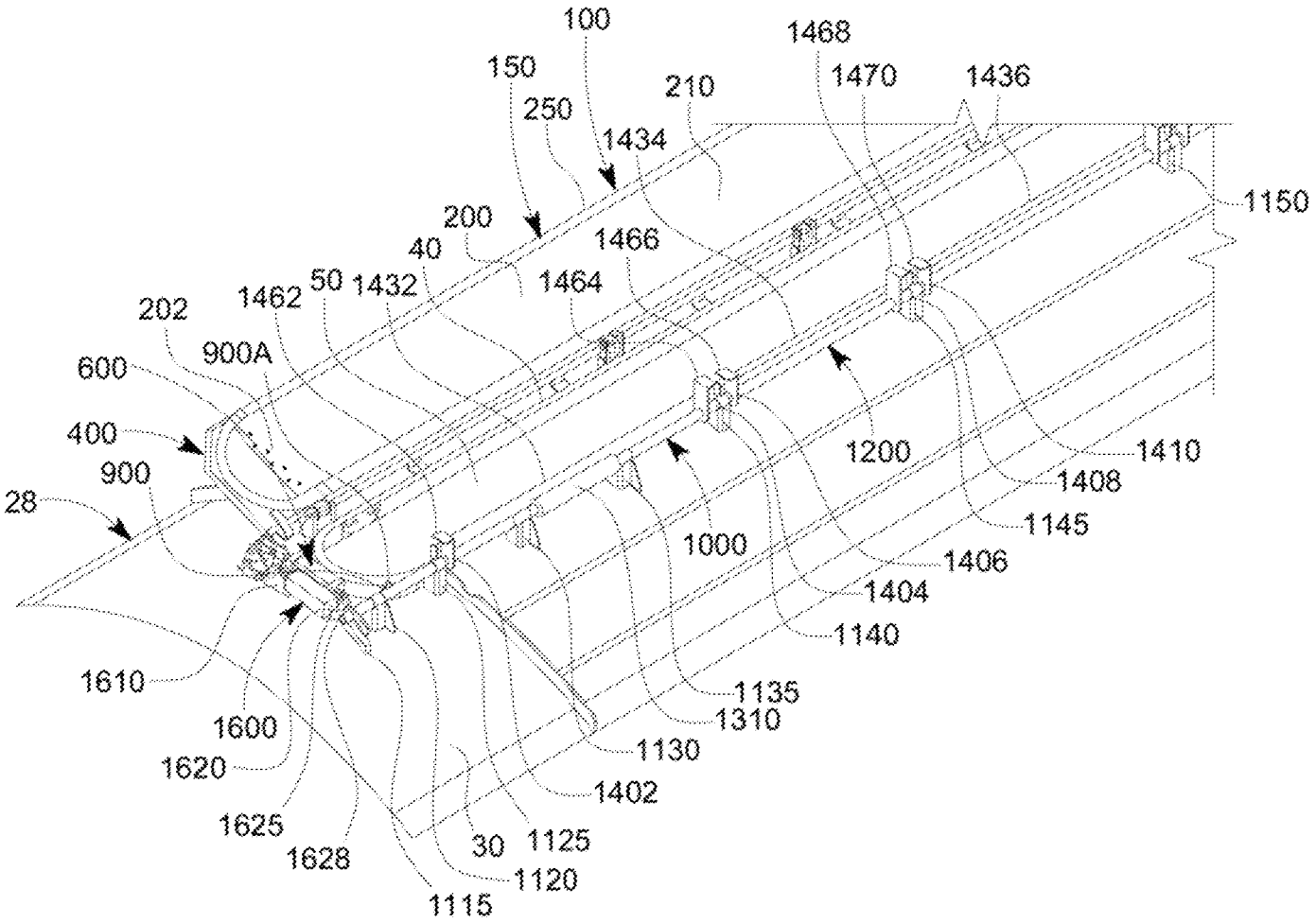
FIG. 7 is a further enlarged fragmentary top perspective view of the first end of the roof of the example hopper railroad car of FIG. 1, and the first end of the top hatch cover assembly of FIG. 2 shown connected to the first end of the roof of the hopper railroad car of FIG. 1 and shown in a fully open position.

It should be appreciated that the present disclosure contemplates adding bumpers such as bumper 900 shown in FIGS. 7 and 8 for supporting the hinges 400 and 500. Such bumpers can include one or more rubber compressible bumper members such as member 900A.

In alternative embodiments of the present disclosure, one or more of the hinges can include a pivot assembly with a torsion shaft to synchronize or link the movement of some or all of the pivot arms.

It should be appreciated from the above that the present disclosure contemplates that the hatch cover can extend outwardly of the coaming to provide drip edges outwardly of the coaming.

Second Example Embodiment

Turning now to FIGS. 20 to 38, an alternative example embodiment of the hatch cover assembly of the present disclosure is generally shown. This example top hatch cover assembly is indicated by numeral 2100. FIGS. 20 to 34 also partially illustrate a roof 28 of an example hopper railroad car, wherein the roof 28 includes a cover panel 30 to which the top hatch cover assembly 2100 of this example embodiment is connected.

Figure 35:
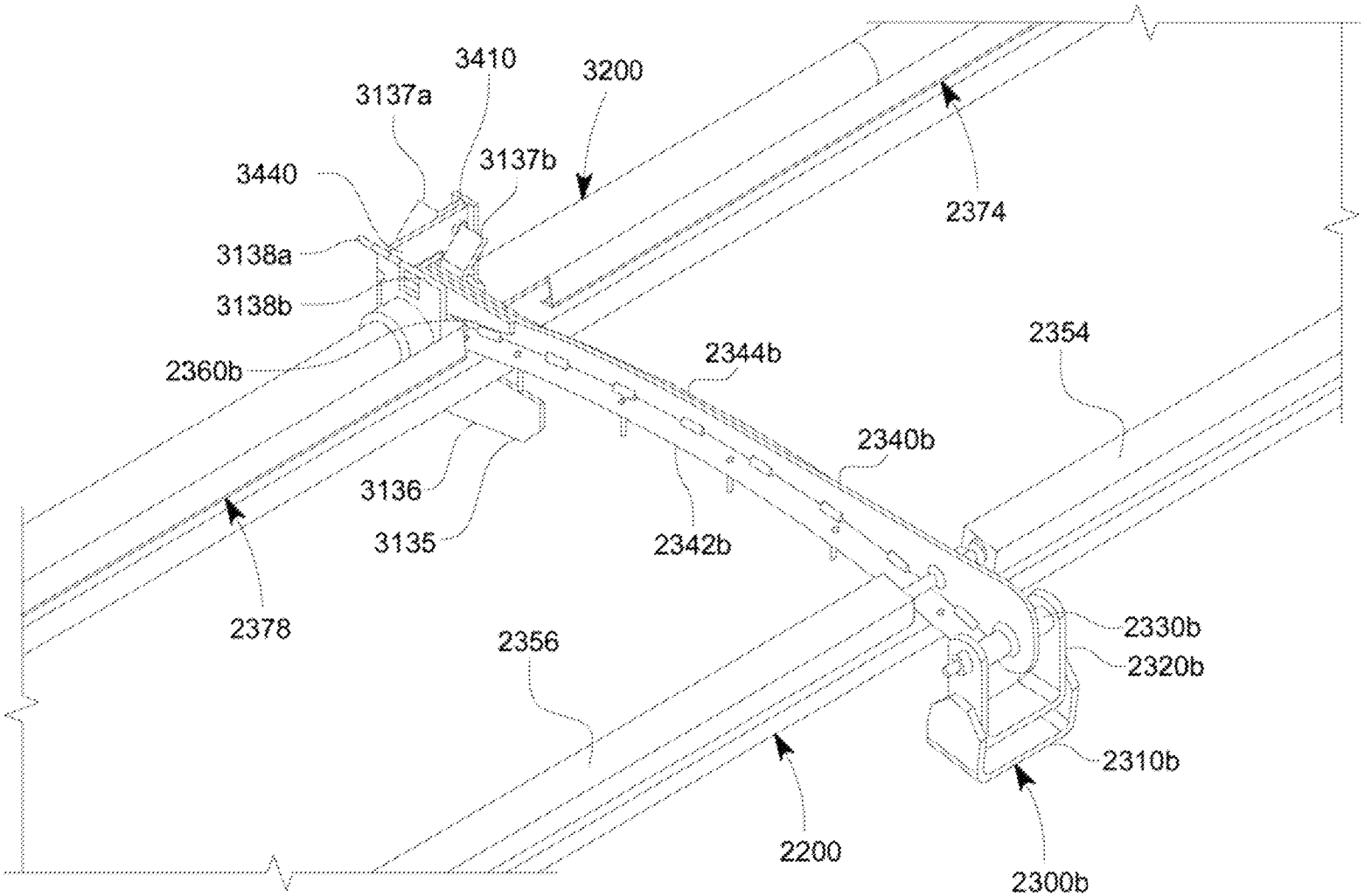
FIG. 35 is an enlarged fragmentary top perspective view of certain parts (including one of the central hinges) of the hatch cover and of certain parts (including one of the hatch cover engagers) of the hatch cover securer of the hatch cover assembly of FIG. 20.
Figure 36:
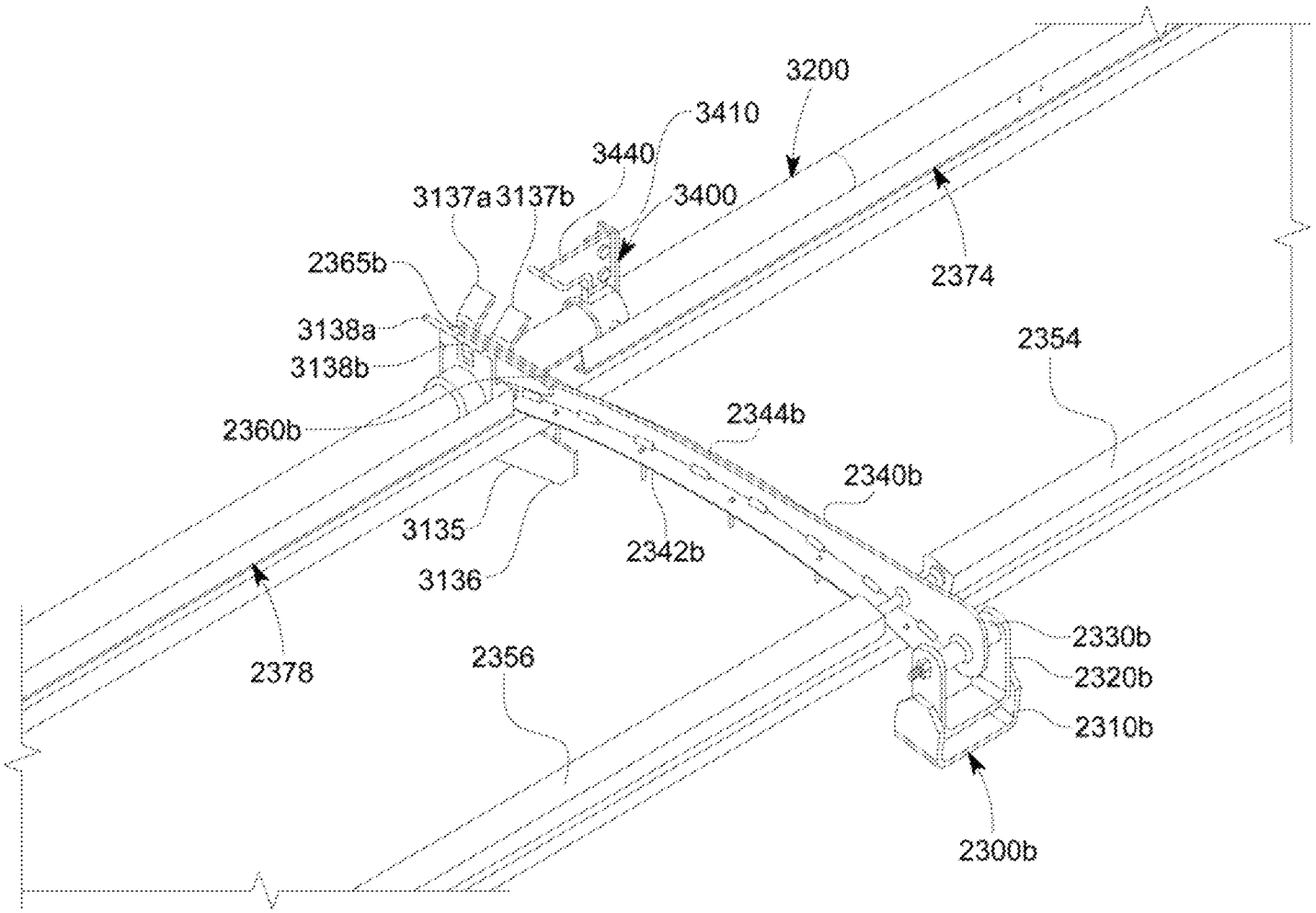
FIG. 36 is an enlarged fragmentary top perspective view of certain parts (including one of the central hinges) of the hatch cover and of certain parts (including one of the hatch cover engagers) of the hatch cover securer of the hatch cover assembly of FIG. 20.

This illustrated example top hatch cover assembly 2100 generally includes: (1) a hatch cover 2150 suitably connected on one side of the coaming 40 to the cover panel 30 of the roof 28 and including an elongated movable hatch 2200 pivotally movable from a closed position engaging the coaming 40 (as shown in FIGS. 20, 21, 24, 26, 28, 29, 30, and 31) to an open position away from the coaming 40 (as shown in FIGS. 22, 23, 25, 27, 32, 33, and 34); and (2) a hatch cover securer 3000 suitably connected on the other side of the coaming 40 to the cover panel 30 of the roof 28 and including a cover engager 3400 linearly movable from: (a) a hatch cover engagement position (as best shown in FIG. 35) in which the cover engager 3400 secures the hatch cover 2150 in the closed position engaging the coaming 40 to (b) a hatch cover non-engagement position (as best shown in FIG. 36) in which the cover engager 3400 does not engage the hatch cover 2150 and allows the movable hatch 2200 of the hatch cover 2150 to move to the open position, as further explained herein.

In this illustrated example embodiment, the hatch cover 2150 is substantially the same as the hatch cover 150 except as described below. Accordingly, for brevity, only the additional or different features of the hatch cover 2150 are described in detail in this section of the present disclosure.

Similar to the hatch cover 150, the hatch cover 2150 includes: (1) an elongated movable hatch 2200; (2) a plurality of spaced apart central hinges 2300*a*, 2300*b*, 2300*c*, 2300*d*, 2300*e*, and 2300*f*, suitably connected to the hatch 2200 and suitably connected to the roof 28; (3) a first end hinge 2400 suitably connected to a first end (not labeled) of the hatch 2200 and suitably connected to the roof 28; (4) a second end hinge 2500 suitably connected to an opposite second end (not labeled) of the hatch 2200 and suitably connected to the roof 28; (5) a first actuator 2600 suitably connected to the first end hinge 2400 and suitably connected to the roof 28; and (6) a second actuator 2700 suitably connected to the second end hinge 2500 and suitably connected to the roof 28.

Similar to the hatch cover 150, the hatch cover 2150 is suitably connected to the roof 28, and more particularly to the curved panel 30 by the hinges 2300*a*, 2300*b*, 2300*c*, 2300*d*, 2300*e*, 2300*f*, 2400, and 2500. Similar to the hatch cover 150, the hatch cover 2150 is configured to securely engage and provide a seal with the coaming 40 when in a closed position (such as shown in FIGS. 20, 21, 24, 26, 28, 29, 30, and 31) and disengage from the coaming 40 and move to various open positions (such as shown in FIGS. 22, 23, 25, 27, 32, 33, and 34). The hatch cover 2150 is configured to move and particularly pivot between the fully open position and the closed position. Thus, the hatch cover 2150 is configured to unseal and seal the hopper railroad car 10 by moving from the fully open position to the closed position, and vice versa. The hatch cover 2150 is configured to be secured in the fully closed position by the hatch cover securer 3000, as further described herein.

Similar to the hatch cover 150, the elongated movable hatch 2200 of the hatch cover 2150 generally includes: (1) an elongated flexible panel 2210; and (2) an elongated oblong coaming sealer 2250 suitably connected to the bottom of the elongated flexible panel 2210.

As mentioned above, similar to the hatch cover 150, the hatch cover 2150 includes spaced apart central hinges

2300*a*, 2300*b*, 2300*c*, 2300*d*, 2300*e*, and 2300*f* suitably connected to the hatch 2200. In this illustrated example embodiment, each of the central hinges 2300*a*, 2300*b*, 2300*c*, 2300*d*, 2300*e*, and 2300*f* is identical, and thus only central hinge 2300*b* (best shown in FIGS. 35, 36, 37, and 38) is discussed in more detail for brevity. It should be appreciated that the central hinges 2300*a*, 2300*b*, 2300*c*, 2300*d*, 2300*e*, and 2300*f* do not need be identical in accordance with the present disclosure. It should also be appreciates that the quantity and spacing of the central hinges may vary in accordance with the present disclosure.

More specifically, similar to the central hinge 300*b* and as also best shown in FIGS. 35, 36, 37, and 38, the central hinge 2300*b* generally includes: (1) a mounting bracket 2310*b*; (2) a pivot pin bracket 2320*b* suitably fixedly connected to the mounting bracket 2310*b*; (3) a pivot pin assembly 2330*b* suitably connected to the pivot pin bracket 2320*b*; and (4) a pivot arm 2340*b* suitably pivotally connected to the pivot pin bracket 2320*b* by the pivot pin assembly 2330*b* and suitably fixedly connected to the elongated panel 2210. These components are the same as the corresponding components described above except for the pivot arm 2340*b*.

Similar to the central hinge 300*b*, as also best shown in FIGS. 35, 36, 37, and 38, the pivot arm 2340*b* includes: (1) an elongated hatch connector base 2342*b*; and (2) an elongated support wall 2344*b* integrally connected to and upwardly extending from the elongated hatch connector base 2342*b*. The hatch connector base 2342*b* includes a bottom surface (not labeled) that is positioned on the top surface of the elongated panel 2210 of the hatch 2200. The hatch connector base 2342*b* includes a plurality of openings (not labeled) for suitable fasteners (not labeled) that connect the hatch connector base 2342*b* (and thus the pivot arm 2340*b*) to the panel 2210. The support wall 2344*b* adds structural support to the hatch connector base 2342*b* and facilitates the rotation of the hatch 2200. The elongated support wall 2344*b* is integrally connected to the collar (not labeled) of the pivot pin assembly 2330*b*. This configuration enables the pivot arm 2340*b* and the section of the panel 2210 of the hatch 2200 to pivot about the pivot pin assembly 2330*b* and relative to the pivot pin bracket 2320*b*, the coaming 40, and the roof 28.

Additionally, in this example embodiment and as also best shown in FIGS. 35, 36, 37, and 38, the pivot arm 2340*b* includes a hand 2360*b* suitably connected to and extending from the support wall 2344*b*. The hand 2360*b* includes an outwardly extending palm 2365*b*. The palm 2365*b* is configured to extend between two sets of outwardly extending fingers (e.g., between set 3137*a* and 3137*b* and set 3138*a* and 3138*b* (as described below). The pivot arm 2340*b* is made of steel in this example embodiment. It should be appreciated that the pivot arm 2340*b* may be alternatively sized, configured, and made of different materials in accordance with the present disclosure.

In this illustrated example embodiment, the hatch cover 2150 additionally includes a plurality of additional hatch engagement members 2350, 2352, 2354, 2356, 2358, 2360, and 2362 extending between and suitably rotatably and pivotally connected to and between pairs of respective pivot arms of the hinges including spaced apart hinges 2400, 2300*a*, 2300*b*, 2300*c*, 2300*d*, 2300*e*, 2300*f*, and 2500. Specifically, (1) additional hatch engagement member 2350 extends between and is suitably connected to and between the pivot arm (not labeled) of hinge 2400 and the pivot arm of 2300*a* by respective bosses (not labeled) that are each rotatably and pivotally connected to the respective pivot arms; (2) additional hatch engagement member 2352 extends between and is suitably connected to and between the pivot arm of hinge 2300*a* and the pivot arm of 2300*b* by respective bosses (not labeled) that are each rotatably and pivotally connected to the respective pivot arms; (3) additional hatch engagement member 2354 extends between and is suitably connected to and between the pivot arm of hinge 2300*b* and the pivot arm of 2300*c* by respective bosses (not labeled) that are each rotatably and pivotally connected to the respective pivot arms; (4) additional hatch engagement member 2356 extends between and is suitably connected to and between the pivot arm of hinge 2300*c* and the pivot arm of 2300*d* by respective bosses (not labeled) that are each rotatably and pivotally connected to the respective pivot arms; (5) additional hatch engagement member 2358 extends between and is suitably connected to and between the pivot arm of hinge 2300*d* and the pivot arm of 2300*e* by respective bosses (not labeled) that are each rotatably and pivotally connected to the respective pivot arms; (6) additional hatch engagement member 2360 extends between and is suitably connected to and between the pivot arm of hinge 2300*e* and the pivot arm of 2300*f* by respective bosses (not labeled) that are each rotatably and pivotally connected to the respective pivot arms; and (7) additional hatch engagement member 2362 extends between and is suitably connected to and between the pivot arm of hinge 2300*f* and the pivot arm (not labeled) of hinge 2500 by respective bosses (not labeled) that are each rotatably and pivotally connected to the respective pivot arms. Each of the additional hatch engagement members 2350, 2352, 2354, 2356, 2358, 2360, and 2362 has a square cross-section and four flat surfaces. Each of the additional hatch engagement members 2350, 2352, 2354, 2356, 2358, 2360, and 2362 is configured to freely rotate relative to the spaced apart pivot arms to which it is attached. This free rotation enables the opening of the hatch cover 2150 and particularly the hatch 2200 from either or both ends. For instance, as the hatch 2200 is opened from the first end, the first additional hatch engagement member 2350 can rotate as the flexible hatch 2200 moves upwardly. This allowed rotation prevents the bending of the additional hatch engagement member 2350. This free rotation also enables the closing of the hatch cover 2150 and particularly the hatch 2200 from either or both ends in the same manner. It should also be appreciated that these rotational connections enable each pivot arm to move independently and each section of the panel 2210 to be lifted (or lowered) sequentially. Each additional hatch engagement member engager is configured to engage a portion of the top surface of the hatch 2200 over a section of the hatch 2200 that includes the seal 250 to thus apply an even amount of pressure to that portion of the hatch 2200 and that portion of the seal 2250. Each additional hatch engagement member is made of steel in this example embodiment. It should be appreciated that the additional hatch engagement members may be alternatively sized, configured, and made of different materials in accordance with the present disclosure.

Figure 26:
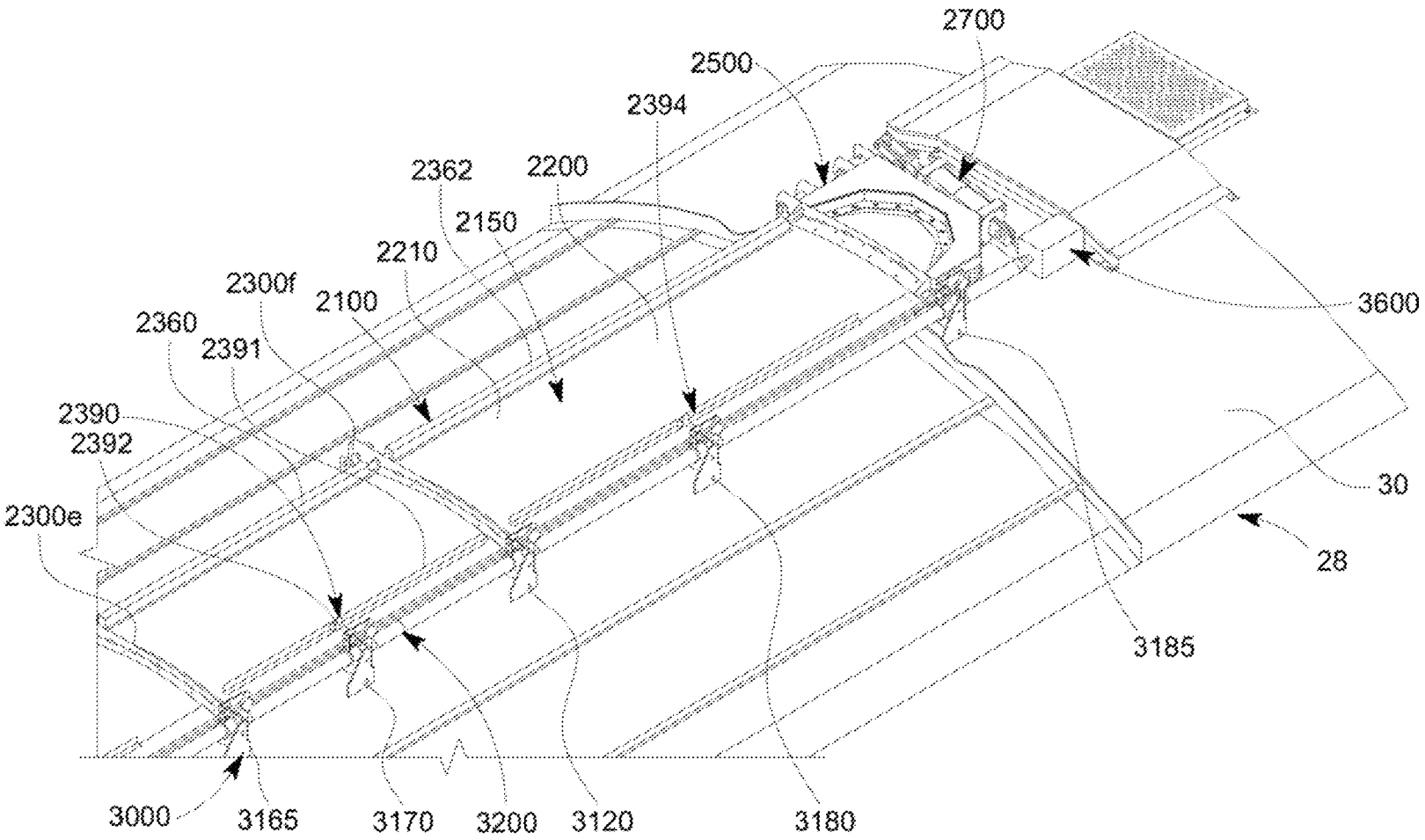
FIG. 26 is a further enlarged fragmentary top perspective view of a second end of the roof of the example hopper railroad car of FIG. 1, and a second end of the top hatch cover assembly of FIG. 20 shown connected to the second end of the roof of the hopper railroad car of FIG. 1 and shown in the closed position.
Figure 27:
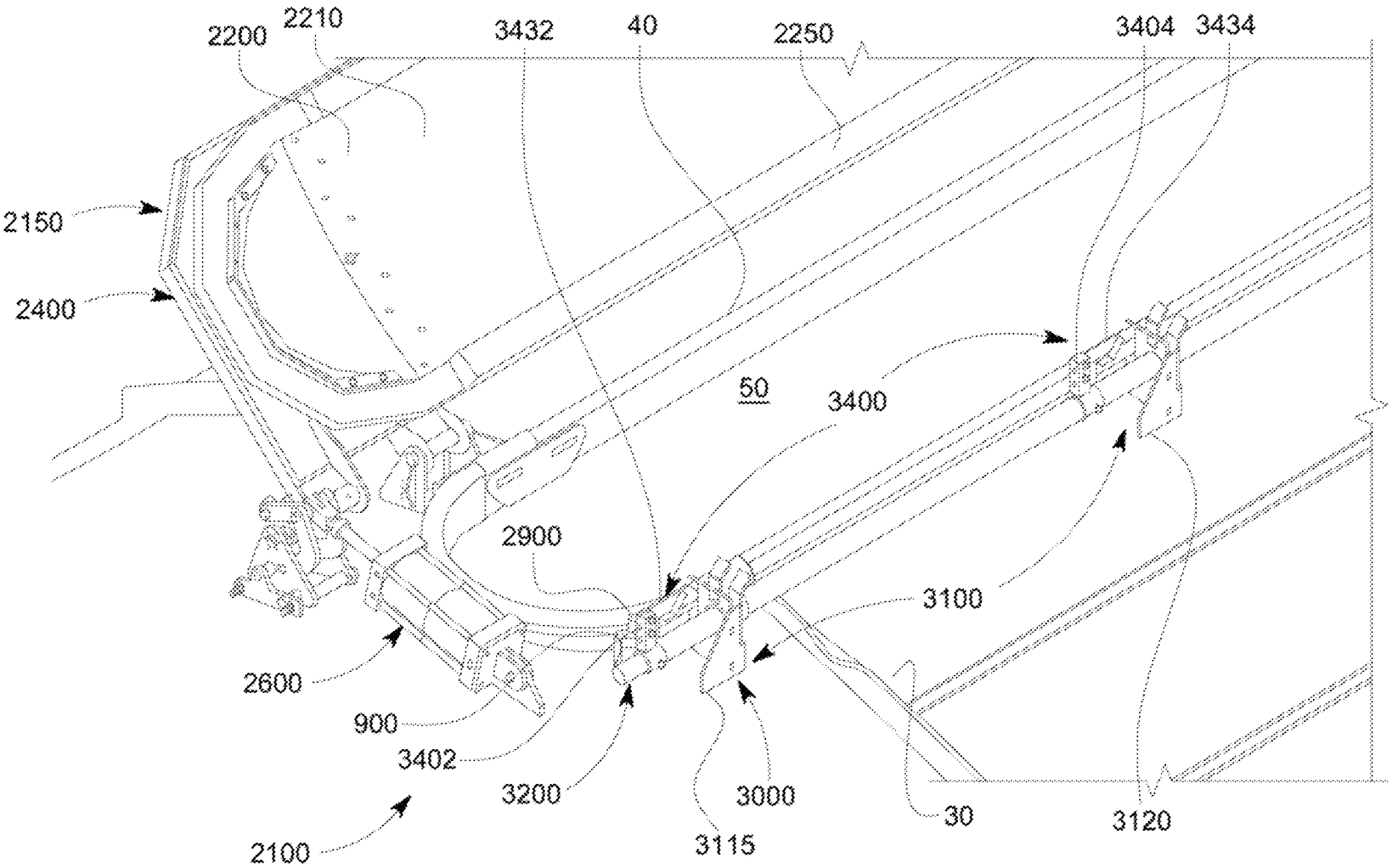
FIG. 27 is a further enlarged fragmentary top perspective view of the first end of the roof of the example hopper railroad car of FIG. 1, and the first end of the top hatch cover assembly of FIG. 20 shown connected to the first end of the roof of the hopper railroad car of FIG. 1 and shown in the fully open position.
Figure 28:
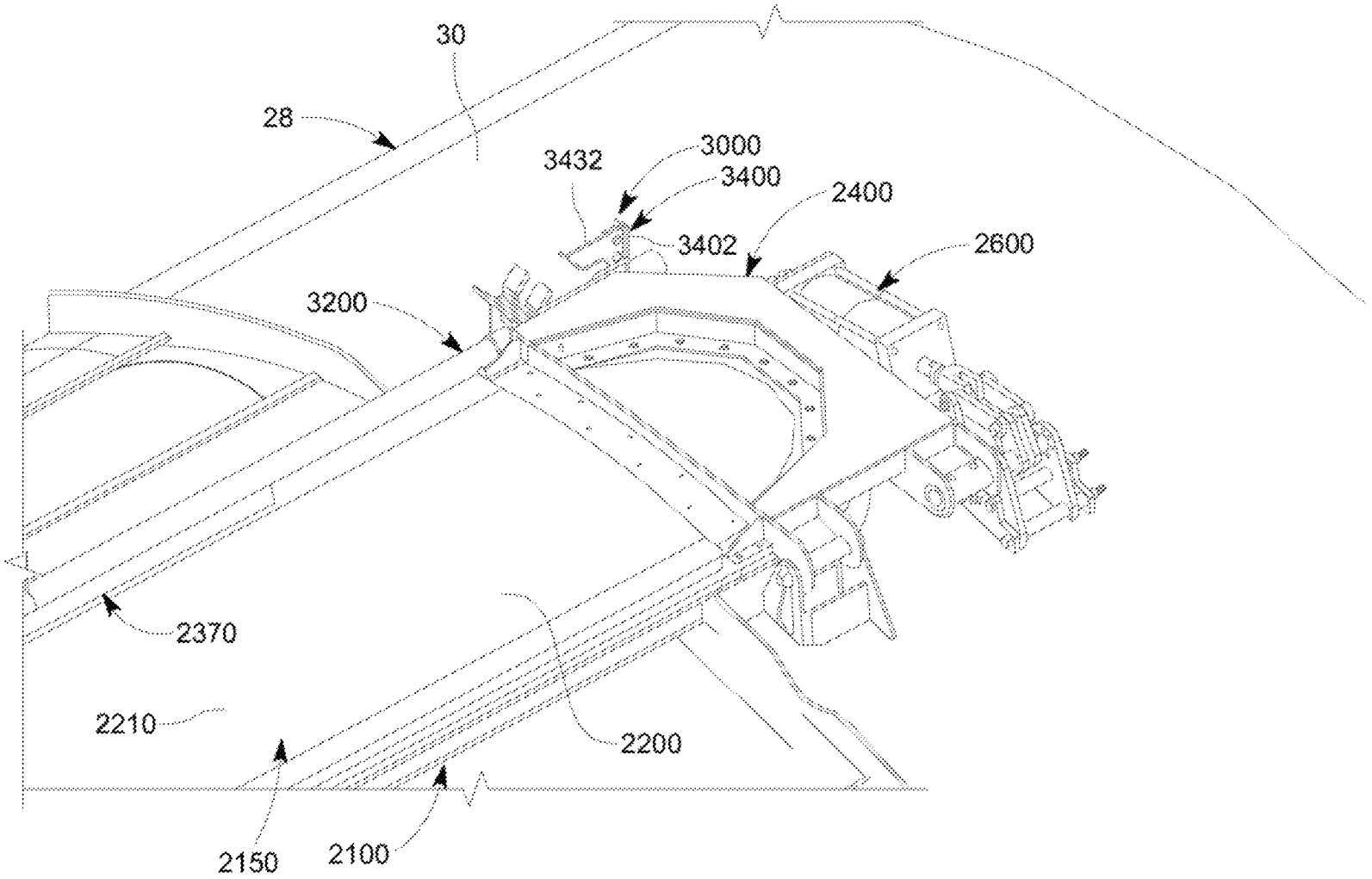
FIG. 28 is an even further enlarged fragmentary top perspective view of the first end of the roof of the example hopper railroad car of FIG. 1, and the first end of the top hatch cover assembly of FIG. 20 shown connected to the first end of the roof of the hopper railroad car of FIG. 1 and shown in the closed position.
Figure 29:
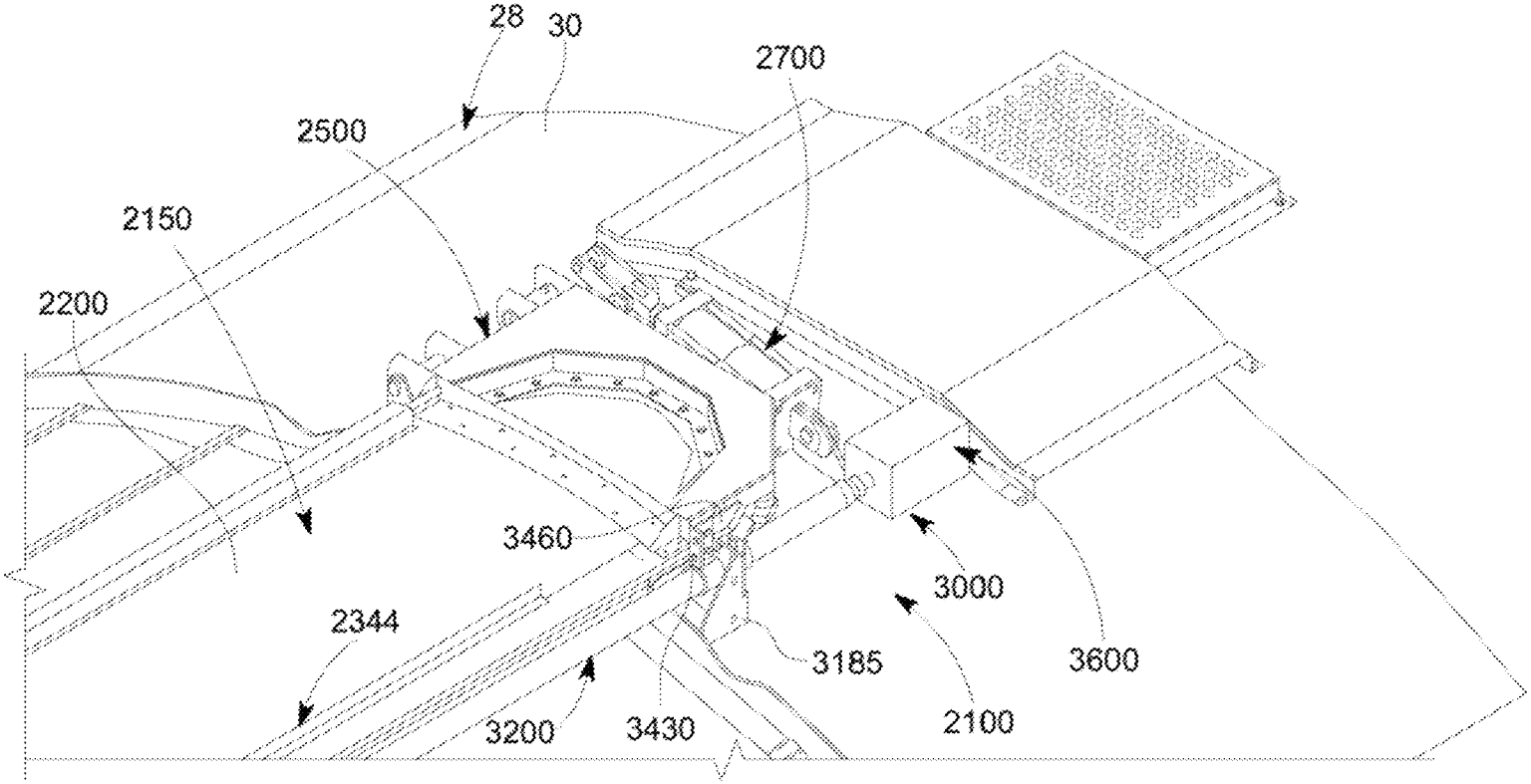
FIG. 29 is an even further enlarged fragmentary top perspective view of the second end of the roof of the example hopper railroad car of FIG. 1, and the second end of the top hatch cover assembly of FIG. 20 shown connected to the second end of the roof of the hopper railroad car of FIG. 1 and shown in the closed position.
Figure 30:
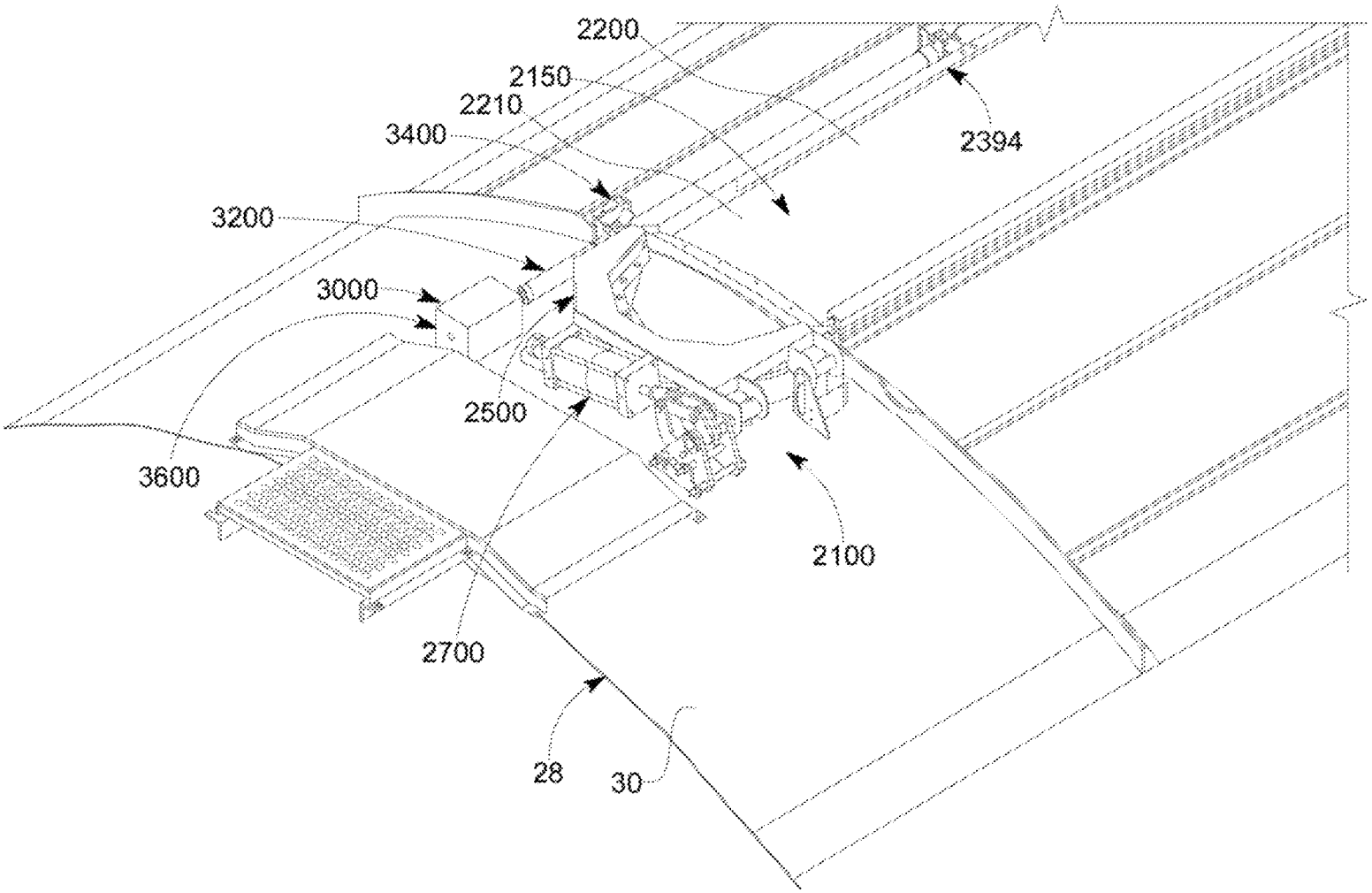
FIG. 30 is a still further enlarged fragmentary top perspective view of the second end of the roof of the example hopper railroad car of FIG. 1, and the second end of the top hatch cover assembly of FIG. 20 shown connected to the second end of the roof of the hopper railroad car of FIG. 1 and shown in the closed position.

Additionally, in this example embodiment and as also best shown in FIGS. 35, 36, 37, and 38, the hatch cover 2150 includes a plurality of additional connection arm assemblies 2370, 2374, 2378, 2382, 2386, 2390, and 2394. Each of these additional connection arm assemblies 2370, 2374, 2378, 2382, 2386, 2390, and 2394 includes a base suitably connected to the hatch 2200 by suitable fasteners (not shown) and an additional arm suitably connected to the base and extending from the base. Each additional arm includes an additional hand suitably connected to and extending from the support wall. Each hand includes an outwardly extending palm. The palm is configured to extend between sets of outwardly extending fingers (described below). For example, as shown in FIG. 26, the additional connection arm assembly 2390 includes a base 2391 suitably connected to the hatch 2200 by suitable fasteners (not shown) and an additional arm 2392 suitably connected to the base 2391 and extending from the base 2391. The additional arm includes an additional hand (not labeled) suitably connected to and extending from the support wall. Each hand includes an outwardly extending palm (not labeled). The palm is configured to extend between sets of outwardly extending fingers (described below). These additional connection arm assemblies are made of steel in this example embodiment. It should be appreciated that these additional connection arm assemblies may be alternatively sized, configured, and made of different materials in accordance with the present disclosure.

This illustrated example hatch cover securer 3000 generally includes: (1) a mounting assembly 3100; (2) a hatch cover engager mover 3200 supported by the mounting assembly 3100; (3) a biasing assembly (not shown) suitably connected to the hatch cover engager mover 3200; (4) a hatch cover engager 3400 suitably connected to the hatch cover engager mover 3200; and (5) an actuator 3600 suitably connected to the hatch cover engager mover 3200. This example hatch cover securer 3000 is different from the above described hatch cover securer 1000 in part because the hatch cover engager mover 3200 is configured to move linearly instead of rotating like the hatch cover engager mover 1200.

Figure 20:
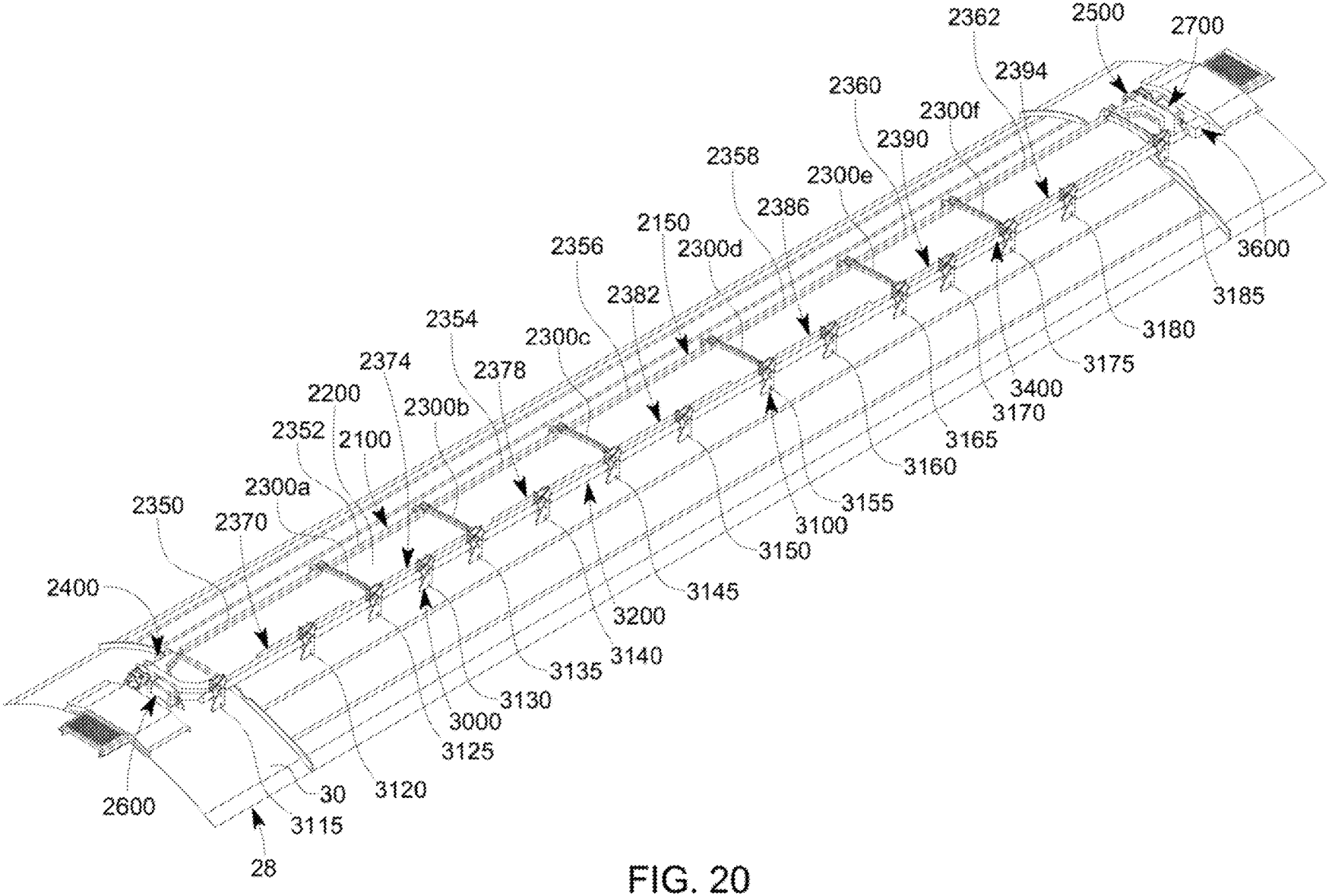
FIG. 20 is an enlarged top perspective view of the roof of the hopper railroad car of FIG. 1, showing a top hatch cover assembly of another example embodiment of the present disclosure connected to the roof of the hopper railroad car of FIG. 1 and shown in the closed position.
Figure 21:
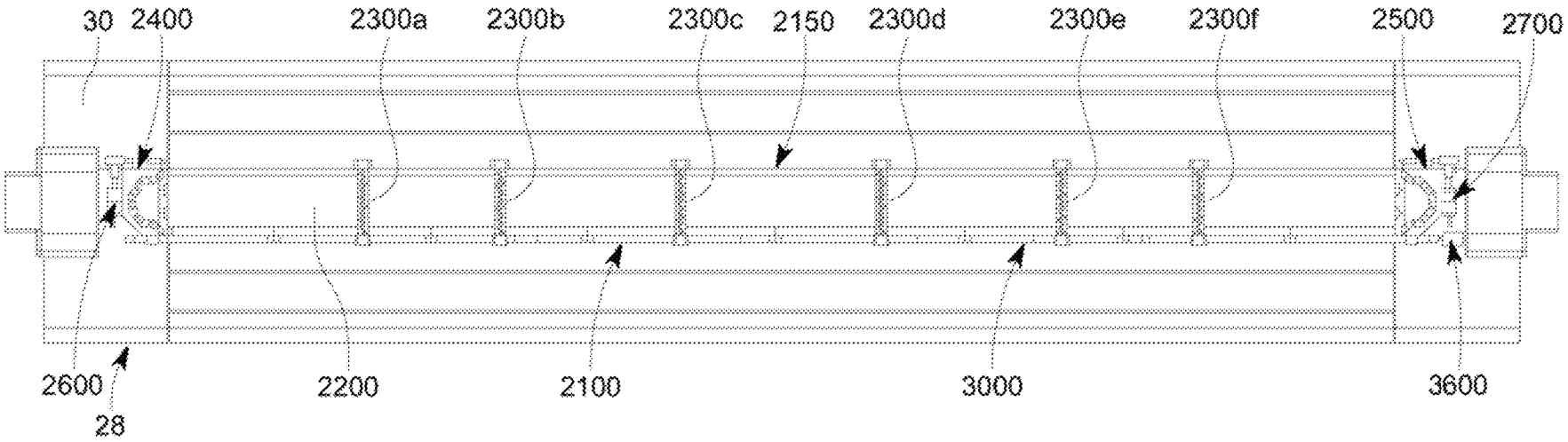
FIG. 21 is an enlarged top view of the roof of the hopper railroad car of FIG. 1, and the top hatch cover assembly of FIG. 20 shown connected to the roof of the hopper railroad car of FIG. 1 and shown in the closed position.
Figure 22:
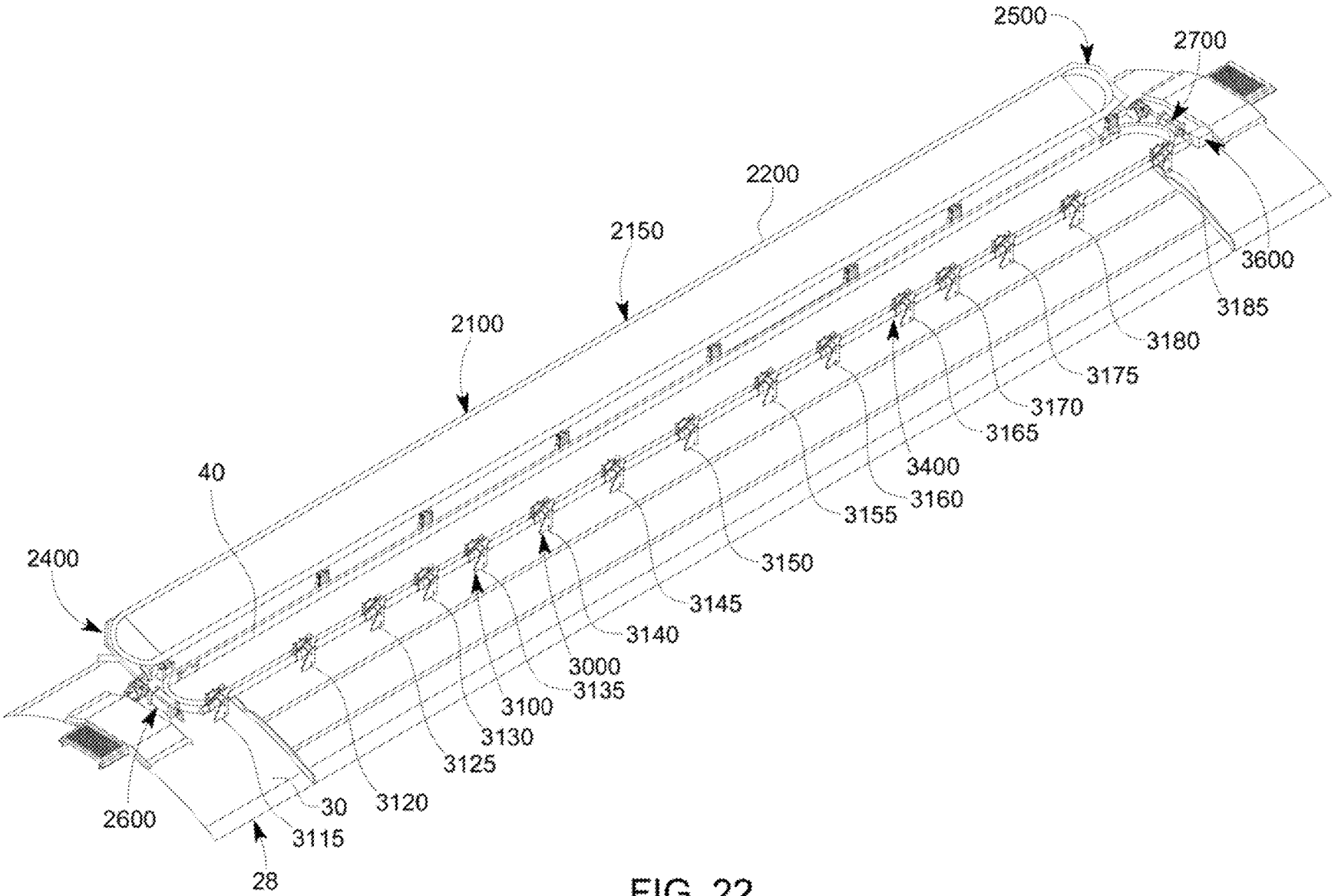
FIG. 22 is a top perspective view of the roof of the hopper railroad car of FIG. 1, and the top hatch cover assembly of FIG. 20 shown connected to the roof of the hopper railroad car of FIG. 1 and shown in a fully open position.
Figure 23:
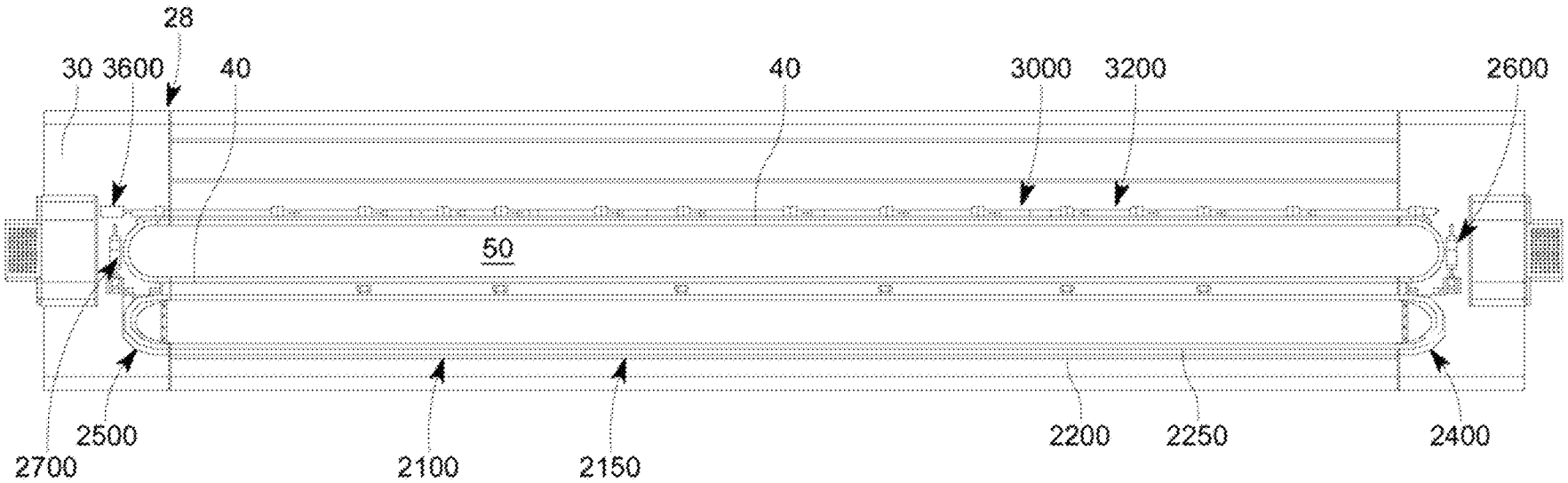
FIG. 23 is a top view of the roof of the example hopper railroad car of FIG. 1, and the top hatch cover assembly of FIG. 20 shown connected to the roof of the hopper railroad car of FIG. 1 and shown in the fully open position.
Figure 24:
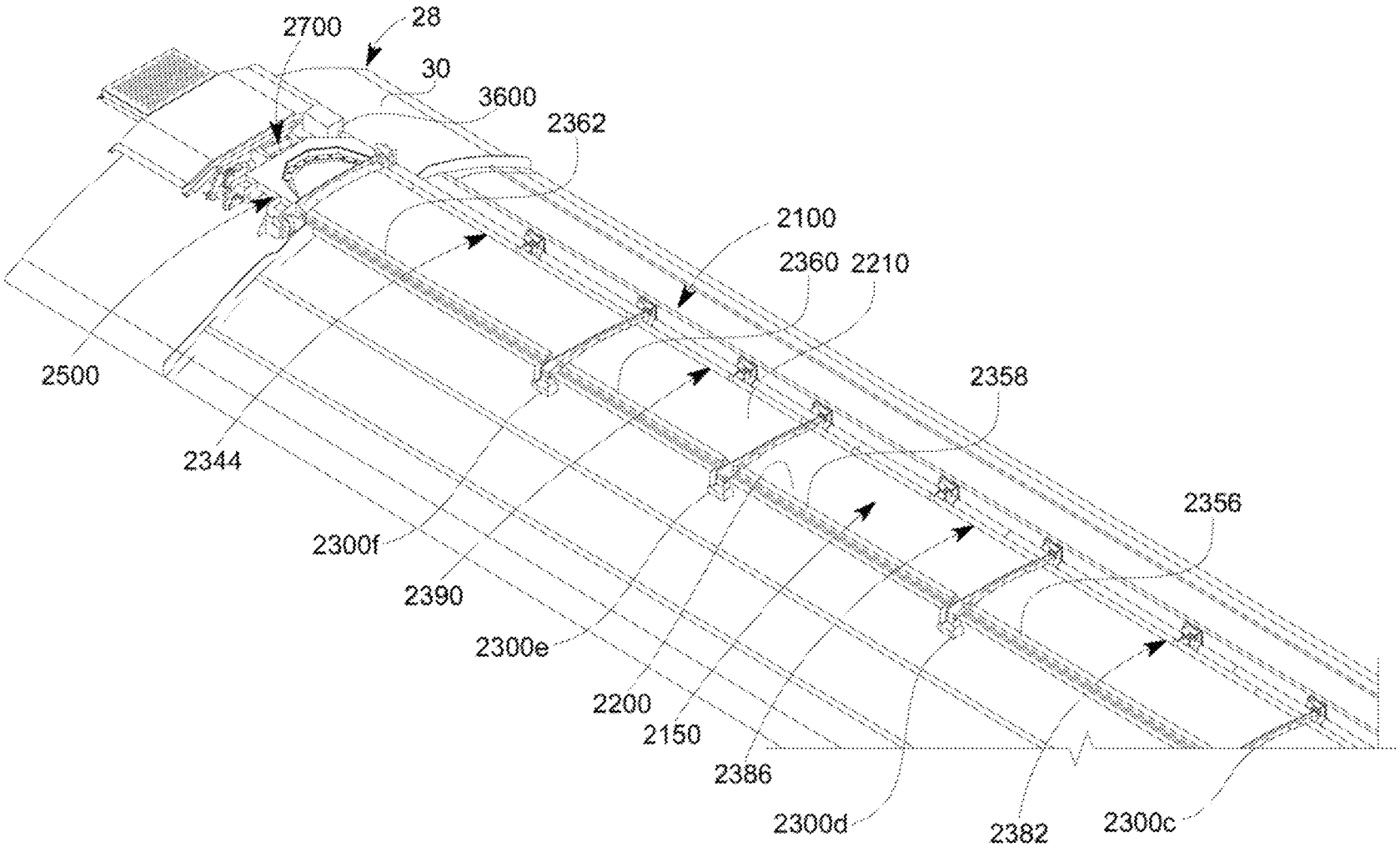
FIG. 24 is an enlarged fragmentary top perspective view of a second end of the roof of the example hopper railroad car of FIG. 1, and a second end of the top hatch cover assembly of FIG. 20 shown connected to the second end of the roof of the hopper railroad car of FIG. 1 and shown in the closed position.
Figure 25:
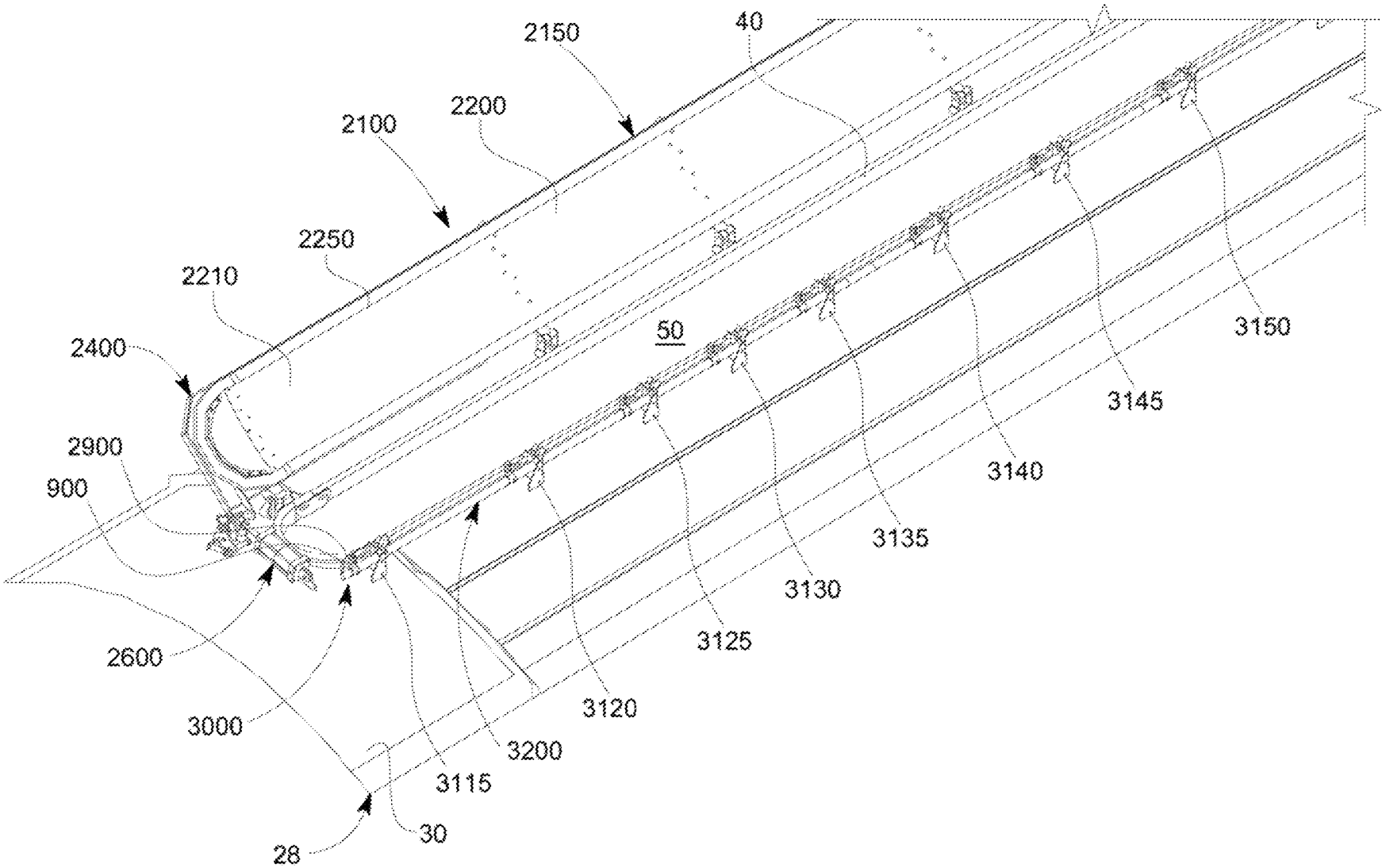
FIG. 25 is an enlarged fragmentary top perspective view of the first end of the roof of the example hopper railroad car of FIG. 1, and the first end of the top hatch cover assembly of FIG. 20 shown connected to the first end of the roof of the hopper railroad car of FIG. 1 and shown in the fully open position.

More specifically, the mounting assembly 3110 includes a plurality of spaced apart mounting brackets such as mounting brackets 3115, 3120, 3125, 3130, 3135, 3140, 3145, 3150, 3155, 3160, 3165, 3170, 3175, 3180, and 3185, as generally shown in FIGS. 20 and 22. Each of these mounting brackets 3115, 3120, 3125, 3130, 3135, 3140, 3145, 3150, 3155, 3160, 3165, 3170, 3175, 3180, and 3185 is suitably connected to the panel 30 of the roof 28, and configured to support the hatch cover engager mover 3200 and the hatch cover engager 3400. Each of these mounting brackets is identical in this example embodiment, although it should be appreciated that these mounting brackets do not need to be identical in accordance with the present disclosure. Thus, only mounting bracket 3135 is described in more detail herein for brevity. As best shown in FIGS. 35, 36, 37, and 38, the mounting bracket 3135 includes: (1) a base portion 3136; (2) a receiver portion 3137 suitably connected to the base portion 3136; and (3) four fingers 3137*a*, 3137*b*, 3138*a*, and 3138*b* integrally connected to and upwardly and outwardly extending from the receiver portion 3137. Fingers 3137*a* and 3137*b* are spaced apart and upwardly extend from the receiver portion 3137 in a first direction. Fingers 3138*a* and 3138*b* are spaced apart and upwardly extend from the receiver portion 3137 in a generally second opposite direction. Spaced apart fingers 3137*a* and 3137*b* define a first locking member receiving slot (not labeled). Spaced apart fingers 3138*a* and 3138*b* defines a second locking member receiving slot (not labeled) that is aligned with the first locking member receiving slot. These slots are configured to receive the hatch cover engager 3440 of the hatch securer 3000, as further described below. When the hatch cover engager 3440 of the hatch secure 3000 is received in these slots, the hatch cover engager 3440 engages the palm of the hand 2360*b* of the pivot arm 2340*b* and prevents the upward movement of the hand 2360*b* and the pivot arm 2340*b*. This assists in securing the hatch 2200 and the hatch cover 2150 to the coaming 40.

The base portion 3136 is fixedly connected to the panel 30 of the roof 28. The receiver portion is configured to receive and be journaled about a portion of the hatch cover engager mover 3200. In this illustrated example embodiment, the receiver portion includes a hollow cylindrical member through which part of the hatch cover engager mover 3200 extends and which supports that part of the hatch cover engager mover 3200.

The mounting brackets 3115, 3120, 3125, 3130, 3135, 3140, 3145, 3150, 3155, 3160, 3165, 3170, 3175, 3180, and 3185 are thus configured to support the hatch cover engager mover 3200 such that the hatch cover engager mover 3200 can linearly move: (1) from a first position shown best in FIGS. 26, 35, 37, and 38; (2) to a second position shown in FIGS. 27 and 36; and (3) back to the first position. Generally, in the first position, the hatch cover engager mover 3200 causes the hatch cover engager 3400 to engage various positions along the hatch cover 2150 to secure the hatch cover 2150 in the closed position and to secure the hatch cover 2150 and specifically the hatch 2200 to the coaming 40. The hatch cover engager mover 3200 is biased toward the first position by the biasing assembly 3300. Generally, in the second position, the hatch cover engager mover 3200 causes the hatch cover engager 3400 to be dis-engaged from the hatch cover 2150 and out of the way of the hatch cover 2150 to allow parts of the hatch cover 2150 (and specifically the hatch 2200 and the arms of the hinges of the hatch cover 2150 as well as the arms of the additional connection assemblies) to move from the closed position to a fully opened position.

The hatch cover engager mover 3200 includes a plurality of elongated cylindrical rods (not labeled) and a plurality of rod connectors (not labeled). The rod connectors suitably connect the rods. It should be appreciated that any suitable quantity of rods and rod connectors may be employed in accordance with the present disclosure.

The biasing assembly in this example embodiment may include one or more biasing members such as one or more springs suitably connected to the hatch cover engager mover 3200 and particularly to one or more of the rods 3210 of the hatch cover engager mover 3200. The biasing assembly in this example embodiment may be positioned in the housing for the actuation 3600 and is thus not shown. The biasing assembly is configured to bias the hatch cover engager mover 3200 and the hatch cover engager 3400 toward the first position. If the hopper railroad car or the top hatch cover assembly 2100 loses power, the biasing assembly is configured to cause the hatch cover engager mover 3200 toward the first position such that the hatch cover engager 3400 can secure the hatch cover 2150 to the coaming 40 even if the hopper railroad car or the hatch cover assembly 2100 loses power.

The hatch cover engager 3400 includes: (1) a plurality of engager supporting arms 3402, 3404, 3406 (not labeled), 3408 (not labeled), 3410, 3412 (not labeled), 3414 (not labeled), 3416 (not labeled), 3418 (not labeled), 3420 (not labeled), 3422 (not labeled), 3424 (not labeled), 3426 (not labeled), 3428 (not labeled), and 3430; and (2) a plurality of hatch cover engagers 3432, 3434, 3436 (not labeled), 3438 (not labeled), 3440, 3442 (not labeled), 3444 (not labeled), 3446 (not labeled), 3448 (not labeled), 3450 (not labeled), 3452 (not labeled), 3454 (not labeled), 3456, 3458 (not labeled), and 3460 respectively suitably connected to and extending from the plurality of engager supporting arms 3402, 3404, 3406, 3408, 3410, 3412, 3414, 3416, 3418, 3420, 3422, 3424, 3426, 3428, and 3430. The plurality of engager supporting arms 3402, 3404, 3406, 3408, 3410,

3412, 3414, 3416, 3418, 3420, 3422, 3424, 3426, 3428, and 3430 are respectively suitably connected to the rods of the hatch cover engager mover 3200 at spaced apart positions along the hatch cover engager mover 3200.

Figure 37:
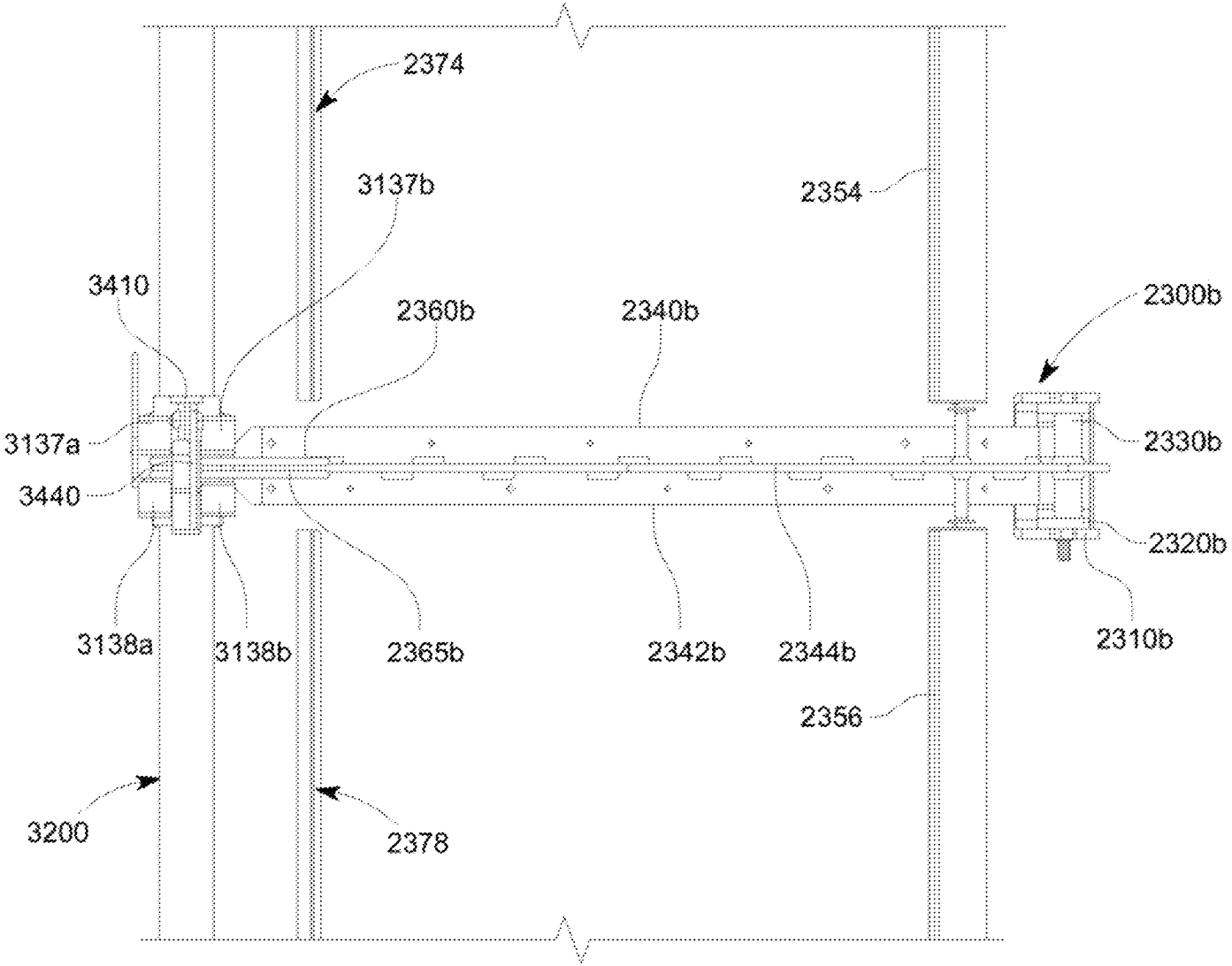
FIG. 37 is an enlarged top view of certain parts (including one of the central hinges) of the hatch cover and of certain parts (including one of the hatch cover engagers) of the hatch cover securer of the hatch cover assembly of FIG. 20.
Figure 38:
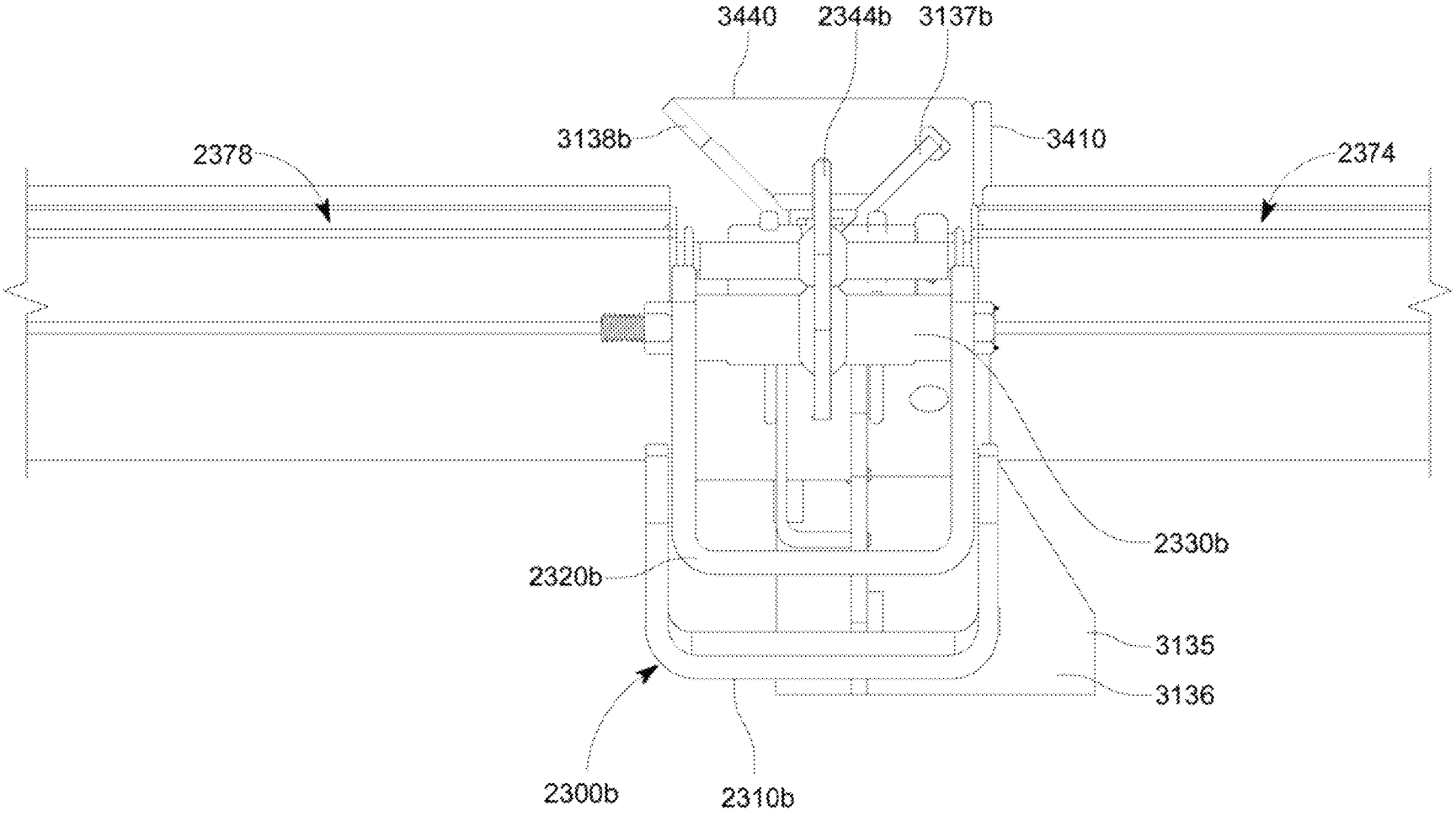
FIG. 38 is an enlarged fragmentary side view of certain parts (including one of the central hinges) of the hatch cover and of certain parts (including one of the hatch cover engagers) of the hatch cover securer of the hatch cover assembly of FIG. 20.

The plurality of hatch cover engagers 3432, 3436, 3440, 3444, 3448, 3452, 3456, and 3460 are respectively configured to move into the slots between each of the respective sets of fingers and engage the respective palms of the hands of the hinges 2400, 2300*a*, 2300*b*, 2300*c*, 2300*d*, 2300*e*, 2300*f*, and 2500 to secure the hinges 2400, 2300*a*, 2300*b*, 2300*c*, 2300*d*, 2300*e*, 2300*f*, and 2500 in place. For example, FIGS. 35, 36, 37 and 38 illustrate this engagement between hatch cover engager 3440 and the palm of the hand 2360*b* of the arm 2340*b* of the hinge 2300*b*. More specifically, FIG. 36 illustrates the arm 3410 and the hatch cover engager 3440 in the hatch cover non-engagement position where: (a) the hatch cover engager 3440 is not in the slot between the fingers 3137*a* and 3137*b*; (b) the hatch cover engager 3440 is not in the slot between fingers and 3138*a* and 3138*b*; and (c) thus the hatch cover engager 3440 is not engaging the palm 2365*b* of the hand 2360*b* of the pivot arm 2340*b* of the hinge 2300*b*. FIGS. 35, 37, and 38 illustrates that the engager mover 3200 has linearly moved and linearly moved the hatch cover engager 3440 into the hatch cover engagement position where: (a) the hatch cover engager 3440 is in the slot between the fingers 3137*a* and 3137*b*; (b) the hatch cover engager 3440 is in the slot between fingers and 3138*a* and 3138*b*; and (c) thus the hatch cover engager 3440 is engaging the palm 2365*b* of the hand 2360*b* of the pivot arm 2340*b* of the hinge 2300*b* to prevent the upward movement of the pivot arm 2340*b* of the hinge 2300*b*.

The plurality of hatch cover engagers 3434, 3438, 3442, 3446, 3450, 3454, and 3458 are likewise respectively configured to move into the slots between each of the sets of fingers and engage the respective palms of the hands of the plurality of additional connection arm assemblies 2370, 2374, 2378, 2382, 2386, 2390, and 2394.

Collectively, these multiple spaced apart engagements, enable the hatch cover securer 3000 to selectively secure the hatch 2200 of the hatch cover 2150 in place engaging the coaming.

FIGS. 31, 32, 33, and 34 further illustrate part of the operation of the hatch cover 2100 and the hatch cover securer 3000.

Figure 31:
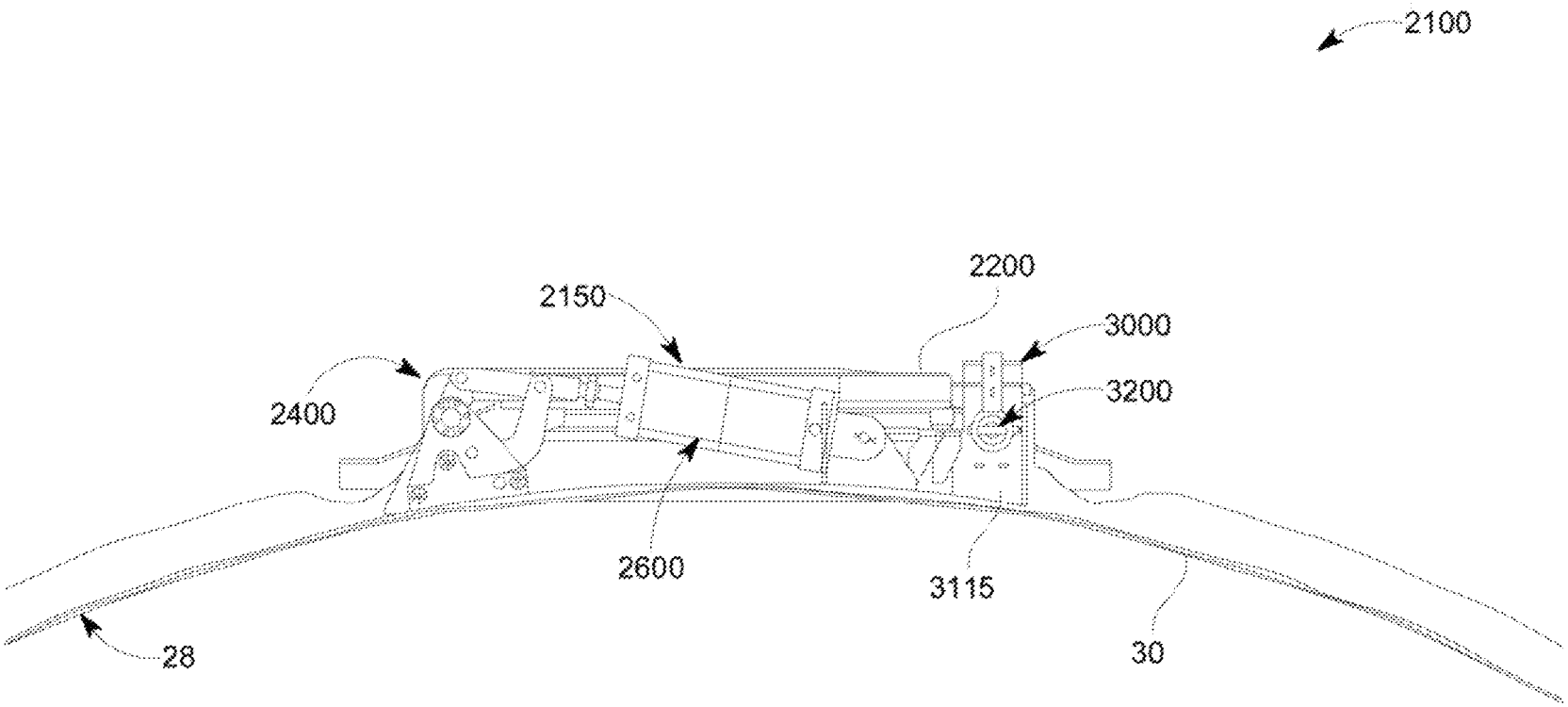
FIG. 31 is an enlarged fragmentary end view of the first end of the roof of the example hopper railroad car of FIG. 1, and the first end of the top hatch cover assembly of FIG. 20 shown connected to the first end of the roof of the hopper railroad car of FIG. 1 and shown in the closed position.

FIG. 31 illustrates the hatch cover 2100 in a closed position. In FIG. 31, the hatch cover 2100 is positioned engaging the coaming 40 such that oval coaming sealer 2250 engages (such as being positioned on) and forms a seal with a surface (such as the oval top surface) of the coaming 40. The coaming sealer 2250 remains suitably in engagement with the steel coaming 40 by the force applied by the hatch cover securer 3000. It should be appreciated that the combination of: (1) the hinge 2400; (2) the hinge 2500; (3) the pivot arms of hinges 2300*a* to 2300*f*; (4) the additional hatch engagement members 2350, 2352, 2354, 2356, 2358, 2360, and 2362; (5) the plurality of hatch cover engagers 3432, 3436, 3440, 3444, 3448, 3452, 3456, and 3460; and (6) the plurality of additional connection arm assemblies 2370, 2374, 2378, 2382, 2386, 2390, and 2394, are individually and collectively configured to engage respective portions of the top surface of the hatch 2200 over a section of the hatch 2200 that includes the seal 2250 to apply even amounts of pressure to those portions of the hatch 2200 and those portions of the seal 2250. In various embodiments, these components co-act to compress the seal under a desired amount of pressure at least point or section of the seal 2250. In various such embodiments, the amounts of pressure is even or substantially even over the entire lengths of both sides of the coaming and both ends of the coaming. In various such embodiments, the amounts of pressure are greater than 5 pounds per every 3 inches. In various embodiments, a biasing assembly can be employed to maintain this pressure even if power is lost.

Figure 32:
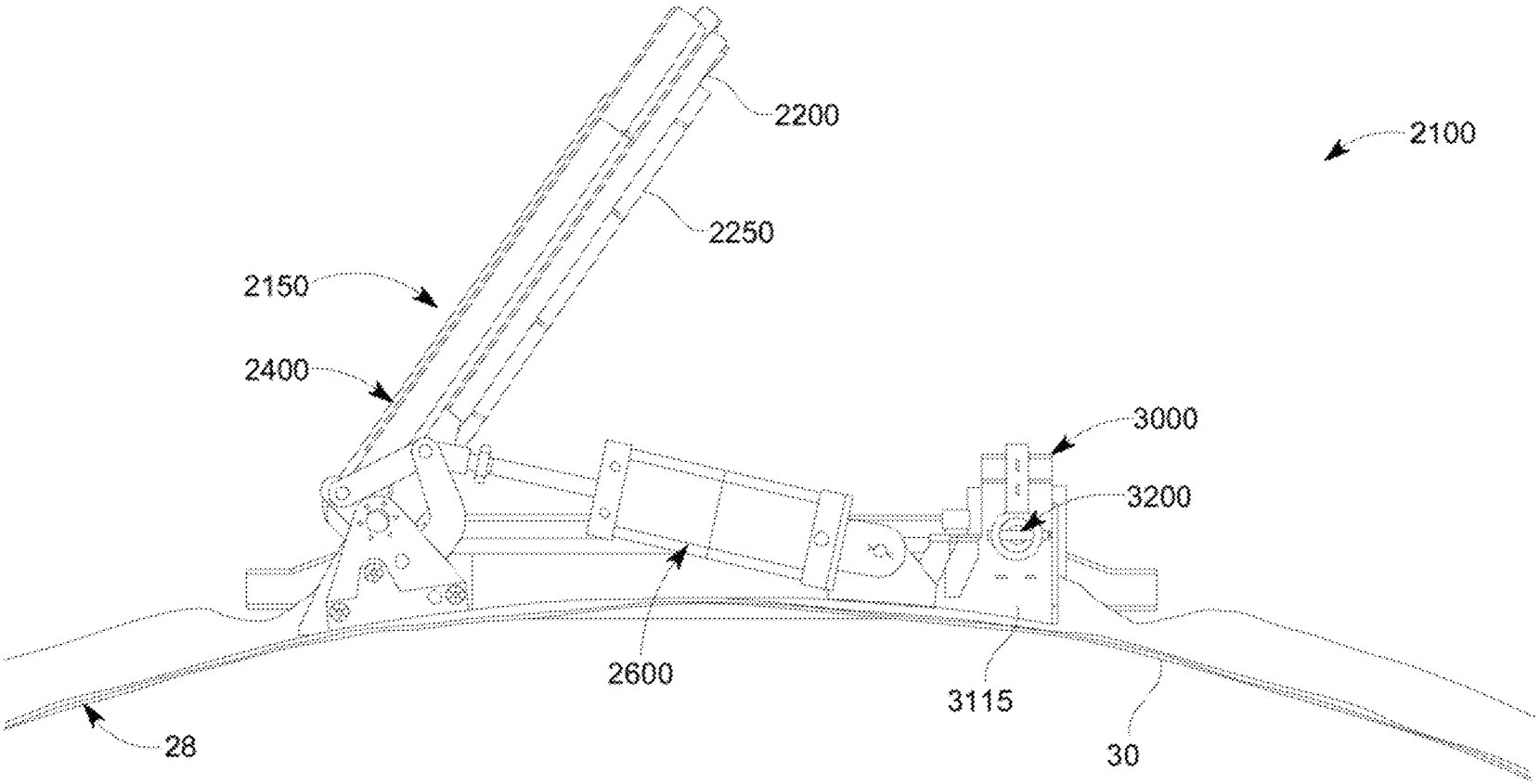
FIG. 32 is an enlarged fragmentary end view of the first end of the roof of the example hopper railroad car of FIG. 1, and the first end of the top hatch cover assembly of FIG. 20 shown connected to the first end of the roof of the hopper railroad car of FIG. 1 and shown in a partially open position.
Figure 33:
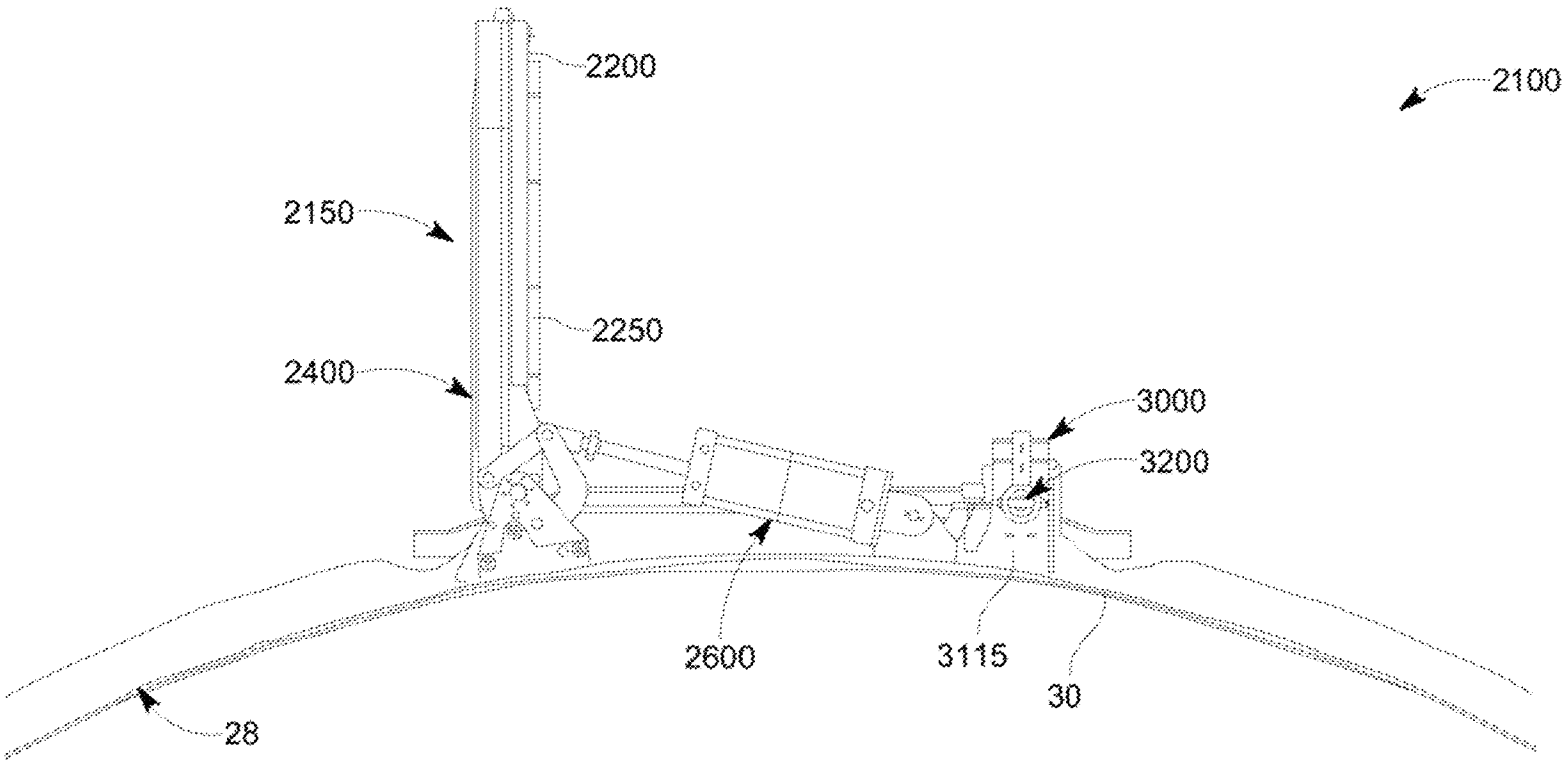
FIG. 33 is an enlarged fragmentary end view of the first end of the roof of the example hopper railroad car of FIG. 1, and the first end of the top hatch cover assembly of FIG. 20 shown connected to the first end of the roof of the hopper railroad car of FIG. 1 and shown in a further partially open position.

FIGS. 32 and 33 illustrate the hatch cover 2100 in partially open positions. To open the hatch 2200, the actuator 3600 linearly moves the hatch cover engager mover 3200 and the hatch cover engager 3400 suitably connected to the hatch cover engager mover 3200 to move the hatch cover engager 3400 from the hatch cover engagement position to the hatch cover non-engagement position. FIG. 32 shows the hatch cover 2150 with the hatch 2200 partially opened. FIG. 33 shows the hatch 2100 further partially opened.

Figure 34:
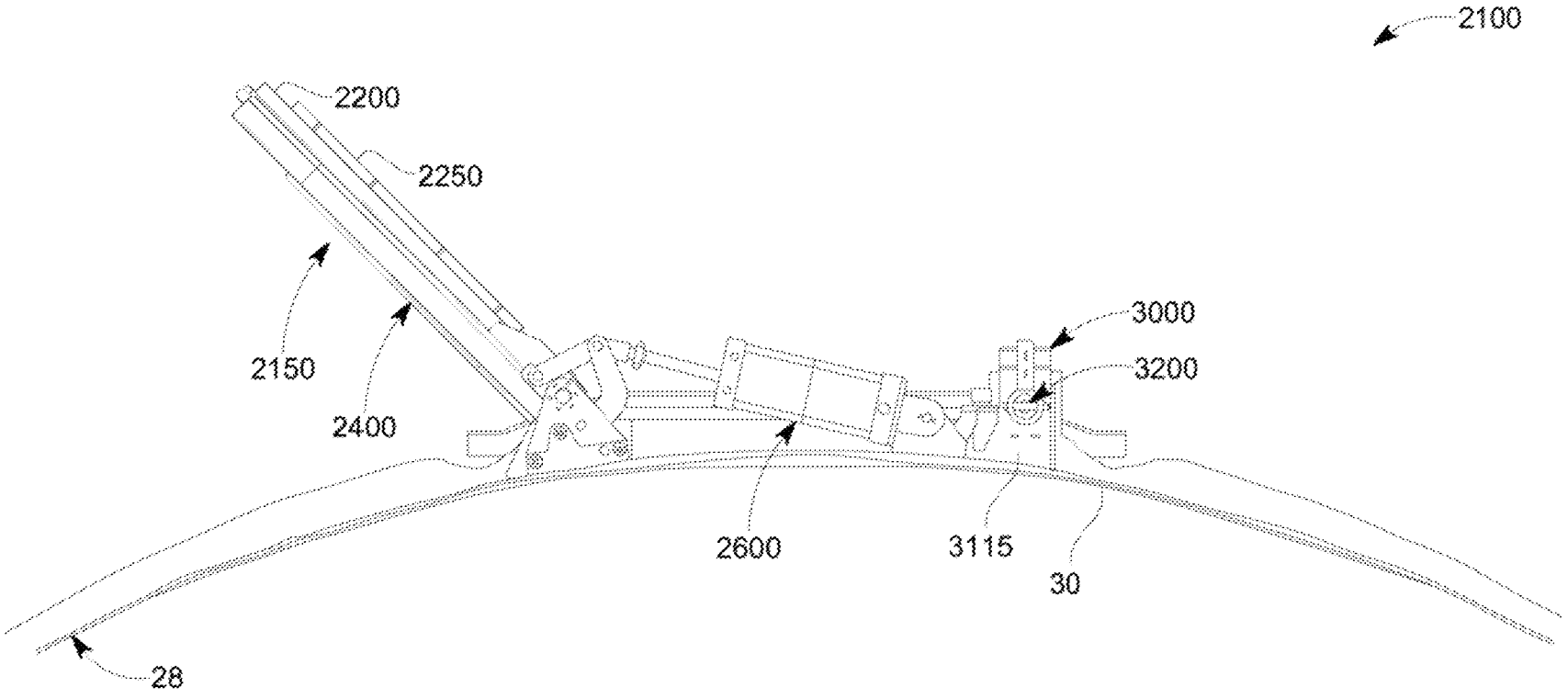
FIG. 34 is an enlarged fragmentary end view of the first end of the roof of the example hopper railroad car of FIG. 1, and the first end of the top hatch cover assembly of FIG. 20 shown connected to the first end of the roof of the hopper railroad car of FIG. 1 and shown in the fully open position.

FIG. 34 illustrates the hatch cover 3100 in the fully open position. To move to the closed position, the process is reversed.

It should be appreciated that the present disclosure contemplates adding bumpers for supporting the hinges 1400 and 1500. Such bumpers can include one or more rubber compressible bumper members.

It will be understood that modifications and variations may be effected without departing from the scope of the novel concepts of the present invention, and it is understood that this application is to be limited only by the scope of the claims.

The invention claimed is:

1. A hopper railroad car top hatch cover assembly for a hopper railroad car including a roof including an upwardly extending coaming, wherein each of the hopper railroad car, the roof, and the coaming extend from end to end in a longitudinal direction and from side to side in a transverse direction, the hopper railroad car hatch cover assembly comprising:

a hatch cover pivotally connectable on one side of the coaming and including a movable hatch pivotally movable from a closed position engaging the coaming to an open position disengaged from the coaming; and a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position, wherein the hatch cover engager is pivotable, along a longitudinal axis that extends in the longitudinal direction, from the hatch cover engagement position to the hatch cover non-engagement position.

2. The hopper railroad car top hatch cover assembly of claim 1, wherein the hatch cover securer includes a hatch cover engager rotator connected to the hatch cover engager and configured to pivot the hatch cover engager about the longitudinal axis from the hatch cover engagement position to the hatch cover non-engagement position.

3. The hopper railroad car top hatch cover assembly of claim 1, wherein the hatch cover engager is configured to engage a pivot arm of a hinge of the hatch cover when the hatch cover engager is in the hatch cover engagement position.

4. The hopper railroad car top hatch cover assembly of claim 3, wherein the hatch cover engager is also configured to engage a hatch of the hatch cover when the hatch cover engager is in the hatch cover engagement position.

5. The hopper railroad car top hatch cover assembly of claim 1, wherein the hatch cover engager is configured to engage a hatch of the hatch cover when the hatch cover engager is in the hatch cover engagement position.

6. The hopper railroad car top hatch cover assembly of claim 1, wherein the hatch cover includes a plurality of additional hatch engagement members extending between and rotatably connected to and between pairs of respective pivot arms of the hinges of the hatch cover.

7. The hopper railroad car top hatch cover assembly of claim 1, wherein the hatch cover includes a sealer and the hatch cover and the hatch cover engager are configured to co-act apply a substantially even amount of pressure on the sealer when the hatch cover is in the engagement position and when the hatch cover engager secures the movable hatch in the closed position engaging the coaming.

8. The hopper railroad car top hatch cover assembly of claim 1, which includes a bumper connected to the roof and configured to support one of the hinges of the hatch cover.

9. A hopper railroad car comprising:

a frame;

spaced apart side walls supported by the frame;

spaced apart end wall supported by the frame;

a roof supported by the side walls, the roof includes a panel and a coaming supported by and upwardly extending from the panel, the coaming partially defining an opening in the roof, wherein each of the hopper railroad car, the roof, and the coaming extend from end to end in a longitudinal direction and from side to side in a transverse direction; and a top hatch cover assembly including:

a hatch cover pivotally connectable on one side of the coaming and including a movable hatch pivotally movable from a closed position engaging the coaming to an open position disengaged from the coaming, and a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position, wherein the hatch cover engager is pivotable, along a longitudinal axis that extends in the longitudinal direction, from the hatch cover engagement position to the hatch cover non-engagement position.

10. The hopper railroad car of claim 9, wherein the hatch cover securer includes a hatch cover engager rotator connected to the hatch cover engager and configured to pivot the hatch cover engager about the longitudinal axis from the hatch cover engagement position to the hatch cover non-engagement position.

11. The hopper railroad car of claim 9, wherein the hatch cover engager is configured to engage a pivot arm of a hinge of the hatch cover when the hatch cover engager is in the hatch cover engagement position.

12. The hopper railroad car of claim 11, wherein the hatch cover engager is also configured to engage a hatch of the hatch cover when the hatch cover engager is in the hatch cover engagement position.

13. The hopper railroad car of claim 9, wherein the hatch cover engager is configured to engage a hatch of the hatch cover when the hatch cover engager is in the hatch cover engagement position.

14. The hopper railroad car of claim 9, wherein the hatch cover includes a plurality of additional hatch engagement members extending between and rotatably connected to and between pairs of respective pivot arms of hinges of the hatch cover.

15. The hopper railroad car of claim 9, wherein the hatch cover includes a sealer and the hatch cover and the hatch cover engager are configured to co-act to apply a substantially even amount of pressure on the sealer when the hatch cover is in the engagement position and when the hatch cover engager secures the movable hatch in the closed position engaging the coaming.

16. The hopper railroad car of claim 9, which includes a bumper connected to the roof and configured to support one of the hinges of the hatch cover.

17. A hopper railroad car top hatch cover assembly for a hopper railroad car including a roof including an upwardly extending coaming, the hopper railroad car hatch cover assembly comprising:

a hatch cover pivotally connectable on one side of the coaming and including a movable hatch pivotally movable from a closed position engaging the coaming to an open position disengaged from the coaming; and a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position, wherein the hatch cover securer includes a hatch cover engager mover connected to the hatch cover engager and configured to linearly move the hatch cover engager from the hatch cover engagement position to the hatch cover non-engagement position.

18. The hopper railroad car top hatch cover assembly of claim 17, wherein the hatch cover engager is configured to engage a pivot arm of a hinge of the hatch cover when the hatch cover engager is in the hatch cover engagement position.

19. The hopper railroad car top hatch cover assembly of claim 18, wherein the hatch cover engager is configured to engage a hand of a pivot arm of a hinge of the hatch cover when the hatch cover engager is in the hatch cover engagement position.

20. A hopper railroad car comprising:

a frame;

spaced apart side walls supported by the frame;

spaced apart end wall supported by the frame;

a roof supported by the side walls, the roof includes a panel and a coaming supported by and upwardly extending from the panel, the coaming partially defining an opening in the roof; and a top hatch cover assembly including:

a hatch cover pivotally connectable on one side of the coaming and including a movable hatch pivotally movable from a closed position engaging the coaming to an open position disengaged from the coaming, and a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position, wherein the hatch cover engager is linearly movable from the hatch cover engagement position in which the hatch cover engager secures the hatch cover to the hatch cover non-engagement position.

21. The hopper railroad car of claim 20, wherein the hatch cover securer includes a hatch cover engager mover connected to the hatch cover engager and configured to linearly move the hatch cover engager from the hatch cover engagement position to the hatch cover non-engagement position.

22. The hopper railroad car of claim 21, wherein the hatch cover engager is configured to engage a pivot arm of a hinge of the hatch cover when the hatch cover engager is in the hatch cover engagement position.

23. A hopper railroad car top hatch cover assembly for a hopper railroad car including a roof including an upwardly extending coaming, the hopper railroad car hatch cover assembly comprising:

a hatch cover pivotally connectable on one side of the coaming and including a movable hatch pivotally movable from a closed position engaging the coaming to an open position disengaged from the coaming, wherein the hatch cover includes a plurality of additional hatch engagement members extending between and rotatably connected to and between pairs of respective pivot arms of the hinges of the hatch cover; and a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position.

24. A hopper railroad car comprising:

a frame;

spaced apart side walls supported by the frame;

spaced apart end wall supported by the frame;

a roof supported by the side walls, the roof includes a panel and a coaming supported by and upwardly extending from the panel, the coaming partially defining an opening in the roof; and a top hatch cover assembly including:

a hatch cover pivotally connectable on one side of the coaming and including a movable hatch pivotally movable from a closed position engaging the coaming to an open position disengaged from the coaming, wherein the hatch cover includes a plurality of additional hatch engagement members extending between and rotatably connected to and between pairs of respective pivot arms of hinges of the hatch cover, and a hatch cover securer movably connectable on an opposite side of the coaming and including a hatch cover engager movable from a hatch cover engagement position in which the hatch cover engager secures the movable hatch in the closed position engaging the coaming to a hatch cover non-engagement position in which the hatch cover engager allows the movable hatch to move to the open position.

* * * * *